US010212977B2

(12) United States Patent
Eyal et al.

(10) Patent No.: US 10,212,977 B2
(45) Date of Patent: Feb. 26, 2019

(54) FASTENER FOR BRA, AND A BRA HAVING SUCH FASTENER

(71) Applicant: Delta Galil Industries Ltd., Caesarea (IL)

(72) Inventors: Yoel Eyal, Tel Aviv (IL); Esther Maoz, Tel Aviv (IL)

(73) Assignee: DELTA GALIL INDUSTRIES LTD., Caesarea (IL)

( * ) Notice: Subject to any disclaimer, the term of this patent is extended or adjusted under 35 U.S.C. 154(b) by 0 days.

(21) Appl. No.: 15/657,152

(22) Filed: Jul. 23, 2017

(65) Prior Publication Data

US 2017/0332718 A1 Nov. 23, 2017

Related U.S. Application Data

(63) Continuation-in-part of application No. PCT/IB2016/050385, filed on Jan. 26, 2016.
(Continued)

(51) Int. Cl.
*A41F 1/00* (2006.01)
*A41C 3/00* (2006.01)
(Continued)

(52) U.S. Cl.
CPC ..... *A41F 1/006* (2013.01); *A41C 3/0028* (2013.01); *A44B 13/0052* (2013.01); *A41C 3/02* (2013.01)

(58) Field of Classification Search
CPC ..... Y10T 24/45958; Y10T 24/45963; Y10T 24/4523; Y10S 24/43; A41F 1/006;
(Continued)

(56) References Cited

U.S. PATENT DOCUMENTS 3,484,907 A * 12/1969 Elsenheimer ..... A41F 1/006 24/588.12
4,728,064 A * 3/1988 Caveney ..... B65D 63/1081 24/16 PB
(Continued)

FOREIGN PATENT DOCUMENTS

| | | |
|---|---|---|
| GB | 941120 | 11/1963 |
| GB | 2398825 | 9/2004 |
| WO | 2007091025 | 8/2007 |

OTHER PUBLICATIONS

International Search Report for PCT/IB2016/050385 dated May 30, 2016.
(Continued)

*Primary Examiner* — Gloria M Hale
(74) *Attorney, Agent, or Firm* — Eitan Mehulal Sadot

(57) ABSTRACT

A bra, a garment, an article of clothing, and a fastener for such items. A bra includes: two cups located at a front-side of the bra; and a fastener located at a back-side of the bra. The back-side of the bra has a first region and a second region. The fastener enables (A) attachment of the first region to the second region, and (B) detachment of the first region from the second region. The fastener includes: (I) a male member located in the first region of the back-side of the bra, and (II) a female member located in the second region of the back-side of the bra. The male member includes a single wide hook. The female member includes a set of multiple spaced-apart wide bridges, each bridge protruding outwardly and generally-perpendicularly relative to the second region of the back-side of the bra. Each bridge is generally perpendicular to the longest dimension of the back-side of the bra.

20 Claims, 30 Drawing Sheets

Related U.S. Application Data

(60) Provisional application No. 62/108,077, filed on Jan. 27, 2015.

(51) Int. Cl.
*A44B 13/00* (2006.01)
*A41C 3/02* (2006.01)

(58) Field of Classification Search
CPC ..... A41C 3/00; A41C 3/0028; A41C 3/02; A44B 13/0052
USPC ..... 450/58; 2/336, 338
See application file for complete search history.

(56) References Cited

U.S. PATENT DOCUMENTS 5,776,123 A 7/1998 Goerg et al.
5,896,826 A * 4/1999 Winer ..... G09F 3/04 116/200
6,163,941 A * 12/2000 Lai ..... A43C 11/1413 24/191
6,173,479 B1 * 1/2001 Howell ..... A44B 11/258 24/578.12
6,185,791 B1 * 2/2001 Khokhar ..... B65D 63/1063 24/16 PB
6,186,451 B1 * 2/2001 Benoit ..... F16L 3/233 24/16 PB
6,553,635 B1 * 4/2003 Howell ..... A44B 11/258 24/593.11
6,793,556 B1 * 9/2004 Fildan ..... A41C 3/02 2/323
8,745,829 B2 * 6/2014 Wanzenboeck ..... A41F 1/006 2/338
8,869,358 B2 * 10/2014 Wanzenboeck ..... A41F 1/006 24/591.1
2006/0189254 A1 8/2006 Hood
2006/0286901 A1 12/2006 Cremer et al.
2014/0317822 A1 10/2014 Friedman

OTHER PUBLICATIONS

Written Opinion of the International Search Authority for PCT/IB2016/050385 dated May 30, 2016.
International Preliminary Report on Patentablitlity for PCT/IB2016/050385 dated Aug. 1, 2017.
Extended European Search Report (EESR) in European patent application No. EP 16742863, prepared by the European Patent Office (EPO) dated Oct. 9, 2018, and mailed out by the EPO dated Oct. 17, 2018.

* cited by examiner

Side View

FASTENER FOR BRA, AND A BRA HAVING SUCH FASTENER

CROSS-REFERENCE TO RELATED APPLICATION

This patent application is a Continuation-in-Part (CIP) of PCT International application number PCT/IB2016/050385, having an international filing date of Jan. 26, 2016, published as International Publication number WO 2016/120790, which is hereby incorporated by reference in its entirety; which claims priority and benefit from U.S. provisional patent application No. 62/108,077, filed on Jan. 27, 2015, which is hereby incorporated by reference in its entirety.

FIELD OF THE INVENTION

The present invention relates to the field of articles of clothing.

BACKGROUND

A brassiere, commonly referred to as a bra, is an undergarment able to support a female's breasts. A bra may provide to its user support and comfort, particularly during a physical activity, for example, running or exercising.

Some bras may provide other functions or features. For example, a "push-up" bra may modify the shape or may increase the perceived size of breasts. Conversely, some bras may be form-fitting and may minimize breasts size.

SUMMARY

The present invention may include, for example, a bra having a unique fastener or an innovative opening/closing mechanism, as described herein. For example, a back side or a back-strap of a bra may comprise a mechanism having a male member and a female member; the male member being a single, large, wide, hook or curved-tooth; the female member being a set of batch or row of multiple bridges, each bridge being a large, wide, upside-down "u" shaped (or "n" shaped) eye-member or bridge-member.

The present invention may provide other and/or additional benefits or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION OF THE INVENTION

Figure 1B:
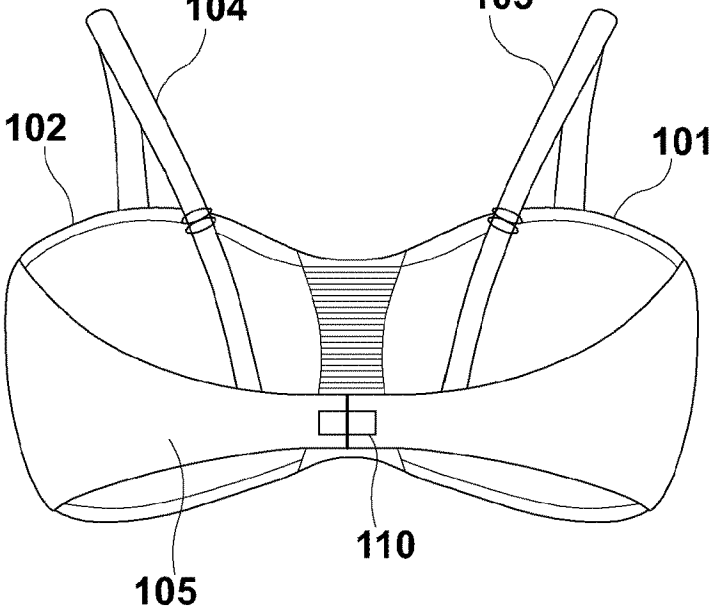
FIGS. 1A-1B are schematic illustrations of a bra, in accordance with some demonstrative embodiments of the present invention.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or modules have not been described in detail so as not to obscure the discussion.

The applicants have realized that a conventional bra may sometimes be difficult to open and/or to close, since it may use a plurality of hook-and-eye pairs that may be located at multiple locations with multiple vertical spacing between them; and the opening or closing of such conventional bra may be difficult, slow, time-consuming, effort-consuming, error-prone, and/or inconvenient; particularly since, for example, the female user is often required to open and close her bra "blindly" without the ability to actually see with her eyes the opening/closing mechanism which is typically located at the back area; and since the female user is often required to maneuver her arms or hands or shoulders in uncomfortable positions behind her back in order to "blindly" open or close such conventional bra. The applicants have also realized that due to the great difficulty of engaging multiple hook-members with multiple respective eye-members, which are (the hooks and the eyes) of minuscule dimensions and are located at the back side of the female wearer, may be difficult and frustrating for many female users; and may even cause many female users to put-on a bra in a cumbersome manner, in which the female user firstly puts on the bra "backwards" such that the multiple hook-and-eye mechanisms are temporarily located at the front (e.g., at the breast area of the female user), then the female user closes the mechanism, and then the female user manipulates the bra and its straps "backwardly" (e.g., over the head and/or around the shoulders or arms), in an awkward and cumbersome movement.

The applicants have realized that a conventional bra may sometimes be difficult to open and/or to close, since it may use a plurality of hook-and-eye pairs that may be very small (e.g., intentionally, in order to eliminate a visible trace of the bra through a garment that is worn over it), and may be located at multiple vertical (south-to-north) locations with multiple vertical (south-to-north) spacing between them. For example, a conventional bra may require a user to insert a set of two or three or four vertically-spaced hooks, into a matching set of two or three or four vertically-spaced eyes, out of multiple horizontally-spaced sets of such eyes. This may be difficult, slow, time-consuming, effort-consuming, error-prone, awkward, cumbersome, and/or inconvenient. Furthermore, a female user may inadvertently or mistakenly skip a hook, or skip an eye, or insert a first hook into a first eye that belongs to a first vertical set of eyes while also inserting a second hook into a second eye that belongs to a second vertical set of eyes.

The applicants have realized that some conventional fastening mechanisms for bras may fail to solve these problems. For example, Applicants have realized that some conventional fastening mechanism may necessarily comprise and/or utilize a rigid frame (e.g., plastic oval-shaped frame), which may add to the weight of the bra, and cause the bra to be a non light-weight article of clothing, and/or may cause the wearer to feel uncomfortable due to a plastic buckle or fastener touch her body (e.g., her back) for long hours every day, or such plastic fastener or buckle rubbing against the wearer's body as she moves or walks or runs. Furthermore, such rigid fastener frame may be subject to breaking, for example, due to wear and tear over multiple utilizations of the fastener or the bra; due to dropping the bra on the floor and damaging or breaking the frame or the fastener; due to washing or drying the bra in a washer or a dryer which causes the bra and its fastener to spin rapidly and/or to accelerate towards walls of such washer or dryer; or the like.

The applicants have realized that there is a need for an improved opening/closing mechanism, or fastener, or fastening mechanism, or attachment/detachment mechanism, for bras and/or for other similar articles of clothing (e.g., a sports bra, a swimsuit, a lingerie item, or the like).

While some portions of the discussion herein may relate, for demonstrative purposes, to a bra or brassiere comprising a fastener or an open/close mechanism or an attachment/detachment mechanism, it is clarified that the present invention may further comprise, and may be utilized in conjunction with, other suitable garments or articles of clothing, for example, a swimsuit, a bikini-type swimsuit, a camisole, a lingerie item of clothing, a sports bra, an athletic bra or garment, a night-time garment (e.g., pajama), a form-fitting garment or shirt, a training bra, or the like.

In accordance with some demonstrative embodiments of the present invention, a bra may include two front-side cups to hold or support the breast of the user. The bra may be a strapless bra that lacks any straps going over the shoulders of the wearer; or, the bra may be a straps bra, having a right-shoulder strap and a left-shoulder strap going over the shoulders of the wearer, and the size of such shoulder straps may user-adjustable or user-modifiable. Optionally, the bra may be a single-strap bra, in which a single strap runs diagonally or in a slanted manner across or over one of the shoulders of the female user.

The bra may further include a back-wing or back-strap, which may comprise of two regions that may be connected to each other and detached from each other by utilizing an open/close mechanism or attachment/detachment mechanism, or a fastener or a fastening mechanism. For example, a right-side portion or area or region of the back-wing or back-strap of the bra may comprise a first part of the fastener; and a left-side portion or area or region of the back-wing of back-strap of the bra may comprise a second part of the fastener which may be able to selectively engage with (and dis-engage from) the first part of the fastener.

Figure 1A:
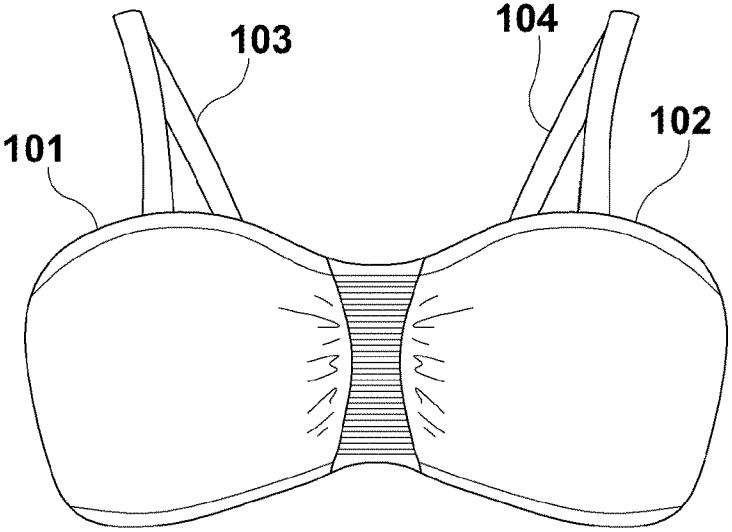

Reference is made to FIGS. 1A-1B, which are schematic illustrations (front-view and rear-view) of a bra 199 in accordance with some demonstrative embodiments of the present invention. Bra 199 may comprise, for example, two front-side cups 101-102, a right-shoulder strap 103, a left-shoulder strap 104, and a back-strap 105 comprising a fastener 110.

Figure 2B:
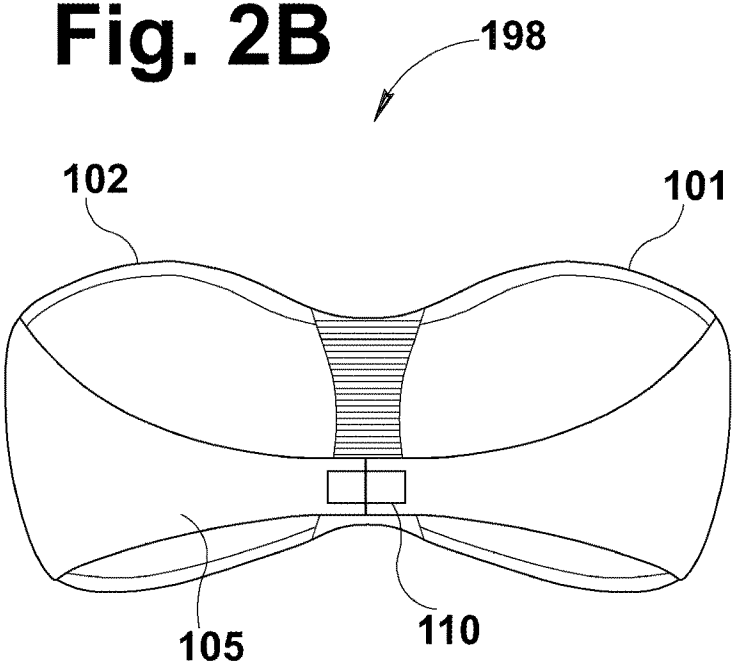
FIGS. 2A-2B are schematic illustrations of a strapless bra, in accordance with some demonstrative embodiments of the present invention.
Figure 2A:
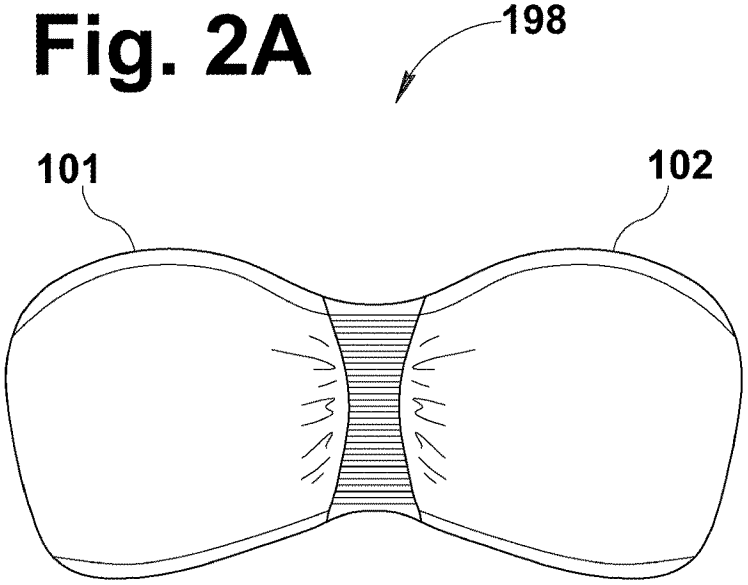

Reference is made to FIGS. 2A-2B, which are schematic illustrations (front-view and rear-view) of a strapless bra 198 in accordance with some demonstrative embodiments of the present invention. Bra 198 may comprise, for example, two front-side cups 101-102, and back-strap 105 comprising a fastener 110. Strapless bra 198 may lack, or may not comprise, any shoulder straps; or may exclude any shoulder straps.

The present invention may comprise other embodiments and/or other garments, for example, a bra having a single shoulder-strap, or a single diagonal shoulder-strap, or a "criss cross" bra or a bra having X-shape crossing of shoulder straps, or the like.

Figure 3:
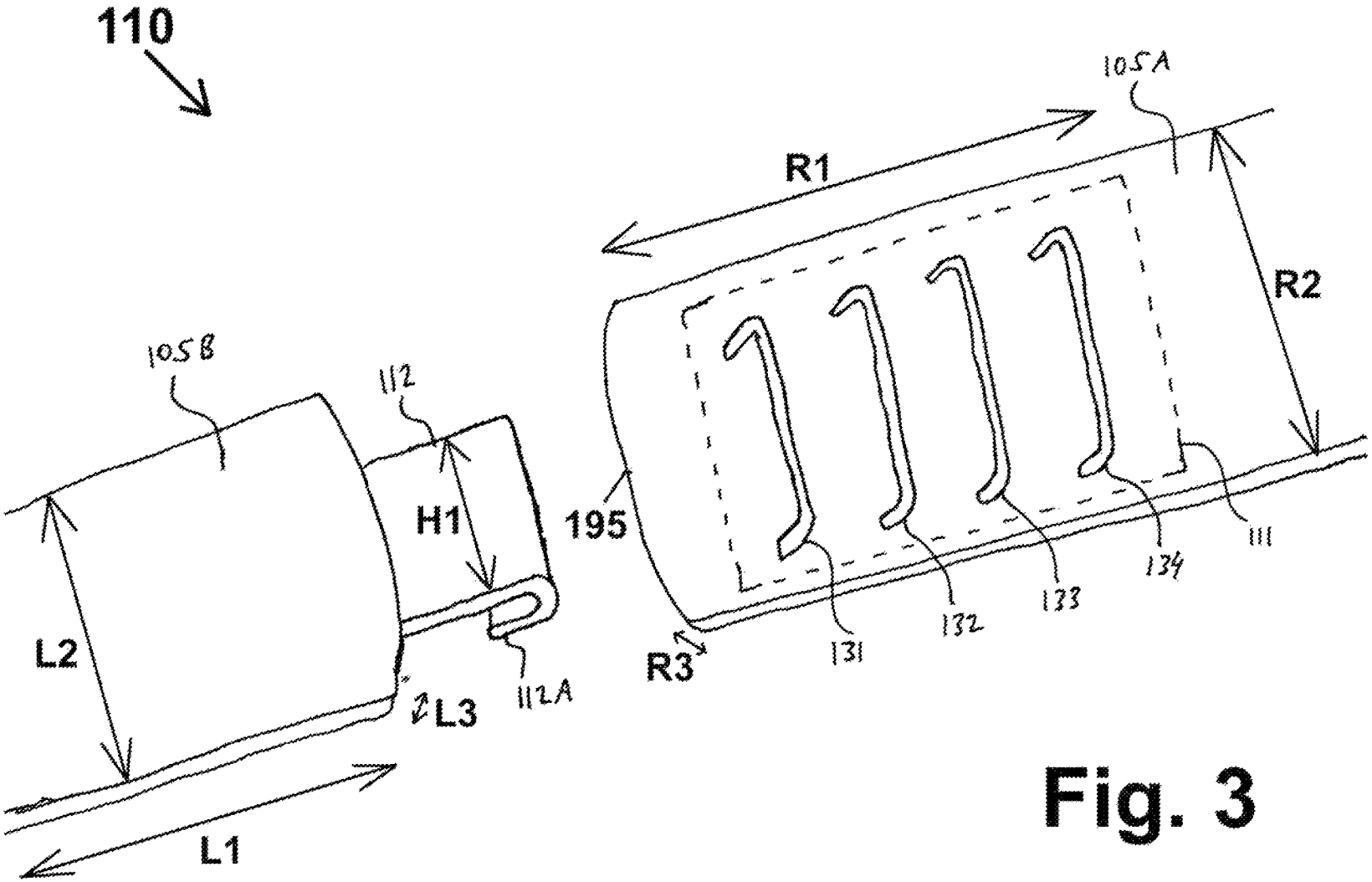
FIGS. 3-14 are schematic illustrations of various implementations of a fastener, in accordance with some demonstrative embodiments of the present invention.

Reference is made to FIG. 3, which is a schematic illustration of fastener 110 in accordance with some demonstrative embodiments of the present invention. Fastener 110 may comprise a first member 111 and a second member 112. The first member 111 may be located at, or located within, or embedded within, or may be an integral part of, a first region 105A of the back-strap of a bra. The second member 112 may be located at, or located within, or embedded within, or may be an integral part of, a second region 105B of the back-strap of a bra.

The first member 111 may comprise a set of multiple bridges 131-134, or similar "female side" members, which may be parallel or generally-parallel to each other, and may be spaced from each other. In a demonstrative example, each bridge may be "n" shaped, or may be shaped like an upside-down "U", or may have other suitable shape. In some embodiments, each bridge may have generally-rounded corners or a non-sharp contour, in order to allow smooth feeling of the bridges by a wearer. In other embodiments, each bridge may be generally polygonal or generally rectangular or generally trapezoid, and may have clearly-felt corners (although such corners may be smooth and non-sharp to the feeling fingers). Each bridge may be formed of plastic, injected plastic, injection molding of plastic material(s), metal, multiple metals, and/or other suitable material(s).

The second member 112 may comprise a single protrusion or hook or curved-panel or curved-element 112A, or other "male side" member or element, able to selectively engage with (and dis-engage from) any one of the bridges 131-134 of the first member 111. For example, the second member 112 may comprise a hook comprised of a generally flat tongue-shaped panel, which extends or protrudes outwardly towards the first member 111, and then curves backward with a U-shaped cross section to comprise a hook-shaped panel tip. The general elasticity of the back-strap may enable the wearer to pull the second member 112 sufficiently in order to selectively engage the second member 112 with one particular bridge out of the plurality of bridges 131-134 of the first member 111, selectively by the wearer. Similarly, a further pulling motion of the second member 112, optionally together with a slight or partial folding motion or breaking motion (e.g., directed outwardly, away from the wearer's body), may enable the wearer to dis-engage the second member 112 from the first member 111, thereby opening the fastener 110 and allowing the wearer to take-off the bra.

For demonstrative purposes, four bridges 131-134 are shown and described; however, fastener 110 may be implemented to comprise other number of such bridges, for example, a single bridge, two bridges, three bridges, five bridges, six bridges, seven bridges, eight bridges, nine bridges, ten bridges, or other suitable number of such bridges.

In some embodiments, all the bridges 131-134 may be substantially identical to each other. In other embodiments, at least one of the bridges 131-134 may be different or slightly-different from other bridges; for example, may have a shorter length or a longer length or a different length relative to other (or immediately-neighboring) bridges; for example, in order to indicate to the wearer of the bra, who typically engages the fastener "blindly" without being able to see behind her back, that she is touching or reaching a particular differently-shaped bridge out of the set of bridges.

Region 105A has three dimensions: (A) dimension R1 being the longest dimension of region 105A (e.g., being the left-to-right axis or direction or dimension; or being the horizontal dimension; or being the east-to-west direction or axis or dimension); (B) dimension R2 being the intermediate-length dimension (or the second-longest dimension) of region 105A (e.g., being the up-to-down axis or direction or dimension; or being the vertical dimension or direction or axis; or being the north-to-south dimension or direction or axis); (C) dimension R3 being the shortest dimension of region 105A (e.g., being the thickness or the depth dimension of region 105A; being the dimension that is generally perpendicular to the back of the female wearer). Dimension R1 is perpendicular to dimension R2. Dimension R1 is perpendicular to dimension R3. Dimensions R2 is perpendicular to dimension R3. Dimension R1 may be referred to as "length" or "east-to-west" dimension of region 105A. Dimension R2 may be referred to as "width" or as "height" or as "north-to-south" direction of region 105A. Dimension R3 may be referred to as "thickness" or "depth" dimension of region 105A.

Region 105B may similarly have three dimensions, denoted respectively as L1 and L2 and L3, as demonstrated in FIG. 3.

In accordance with some demonstrative embodiments of the present invention, the length of the longest dimension of each one of bridges 131-134, may be 95 or 90 or 85 or 80 or 75 or 60 or 55 or 50 percent of the width of region 105A (namely, of the second-longest dimension (R2) of region 105A).

In accordance with some demonstrative embodiments of the present invention, the length of the longest dimension of each one of bridges 131-134, may be in the range of 50 to 95 percent, or 51 to 90 percent, or 55 to 90 percent, or 60 to 90 percent, or 66 to 90 percent, or 75 to 90 percent, or 60 to 80 percent, of the width of region 105A (namely, of the second-longest dimension (R2) of region 105A).

In accordance with some demonstrative embodiments of the present invention, the length of the longest dimension of each one of bridges 131-134, may be at least 50 percent, or at least 51 percent, or at least 55 percent, or at least 60 percent, or at least 66 percent, or at least 70 percent, or at least 75 percent, or at least 80 percent, or at least 90 percent, or at least 95 percent, of the width of region 105A (namely, of the second-longest dimension (R2) of region 105A).

In accordance with some demonstrative embodiments of the present invention, there exists (I) a single bridge, in (II) each line of region 105A that is parallel or generally-parallel to the second-longest dimension R2 of region 105A. For example, no line of region 105A, that is parallel or generally-parallel to the second-longest dimension, includes two (or more) bridges, one above the other. The bridges 131-134 are only parallel or generally-parallel to each other; and there are no two bridges that are at the same distance (e.g., right-to-left distance, or horizontal distance, or east-to-west distance) from point 195 which is located at the center of the tip or edge of region 105A. Each one of bridges 131-134, is located at a different distance, from point 195. Each one of bridges 131-134, is located at a different distance from the line denoted as R2 in FIG. 3. No two bridges out of bridges 131-134, are located the same distance from point 195. No two bridges out of bridges 131-134, are located at the same distance from the line denoted R2 in FIG. 3. The longest dimension of each bridge (out of bridges 131-134), is parallel or generally-parallel to the longest dimension of each other bridge (out of bridges 131-134). The longest dimension of each bridge (out of bridges 131-134), is not a continuation of the longest dimension of any other bridge (out of bridges 131-134).

In accordance with the present invention, only a single hook-member or male-member is comprised in the second-member 112. In contrast with conventional bras, in which two or more minuscule hook-members are located one on top of the other (e.g., spaced-apart along the L2 dimension), the present invention provides a bra and a fastener having a single, significantly enlarged, significantly wider, hook member in the second member 112.

In some embodiments of the present invention, the longest dimension of the second member 112, is approximately 95 or 90 or 85 or 80 or 75 or 70 or 60 or 55 or 51 or 50 percent, of the longest dimension of bridge 131 (or, of the longest dimension of each one of bridges 131-134).

In some embodiments of the present invention, the longest dimension of the second member 112, denoted H2, is at least 95 or 90 or 85 or 80 or 75 or 70 or 60 or 55 or 51 or 50 percent, of the longest dimension of bridge 131 (or, of the longest dimension of each one of bridges 131-134).

In some embodiments of the present invention, the longest dimension of the second member 112, denoted H2, is in the range of 50 to 90 percent, or 55 to 90 percent, or 60 to 90 percent, or 66 to 90 percent, or 60 to 80 percent, or 66 to 75 percent, or 75 to 90 percent, of the longest dimension of bridge 131 (or, of the longest dimension of each one of bridges 131-134).

In some embodiments of the present invention, the longest dimension of the second member 112, denoted H2, is at least 95 or 90 or 85 or 80 or 75 or 70 or 60 or 55 or 51 or 50 percent, of the second-longest dimension (L2) of region 105B.

In some embodiments of the present invention, the longest dimension of the second member 112, denoted H2, is in the range of 50 to 90 percent, or 55 to 90 percent, or 60 to 90 percent, or 66 to 90 percent, or 60 to 80 percent, or 66 to 75 percent, or 75 to 90 percent, of the second-longest dimension (L2) of region 105B.

It is noted that the above-mentioned ratios or dimensions or proportions, and/or the number and/or location of the bridges, and/or the singularity of the single hook-member that comprises the second member 112 (e.g., as opposed to multiple hook members in conventional bras), and/or the singularity of a single bridge located at a particular distance from the tip or edge (e.g., point 195) of region 105A (e.g., such that there are no two bridges located at the same distance form point 195), are not merely "design preferences"; but rather, they reflect and they serve particular functional benefits and advantages that the Applicants have realized and have innovated.

Figure 4:
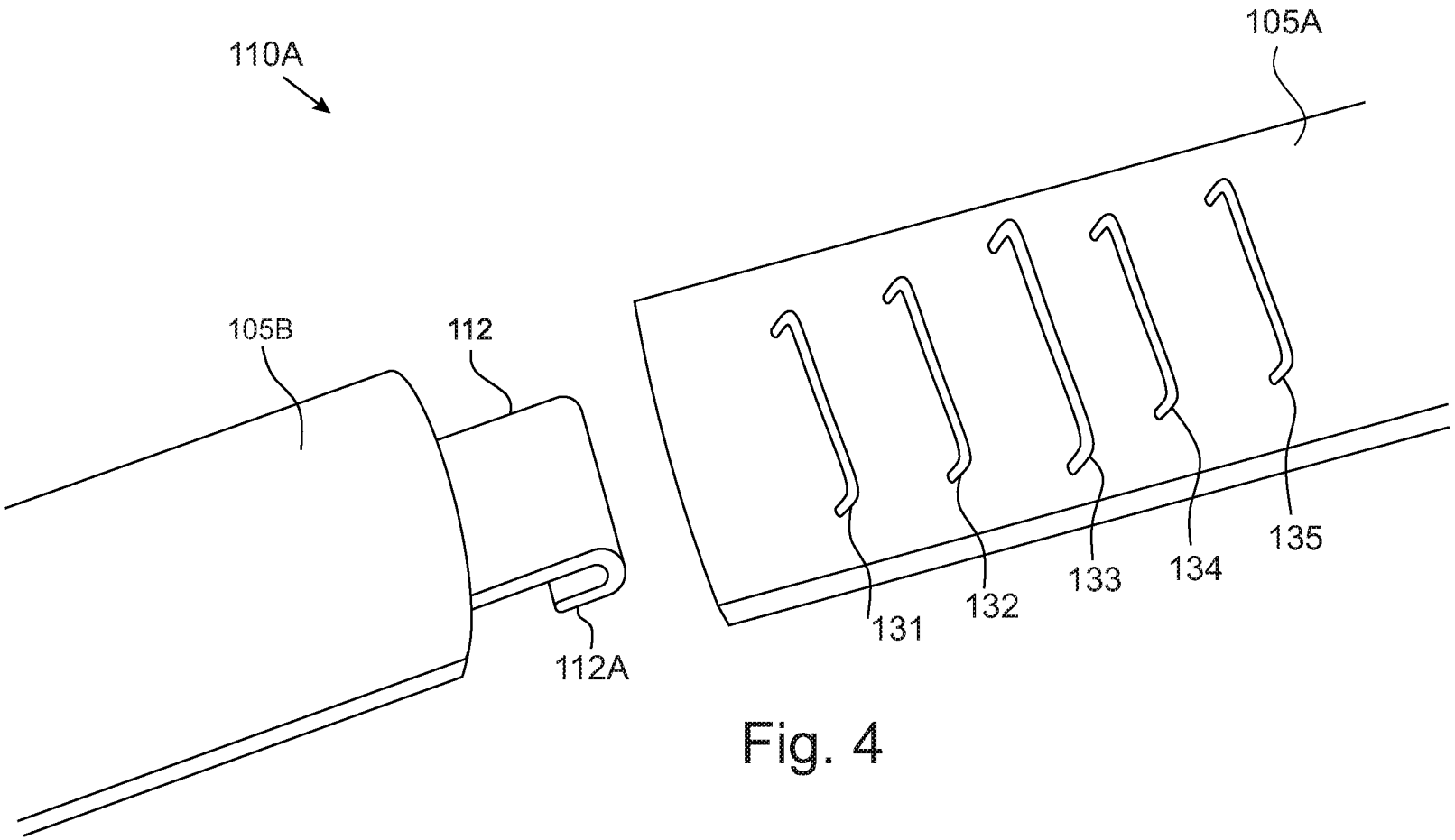

In accordance with some demonstrative embodiments of the present invention, FIG. 4 shows a fastener 110A having five bridges 131-135, in which a central bridge 133 is longer relative to the other bridges 131, 132, 134 and 135; thereby indicating to the user, who may touch the fastener 110A with her fingers, that the longer bridge 133 is the central bridge, and facilitating the user's selection of which bridge to engage with.

Figure 5:
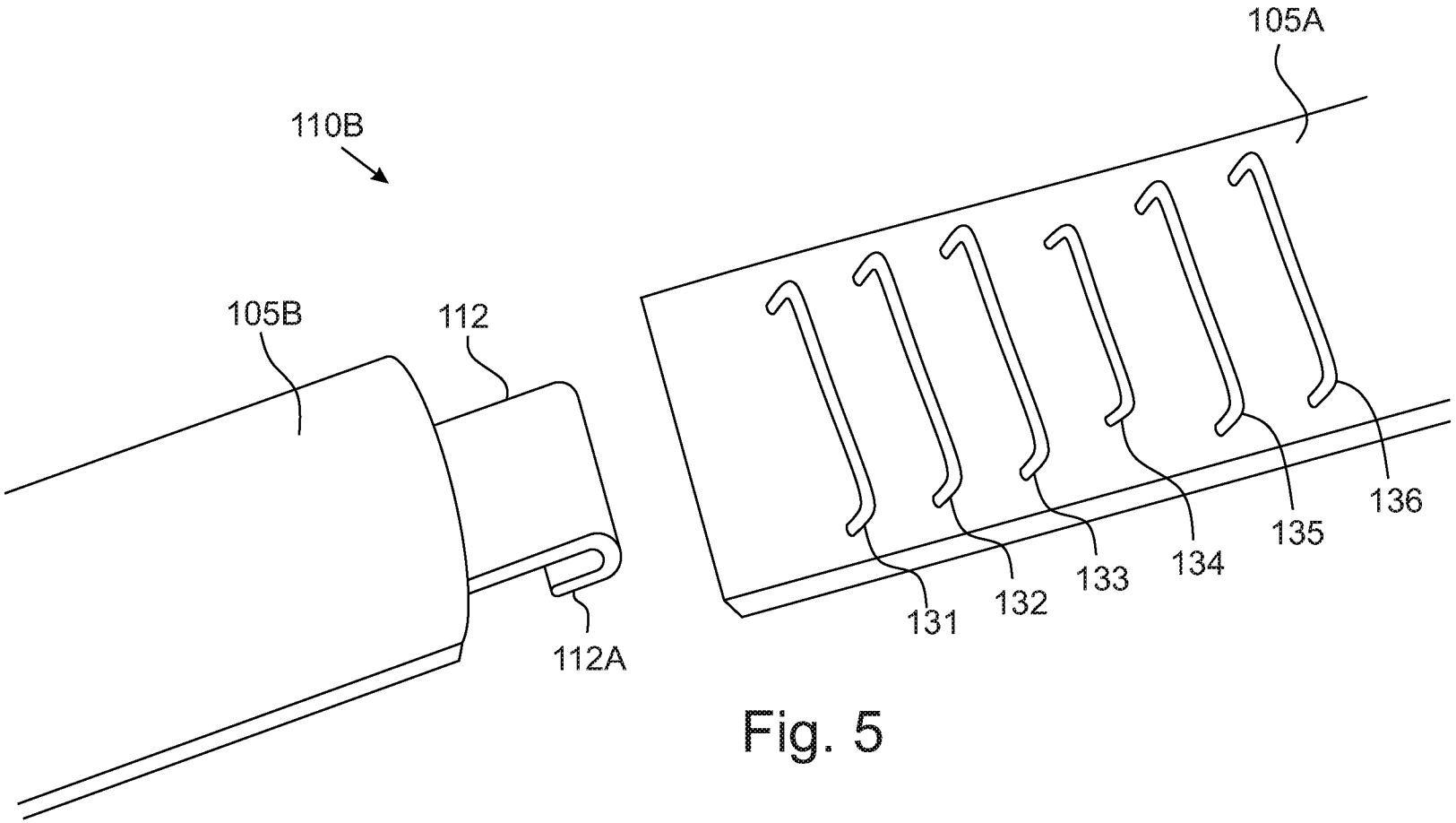

In accordance with some demonstrative embodiments of the present invention, FIG. 5 shows a fastener 110B having six bridges 131-136, in which a non-central bridge 134 is shorter relative to the other bridges 131, 132, 133, 135 and 136; thereby indicating to the user, who may touch the fastener 110B with her fingers, that the shorter bridge 134 is a bridge located approximately two-third along the set of bridges 131-136, and facilitating the user's selection of which bridge to engage with.

In some embodiments, the non-uniform set of bridges 131-134 may comprise a single different bridge that may differ from the other bridges; for example, by its color, length, shape, curvature, thickness, the material from which it is made, the gap or spacing between the different bridge and its immediately-neighboring bridges, or a combination of two or more such differences relative to other bridges in the set of bridges.

Figure 6:
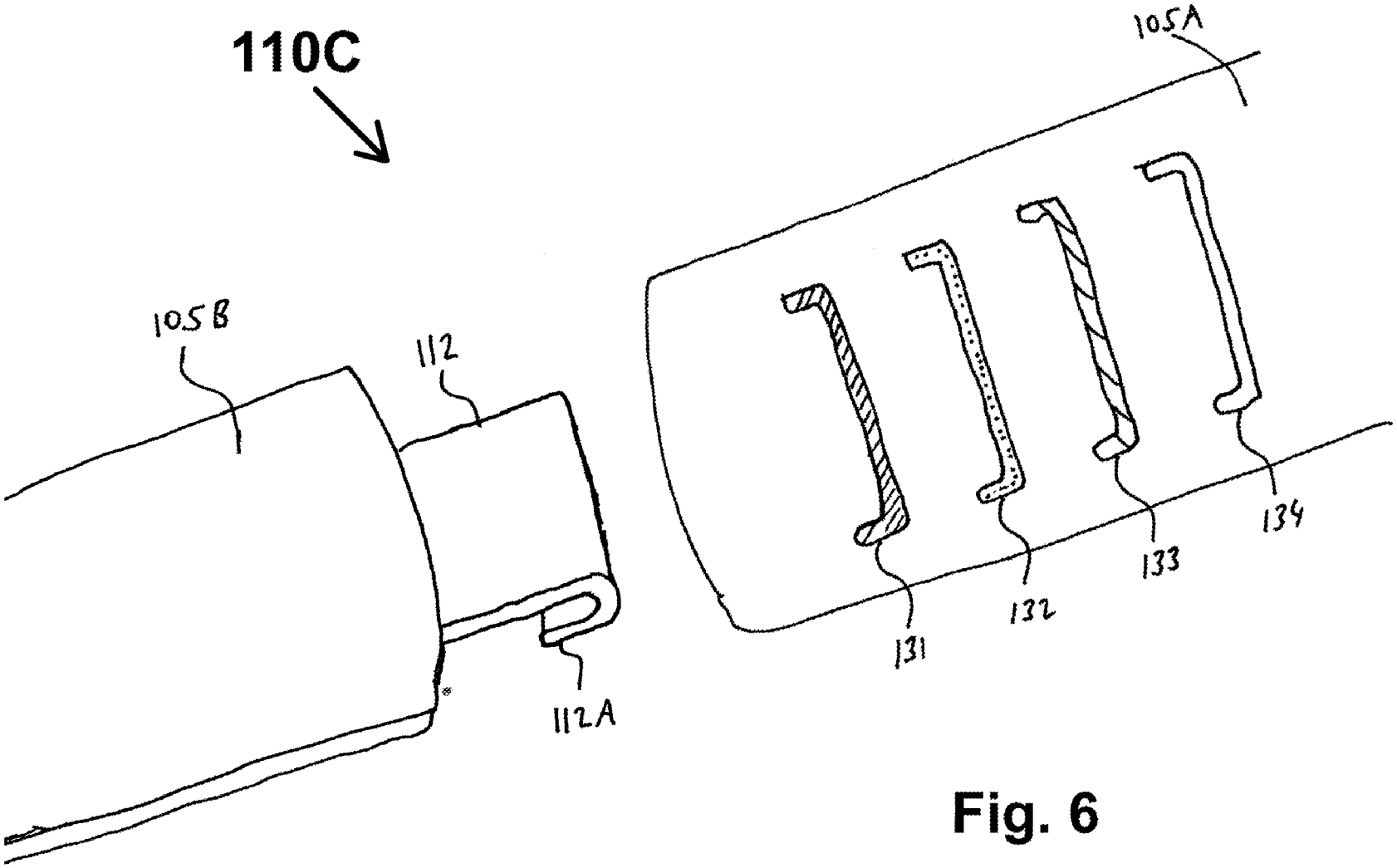

In accordance with some demonstrative embodiments of the present invention, FIG. 6 shows a fastener 110C having four bridges 131-134, in which each bridge is colored (or is coated with a color coating) with a different color, or with a different shade or intensity of a particular color. For example, in one embodiment, bridge 131 may be black, bridge 132 may be blue, bridge 133 may be green, and bridge 134 may be yellow. For example, in another embodiment in which the bra is generally pink, bridge 131 may be light-pink, bridge 132 may be dark pink, bridge 133 may be light-red, and bridge 134 may be dark-red. Such color-coding of the bridges may allow a wearer to wear the bra, and to observe via a mirror (or to ask another person) which one of the differently-colored bridges is currently engaging with the second member of the fastener; in order to ascertain that the correct bridge was selected. For example, a user may practice or try-on the bra with the fastener being engaged through various bridges, one at a time; the user may look via a mirror to see which bridge is engaged; the user may decide that the Green bridge 133 (or the light-red bridge 133) is the most comfortable bridge for her wearing of the bra; and in subsequent wearing of the bra (e.g., the next day or the next week), the wearer may ensure (e.g., by looking via a mirror, or by asking another person) that this particular bridge 133 is currently engaged.

Such color-coding scheme of the bridges of the fastener, may provide a reassurance mechanism to the wearer; and may eliminate a situation in which the wearer puts-on a bra by engaging a particular bridge of the fastener, and later (e.g., one minute later, or one hour later) finds out that the wrong bridge or an un-comfortable bridge was engaged instead of her preferred bridge or her typically-engaged bridge; thereby eliminating a situation in which the wearer needs to take-off one or more articles of clothing (e.g., a jacket, a sweat-shirt, a shirt) in order to adjust the bra or in order to change the bridge selected for engagement.

Figure 7:
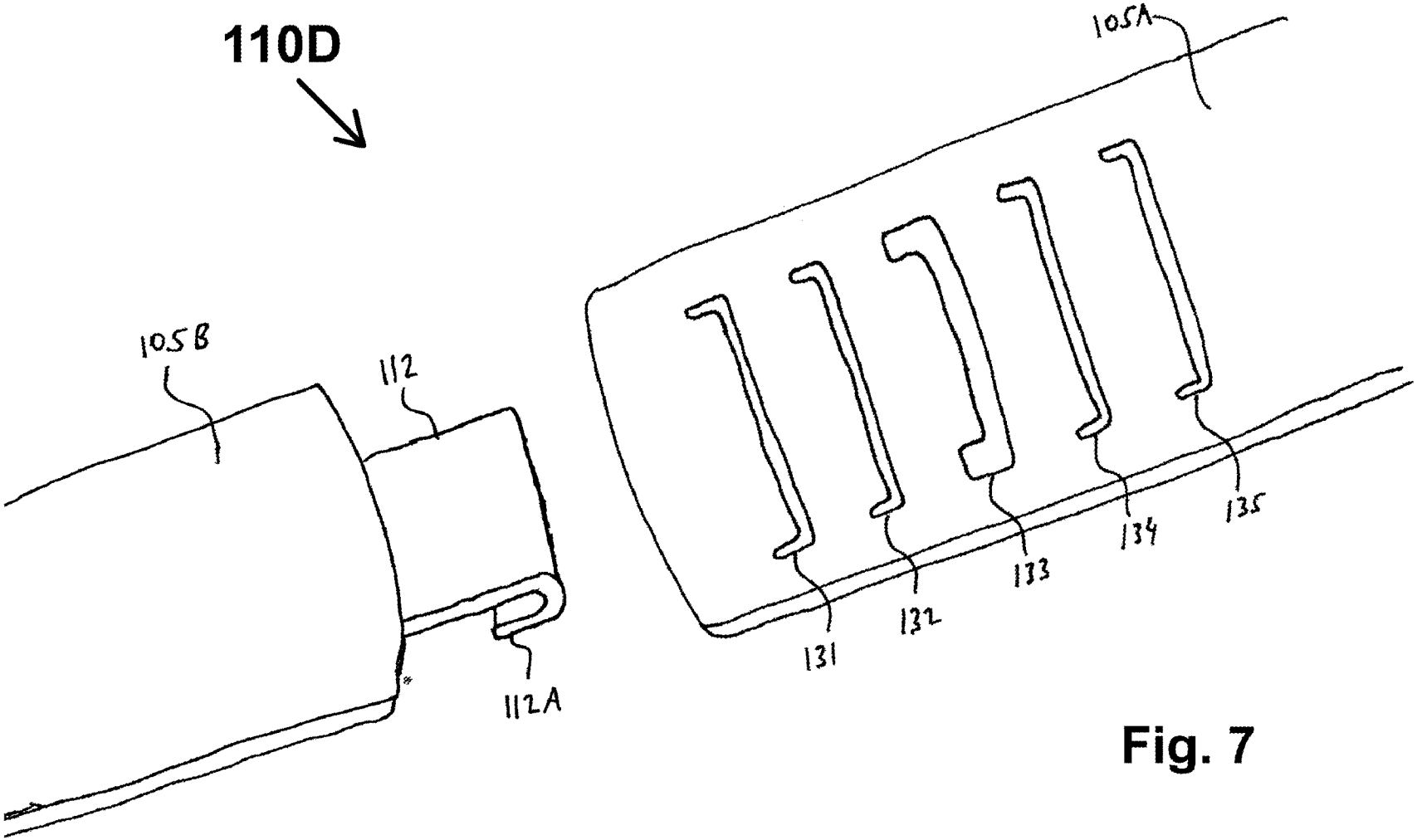

In accordance with some demonstrative embodiments of the present invention, FIG. 7 shows a fastener 110D having five bridges 131-135, in which one bridge 133 has increased thickness relative to the other bridges; thereby indicating or signaling to the wearer that she is currently touching (or engaging) this particular, thicker, bridge.

Figure 8:
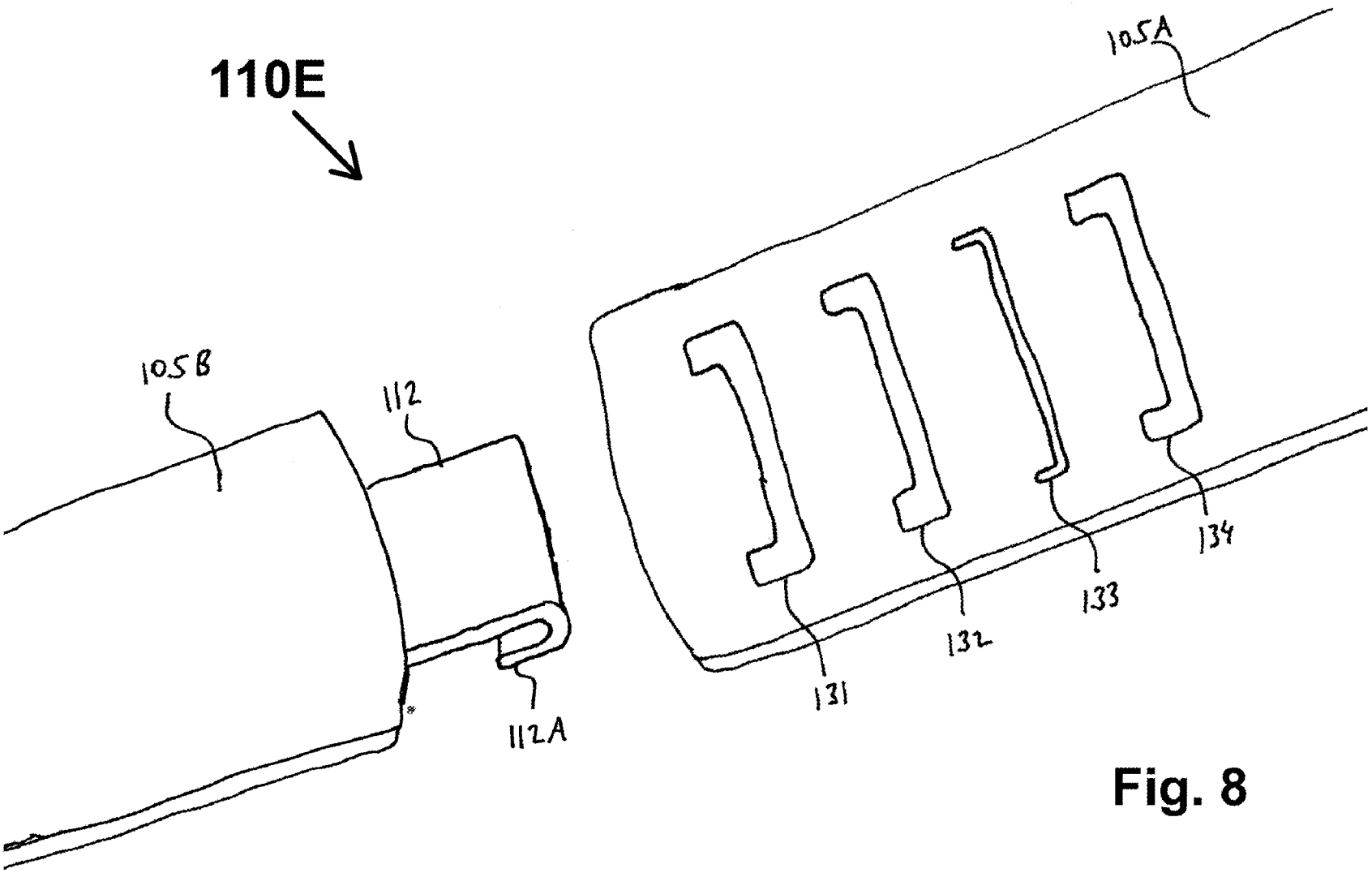

In accordance with some demonstrative embodiments of the present invention, FIG. 8 shows a fastener 110E having four bridges 131-134, in which one bridge 133 has reduced thickness relative to the other bridges; thereby indicating or signaling to the wearer that she is currently touching (or engaging) this particular, thinner, bridge.

Figure 9:
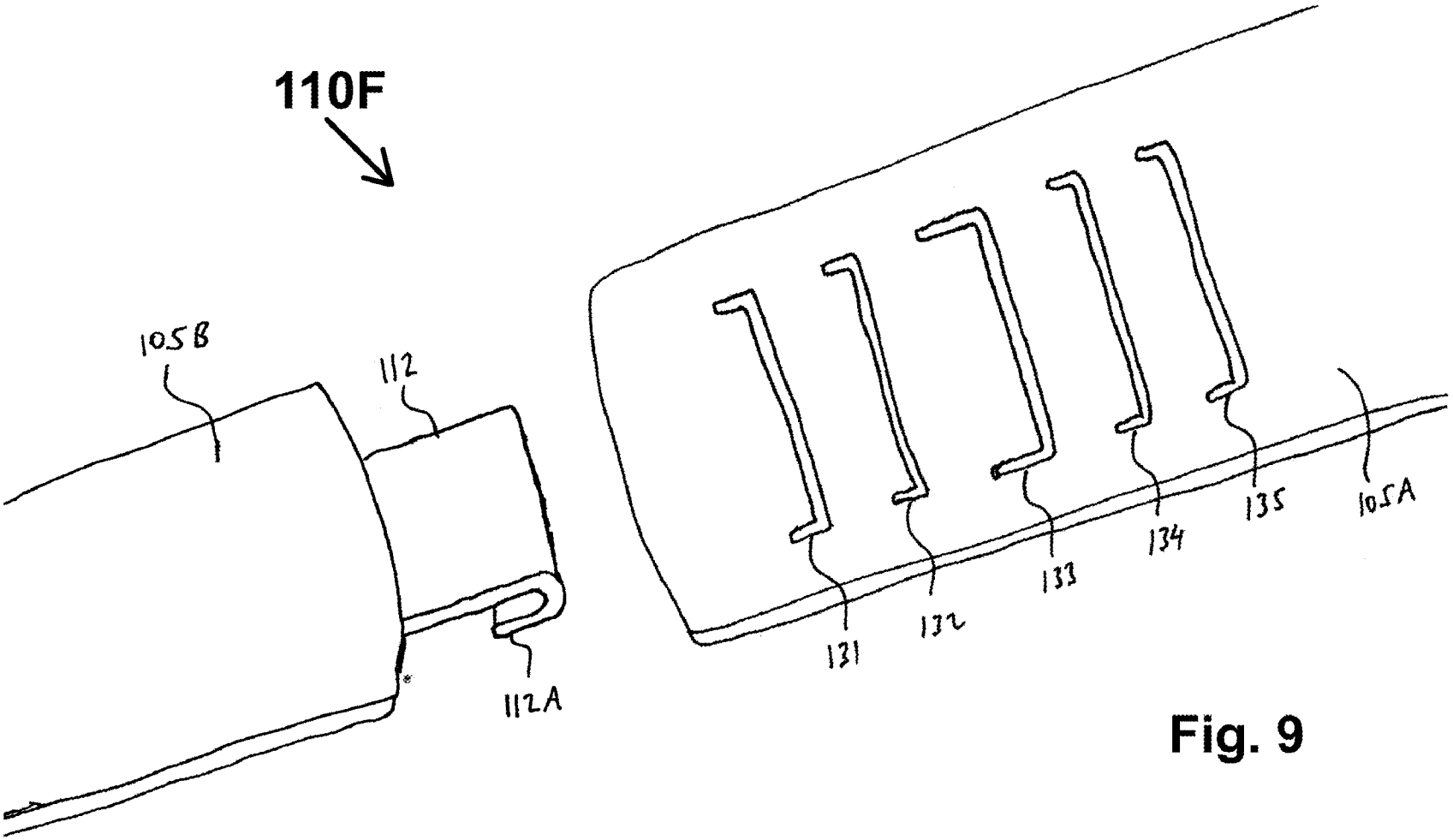

In accordance with some demonstrative embodiments of the present invention, FIG. 9 shows a fastener 110F having five bridges 131-135, in which one bridge 133 has increased height (from the plane of the back-strap) relative to the other bridges; thereby indicating or signaling to the wearer that she is currently touching (or engaging) this particular, higher, bridge.

Figure 10:
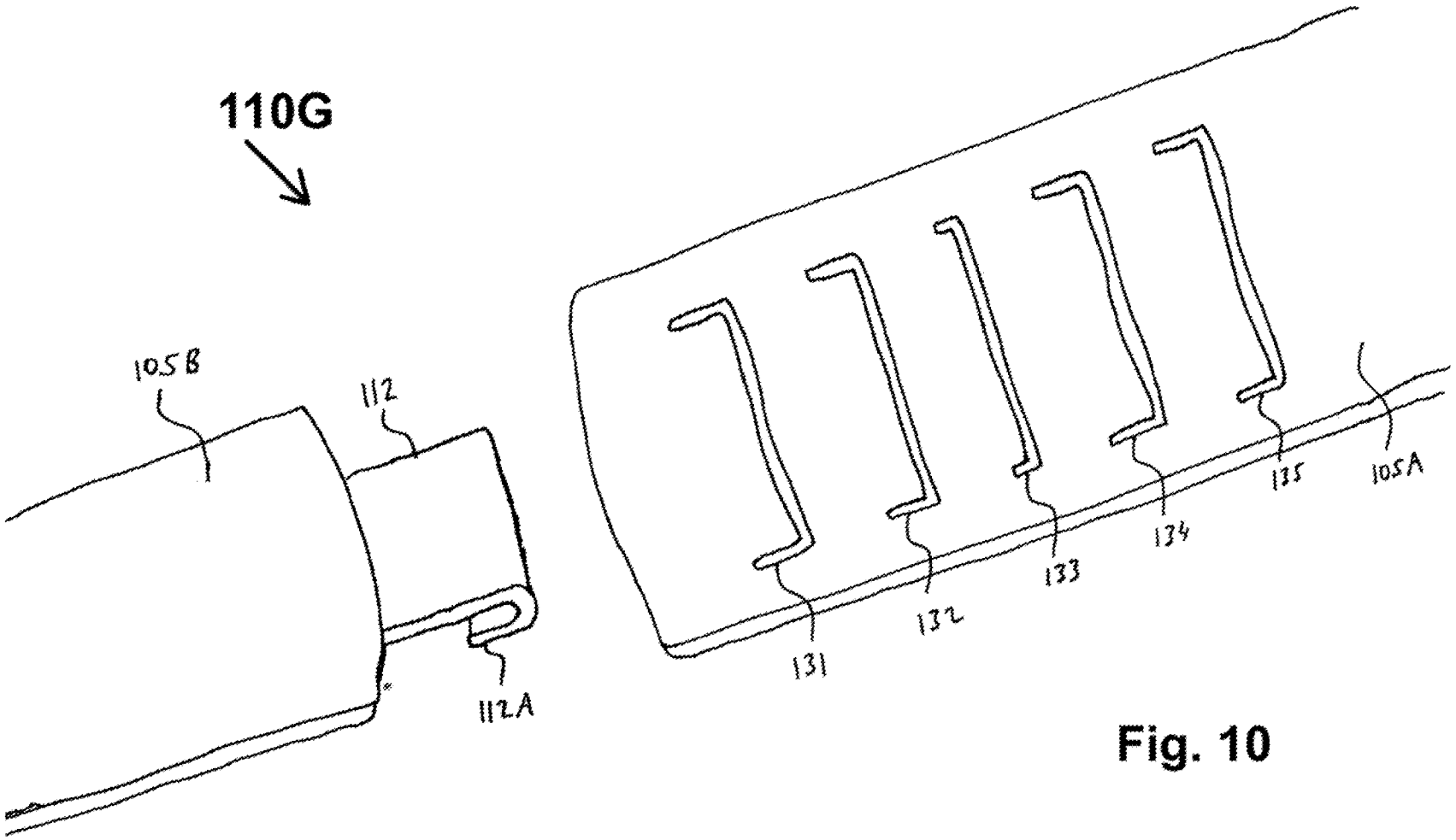

In accordance with some demonstrative embodiments of the present invention, FIG. 10 shows a fastener 110G having five bridges 131-135, in which one bridge 133 has reduced height (from the plane of the back-strap) relative to the other bridges; thereby indicating or signaling to the wearer that she is currently touching (or engaging) this particular, lower, bridge.

Figure 11:
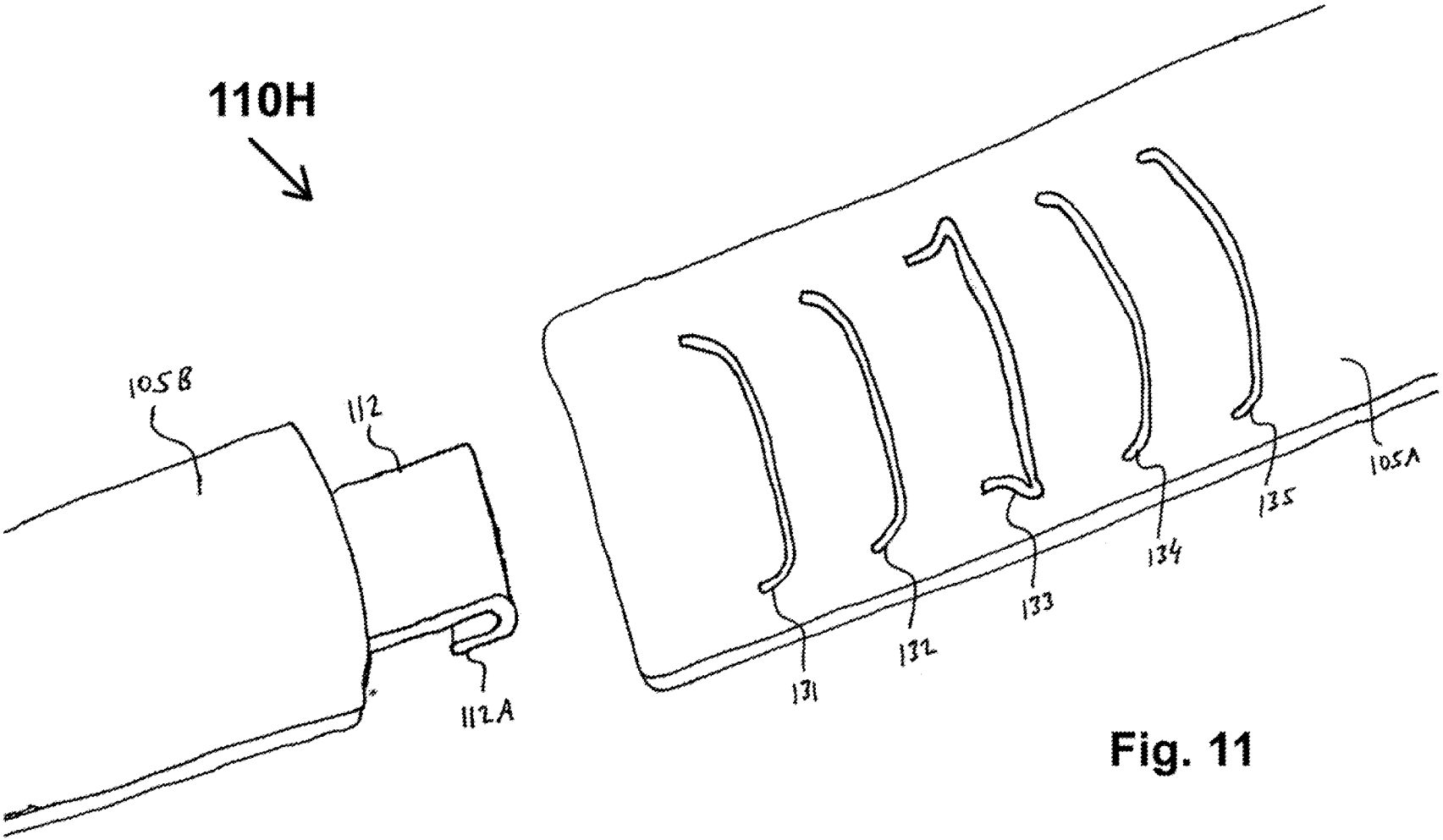

In accordance with some demonstrative embodiments of the present invention, FIG. 11 shows a fastener 110H having five bridges 131-135, in which one bridge 133 has a different shape relative to the other bridges; for example, having a generally trapezoid shape that protrudes outwardly in its upper corners, instead of having a generally curved shape that has curved corners and/or protrudes inwardly at its corner; thereby indicating or signaling to the wearer that she is currently touching (or engaging) this particular, differently-shaped, bridge.

Figure 12:
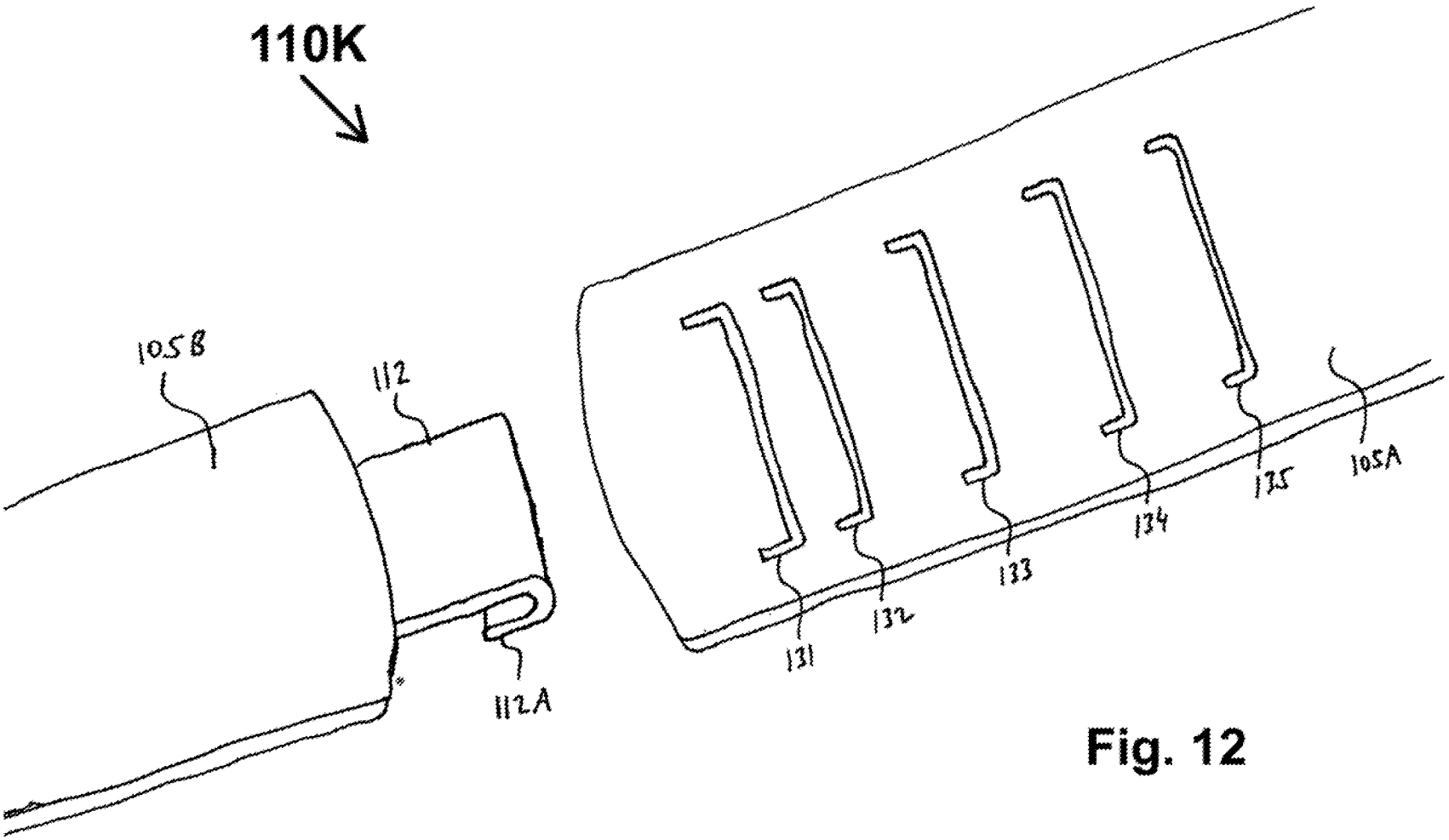

In accordance with some demonstrative embodiments of the present invention, FIG. 12 shows a fastener 110K having five bridges 131-135, in which at least one pair of immediately-neighboring bridges has a gap or space between them, that is different from (greater than, or smaller than) the gap or space between other pair (or pairs) of immediately-neighboring bridges. For example, the spacing or gap between bridges 131-132 may be smaller than the spacing or gap between other pairs of bridges (for example, relative to the pair of bridges 132-133, and relative to the pair of bridges 133-134, or the like); thereby indicating or signaling to the wearer that she is currently touching (or engaging) this particular bridge or bridge-pair having the distinctive, different, gap or spacing therein.

Figure 13:
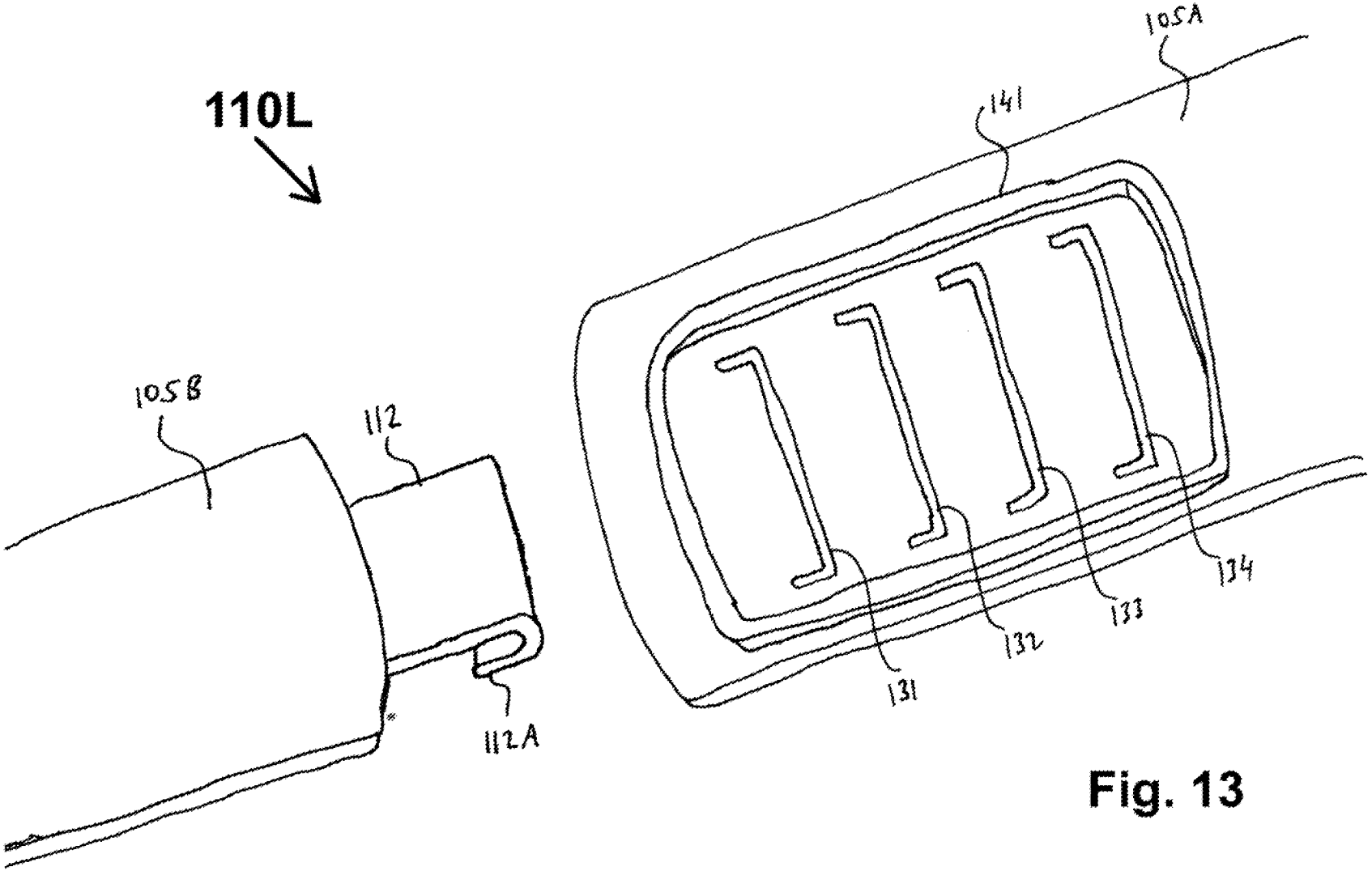

In some embodiments of the present invention, the fastener 110 may comprise a surrounding frame 141 (e.g., plastic frame or metal frame), as demonstrated in fastener 110L of FIG. 13. In other embodiments, the fastener 110 and the back-strap 105 may lack such surrounding frame, thereby reducing the weight of the fastener 110 and of the entire bra, and thereby implementing the bra as a light-weight article of clothing; and also, thereby eliminating a situation in which the entire bra becomes non-usable once the surrounding frame 141 breaks (e.g., due to the bra falling, or being washed and dried numerous times).

Figure 14:
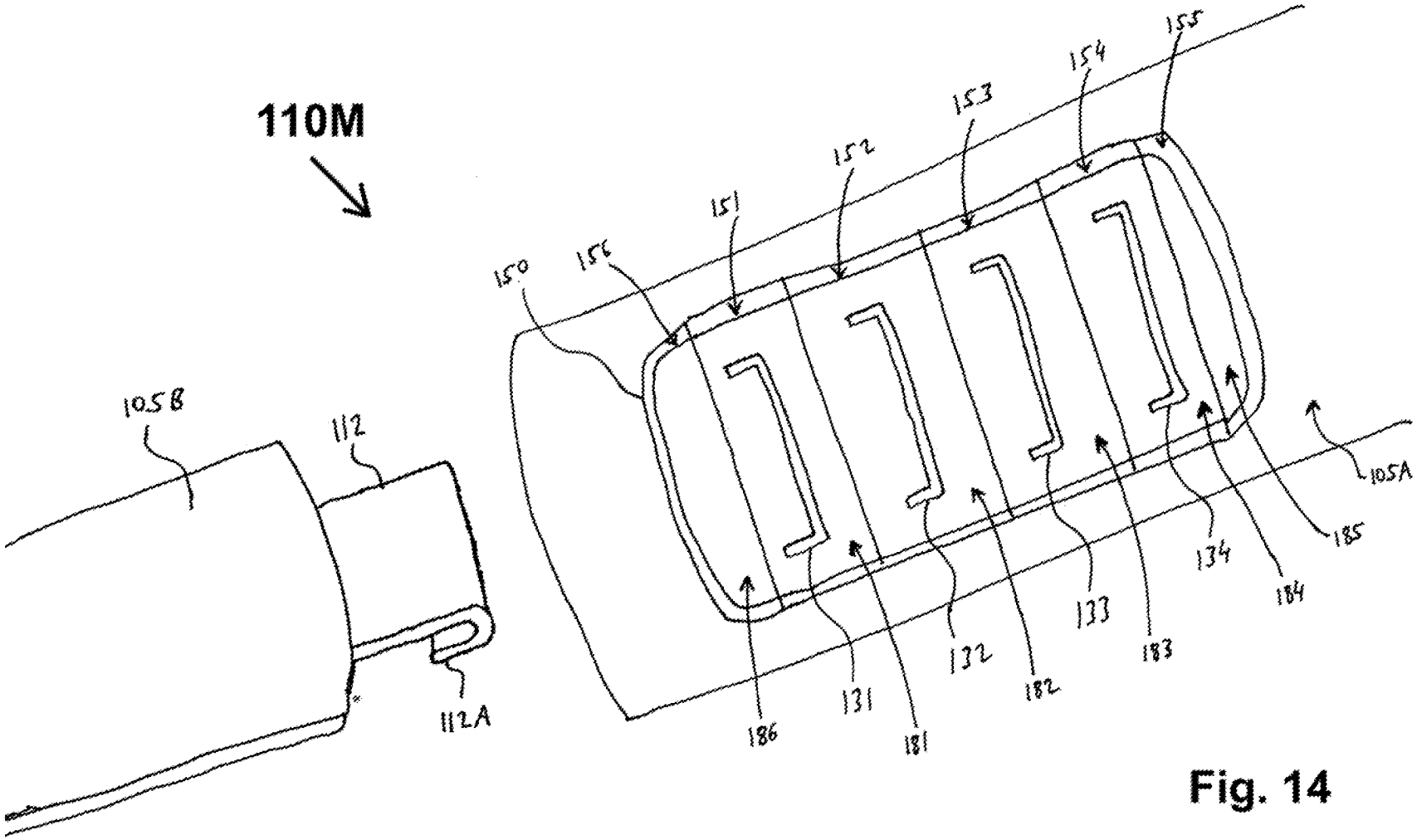

In other embodiments of the present invention, as demonstrated in FIG. 14, a fastener 110M may comprise an optional modular frame 150 (e.g., formed of plastic or metal or other suitable materials), which may be implemented as a set or chain of inter-connected links or rigid frame-members 151-154. In some embodiments, each one of the (or semi-rigid) rigid frame-members 151-154 may comprise exactly one bridge therein. In other embodiments, each one of the rigid frame-members 151-154 may comprise either one bridge therein, or no bridges therein. In other embodiments, each one of the rigid frame-members 151-154 may comprise up to one bridge therein. In other embodiments, each one of the rigid frame-members 151-154 may comprise up to two bridges therein, or no bridges therein. Optionally, two or more additional frame-members 155-156 may be used, to provide an enclosure or oval-shaped structure or rectangular structure to the entirety of module frame 150; and each one of such additional frame-members 155-156 may comprise no bridges at all, or a single bridge.

In some embodiments, the multiple frame-members 151-154, or the multiple frame-members 151-156, may be interconnected in a manner that creates multiple regions (e.g., regions 181-186) and that allows each frame-member or region to be rigid or semi-rigid by itself but also to move, or to fold, relative to other frame-member(s) or relative to one or more immediately-neighboring frame-members. This may allow the modular frame 150 to be more resistant to pressure, and to eliminate or reduce breakage of the modular frame 150; and may allow the bra to comprise a semi-rigid modular fastener or fastener-frame, or a semi-elastic modular fastener or fastener-frame or a rigid-flex (or rigid-flexible) modular fastener or fastener-frame. Additionally or alternatively, this may increase the efficiency or the level-of-comfort of using the modular fastener 150 (and the bra that includes it), by the wearer; since the back of the wearer may not be, or may not be at all times, a planar surface; and rather, the back of the wearer may curve (e.g., when the wearer moves or walks or runs, or bends-down or reaches-up or sits), thereby allowing the modular frame 150 (or the entire modular fastener, or its female member) to adjust its positioning, allowing a greater degree-of-freedom to its frame-members 151-154 or 151-156 or frame regions 181-186, and allowing such frame-members or regions to arc themselves or to become curved or concave or convex, and to accommodate or match the current curvature of the back or the body of the wearer.

Referring still to FIG. 14, it is noted that the modular frame 150 may be optional, and may not be comprised in some embodiments. For example, in some embodiments, the female member (e.g., member 111) of the fastener 110M may be implemented without any frame; but in a manner that still constructs the member 111 as a plurality of rigid or semi-rigid or flexible interconnected regions 151-156, which may be regarded as member-regions rather than frame-members. For example, each one of regions 151-156 may lack any frame or any portion-of-frame surrounding it; yet still, each one of regions 151-156 may be foldable or movable relative to its neighboring or immediately-neighboring regions. This may allow the user or wearer to slightly curve or slightly fold the entirety of the member 111, by moving or arcing or curving one or more of the interconnected regions 151-156 or inter-connected links or linked-regions or other flexibly-linked bridges, which may thus provide a semi-rigid or a rigid-flex structure, facilitating the closure or the opening of the modular fastener.

In some embodiments, optionally, the frame-members of the modular frame 150 may be attached to each other, or may be attached to the back-strap of the bra, by gluing, bonding, knitting, heat-press process, ultrasonic process, or other suitable attachment mechanisms. In some embodiments, bridges and/or frame-members (or other members or parts of the fastener) may be attached to the back-strap of the bra, by gluing, bonding, knitting, heat-press process, ultrasonic process, or other suitable attachment mechanisms.

In some embodiments, a "sandwich" structure may be formed, for example, in which the frame or modular-frame is formed by two parts (e.g., a male part and a female part, or other two complementing parts or matching parts), each side attached to one side of the back-strap, such that the back-strap is "sandwiched" between the two parts of the fastener (or the fastener-frame); and optionally, a gluing process or bonding process or knitting process or ultrasonic process or ultrasonic soldering or heat-press process may be used to form such "sandwich" structure in which the back-strap is trapped between two parts of the fastener or the fastener-frame; on in which the bridges cross through the back-strap.

In some embodiments, each bridge may be attached or glued or bonded to the back-strap of the bra, for example, by bonding, gluing, knitting, sewing, ultrasonic process, ultrasonic soldering, heat-press process, or other suitable process. In some embodiments, each bridge may traverse or may puncture through the back-strap of the bra, such that each bridge may be connected to an inner-side base component that may hold in place (or may support) the shorter edges of each such bridge.

Figure 15:
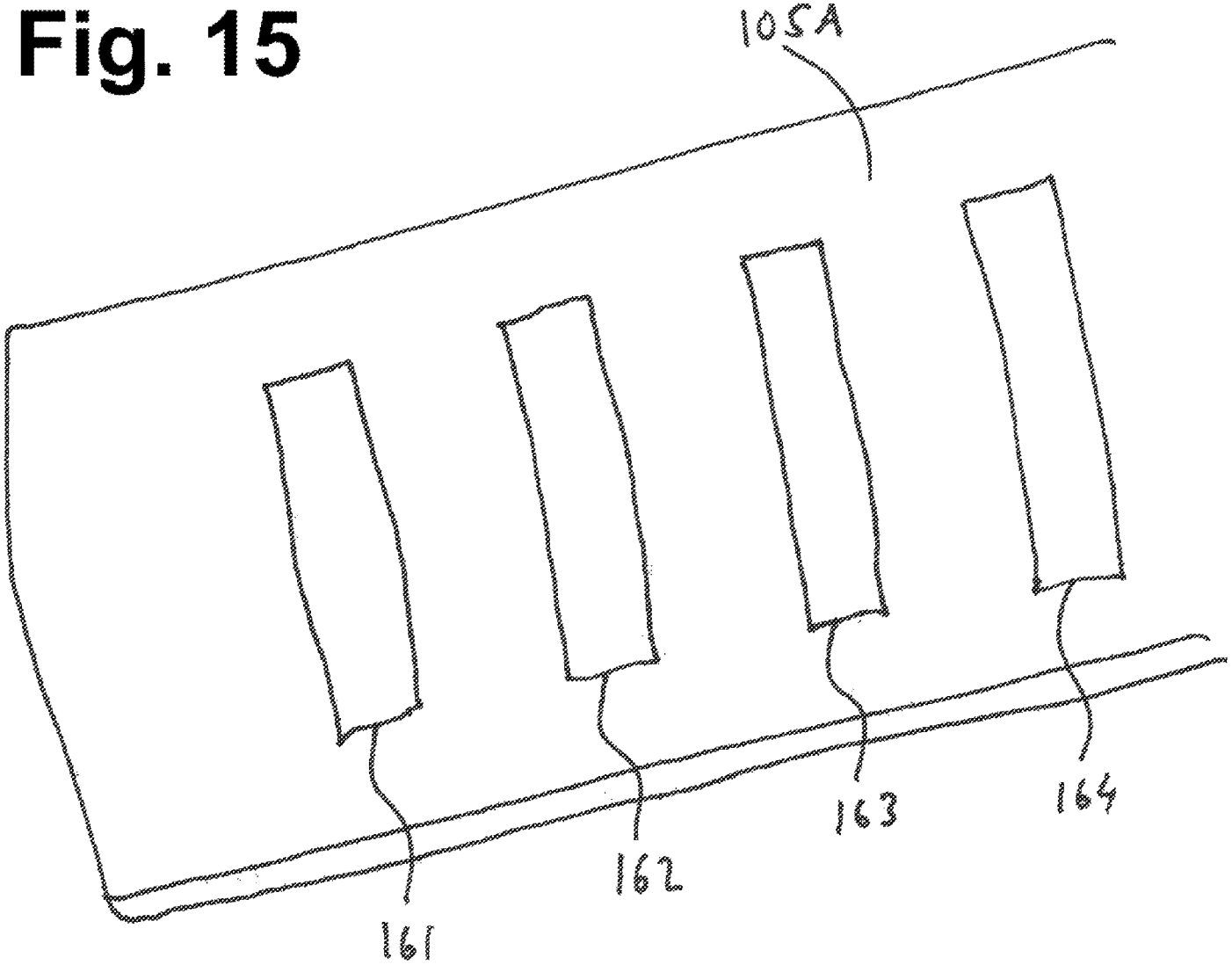
FIG. 15 is a schematic illustration of an internal-side of a region of a back-strap of a bra, in accordance with some demonstrative embodiments of the present invention.

Reference is made to FIG. 15, which demonstrates an internal-side or inner-side of the region 105A of back-strap 105, namely, the side of the back-strap 105 that touches the back (or the body) of the wearer; showing several base-members 161-164 that correspond to four bridges 131-134. The base-members 161-164 may be generally rectangular, or may have other suitable supporting shape or structure.

Figure 16:
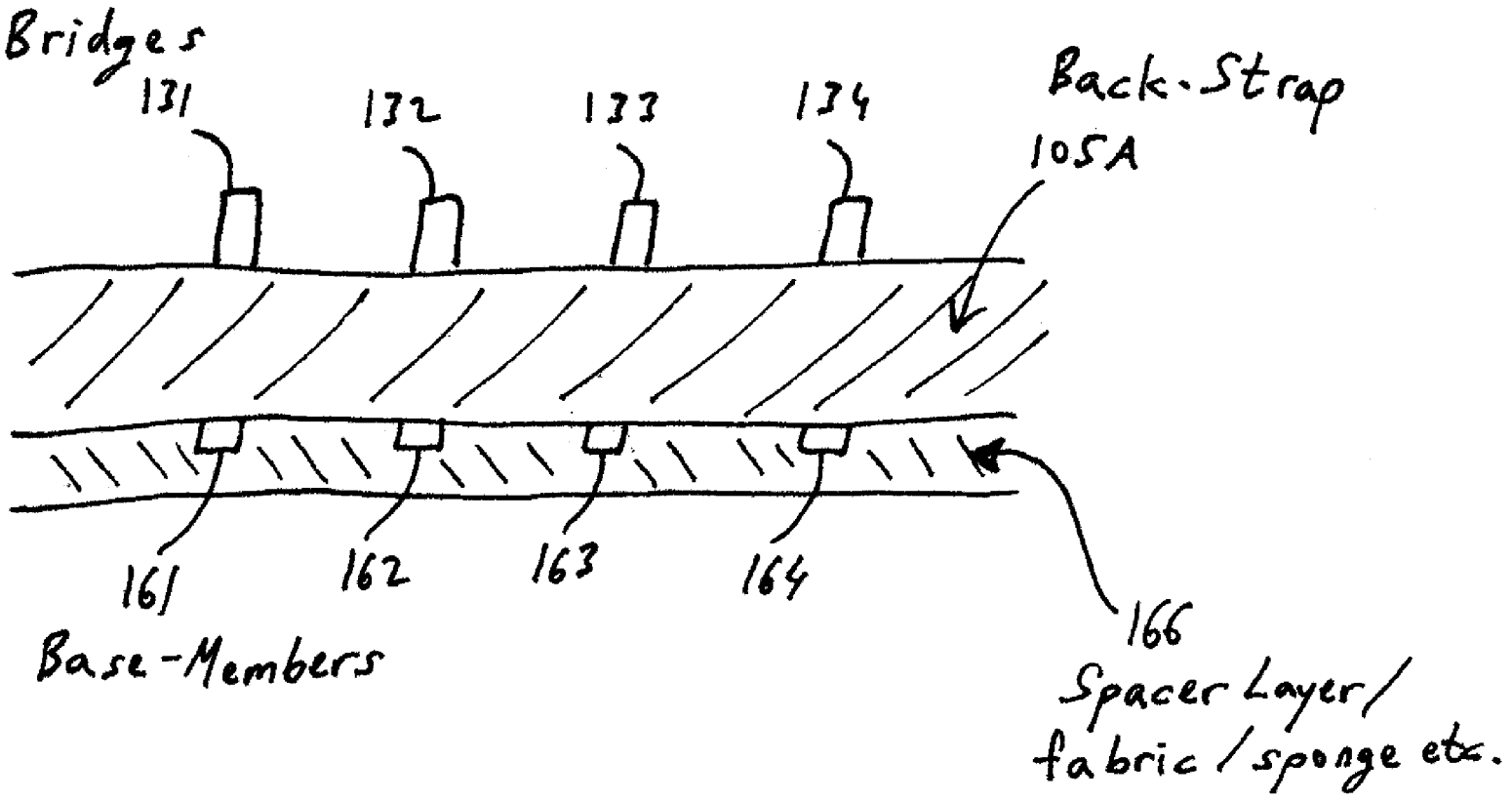
FIG. 16 is a schematic illustration of a side-view of a fastener area of a back-strap of a bra, in accordance with some demonstrative embodiments of the present invention

In accordance with some demonstrative embodiments of the present invention, as demonstrated in the side-view or cross-section shown in FIG. 16, optionally, the internal-side or inner-side of the back-strap of the bra, may optionally comprise a spacer layer 166 or other fabric layer (e.g., made of cotton, polyester, knitted material, fabrics, wool, silk, Lycra, Spandex, elastic, rubber, sponge, sponge-like material, woven material, non-woven material, silicone, or other suitable materials or soft materials or cushioning materials or cushioning layer or softening layers), which may cover or enclose or cushion therein the base members 161-164. This may increase the comfort of wearing the bra; may eliminate the feeling of plastic or other non-fabric components touching the wearer's body (e.g., in general, or when the wearer is reclining back such that her back touches a chair); may eliminate the feeling of rigid or semi-rigid components touching the wearer's body; and/or may protect the fastener and improve its longevity (e.g., by providing a fabric layer that protects the inner-side of the fastener when it falls to the floor or when it is placed inside a washer or a dryer).

It is noted that the bra or portions thereof, such as the back-strap of the bra, or any bra-portion that holds the female member, or any bra-portion that holds the male member, may optionally be formed of a single layer of fabric; or of two or three layers of fabric; or of multiple layers of fabric; or of a combination of layers (e.g., one or more layers of fabric; one or more layers of soft sponge; one or more layers of Lycra or Spandex; one or more layers of woven materials; one or more layers of non-woven materials; or the like). In some embodiments, one or more suitable attachment mechanisms, gluing, bonding, stitching, ultrasonic cutting, ultrasonic welding, ultrasonic attachment, and/or other suitable mechanisms, may be used in order to hold together two or more layers of fabric or two or more layers of materials.

Figure 17:
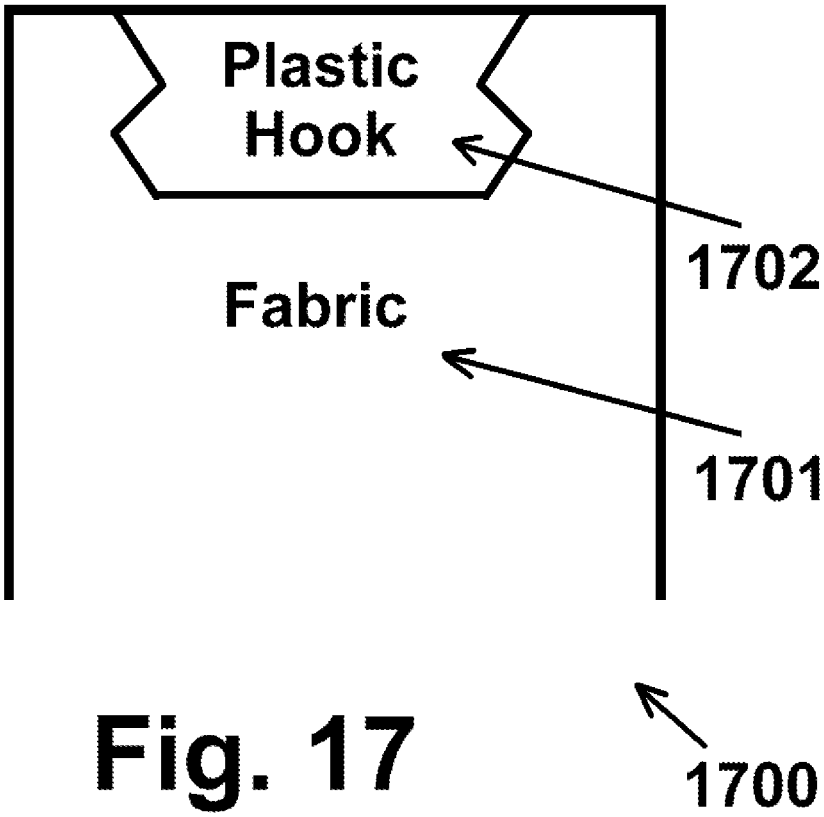
FIGS. 17-26 are schematic illustrations of various male members of a fastener of a bra (or other garment), in accordance with some embodiments of the present invention.

Reference is made to FIG. 17, which is a schematic illustration of a male member 1700 of a fastener of a bra (or other garment), in accordance with some embodiments of the present invention; demonstrating a single plastic hook 1702 covering on top of fabric 1701.

Figure 18:
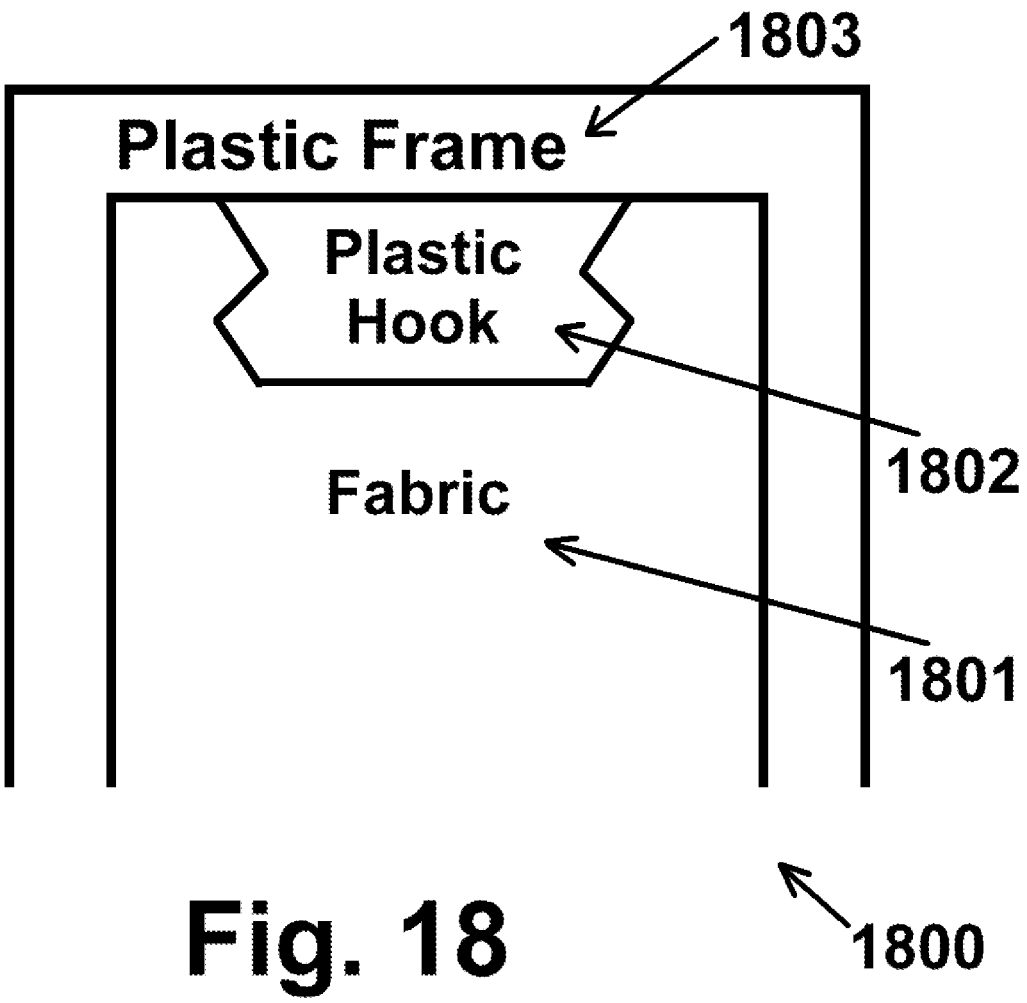

Reference is made to FIG. 18, which is a schematic illustration of a male member 1800 of a fastener of a bra (or other garment), in accordance with some embodiments of the present invention; demonstrating a single plastic hook 1802 covering on top of fabric 1801, the plastic hook 1802 connected to a plastic frame 1803 or other buffer zone or buffer rod(s).

Figure 19:
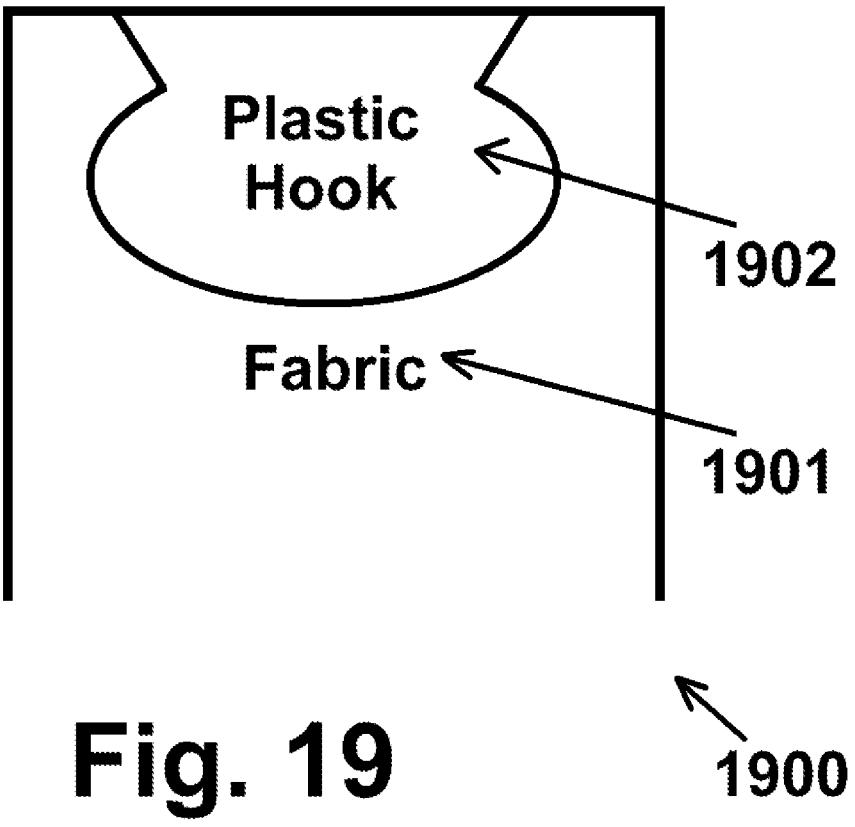

Reference is made to FIG. 19, which is a schematic illustration of a male member 1900 of a fastener of a bra (or other garment), in accordance with some embodiments of the present invention; demonstrating a single generally mushroom-shaped plastic hook 1902 covering on top of fabric 1901.

Figure 20:
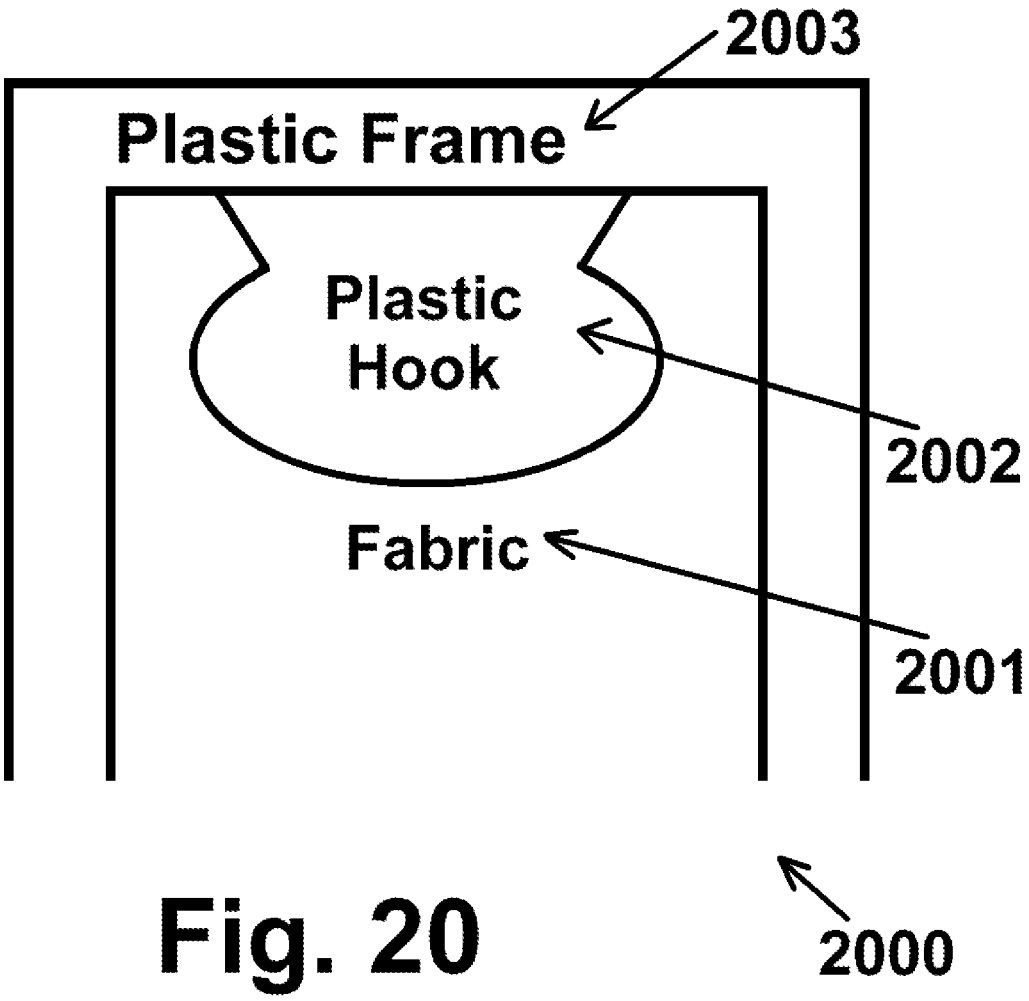

Reference is made to FIG. 20, which is a schematic illustration of a male member 2000 of a fastener of a bra (or other garment), in accordance with some embodiments of the present invention; demonstrating a single generally mushroom-shaped plastic hook 2002 covering on top of fabric 2001, the plastic hook 2002 connected to a plastic frame 2003 or other buffer zone or buffer rod(s).

Figure 21:
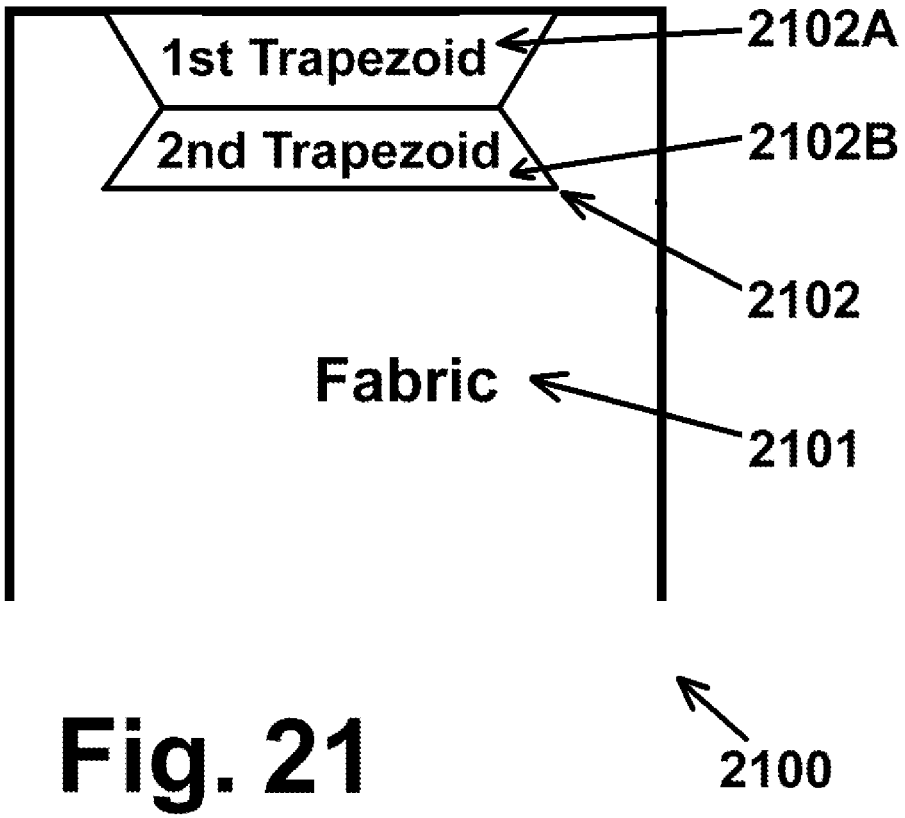

Reference is made to FIG. 21, which is a schematic illustration of a male member 2100 of a fastener of a bra (or other garment), in accordance with some embodiments of the present invention; demonstrating a single plastic hook 2102 consisting of two trapezoids 2102A and 2102B, covering on top of fabric 2101.

Figure 22:
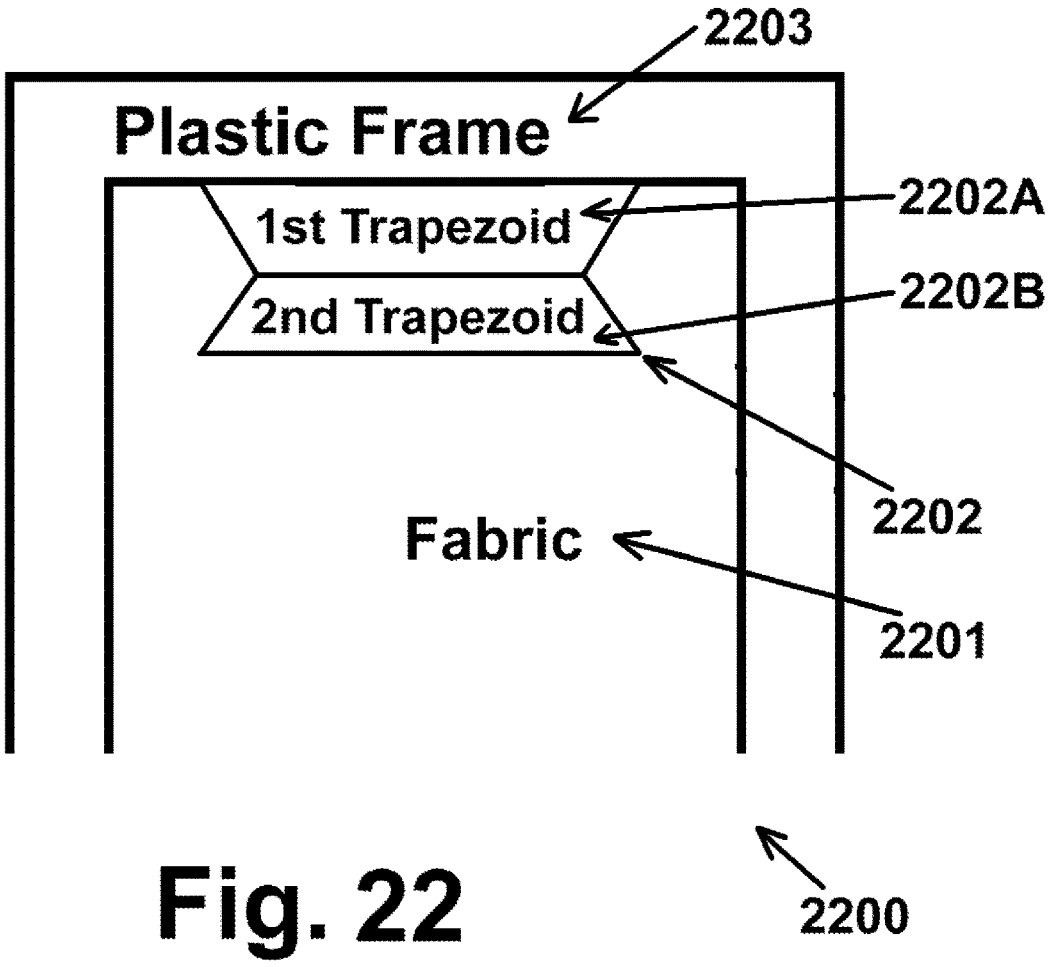

Reference is made to FIG. 22, which is a schematic illustration of a male member 2200 of a fastener of a bra (or other garment), in accordance with some embodiments of the present invention; demonstrating a single plastic hook 2202 consisting of two trapezoids 2202A and 2202B, covering on top of fabric 2201, the plastic hook 2202 connected to a plastic frame 2203 or other buffer zone or buffer rod(s).

Figure 23:
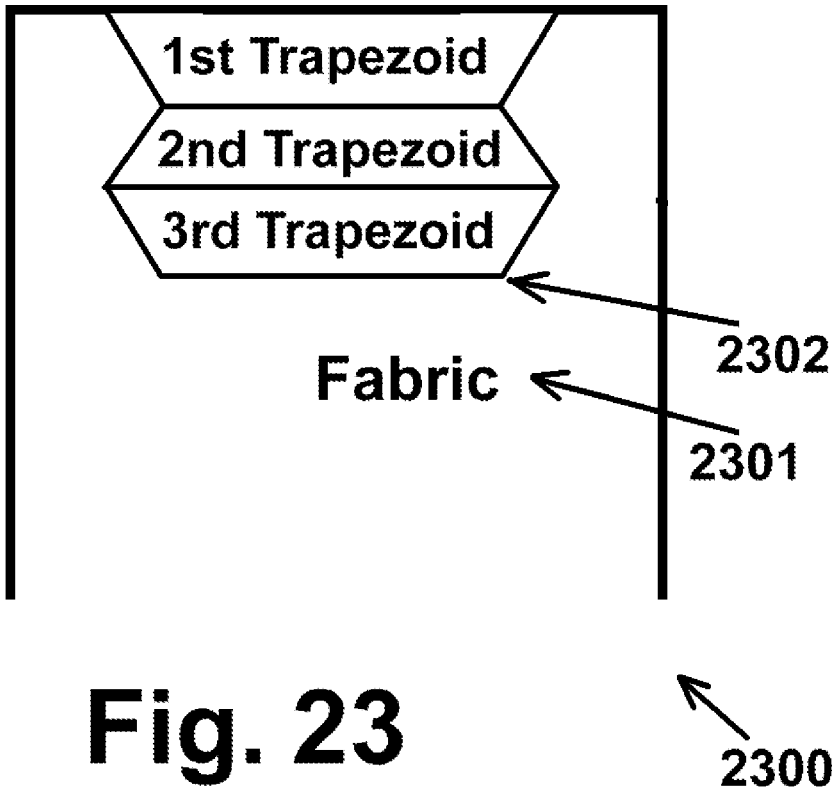

Reference is made to FIG. 23, which is a schematic illustration of a male member 2300 of a fastener of a bra (or other garment), in accordance with some embodiments of the present invention; demonstrating a single plastic hook 2302 consisting of three trapezoids, covering on top of fabric 2301.

Figure 24:
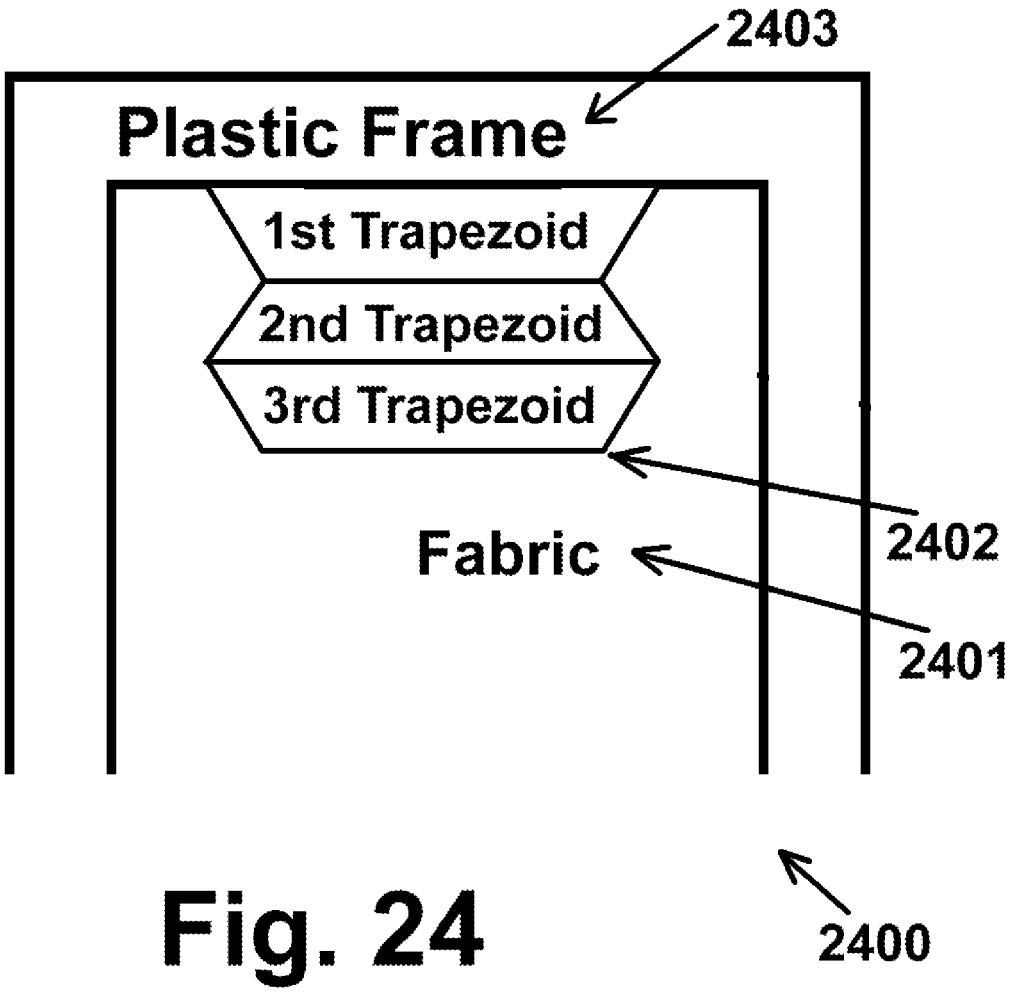

Reference is made to FIG. 24, which is a schematic illustration of a male member 2400 of a fastener of a bra (or other garment), in accordance with some embodiments of the present invention; demonstrating a single plastic hook 2402 consisting of three trapezoids, covering on top of fabric 2401, the plastic hook 2402 connected to a plastic frame 2403 or other buffer zone or buffer rod(s).

Figure 25:
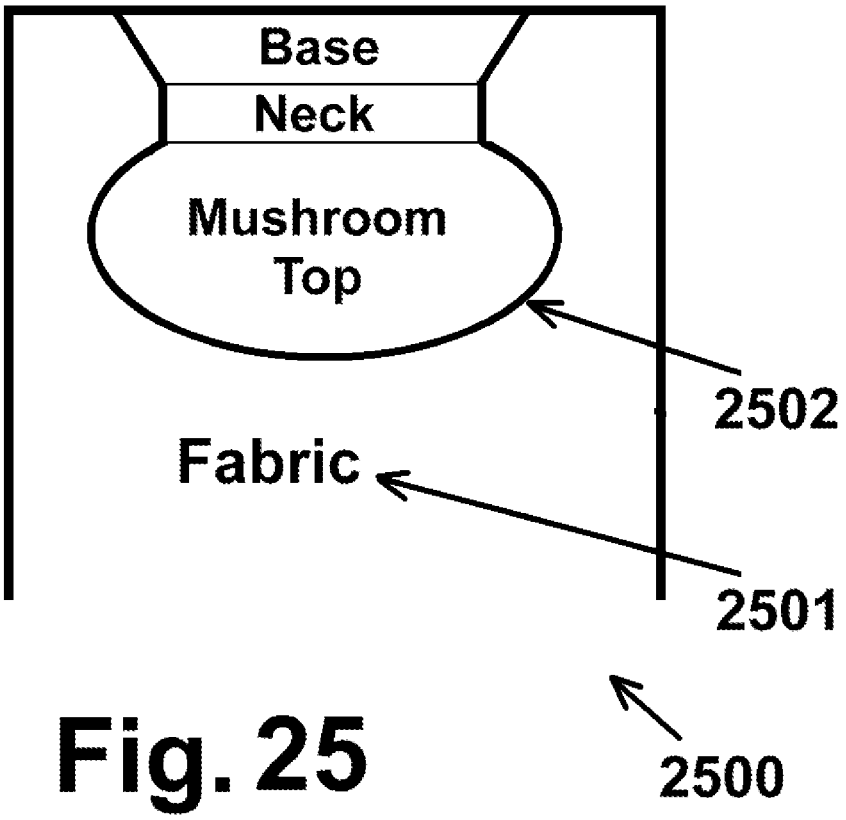

Reference is made to FIG. 25, which is a schematic illustration of a male member 2500 of a fastener of a bra (or other garment), in accordance with some embodiments of the present invention; demonstrating a single generally mushroom-shaped plastic hook 2502 covering on top of fabric 2501, the plastic hook 2502 having multiple regions (e.g., three regions: mushroom base region, mushroom neck region, mushroom top region).

Figure 26:
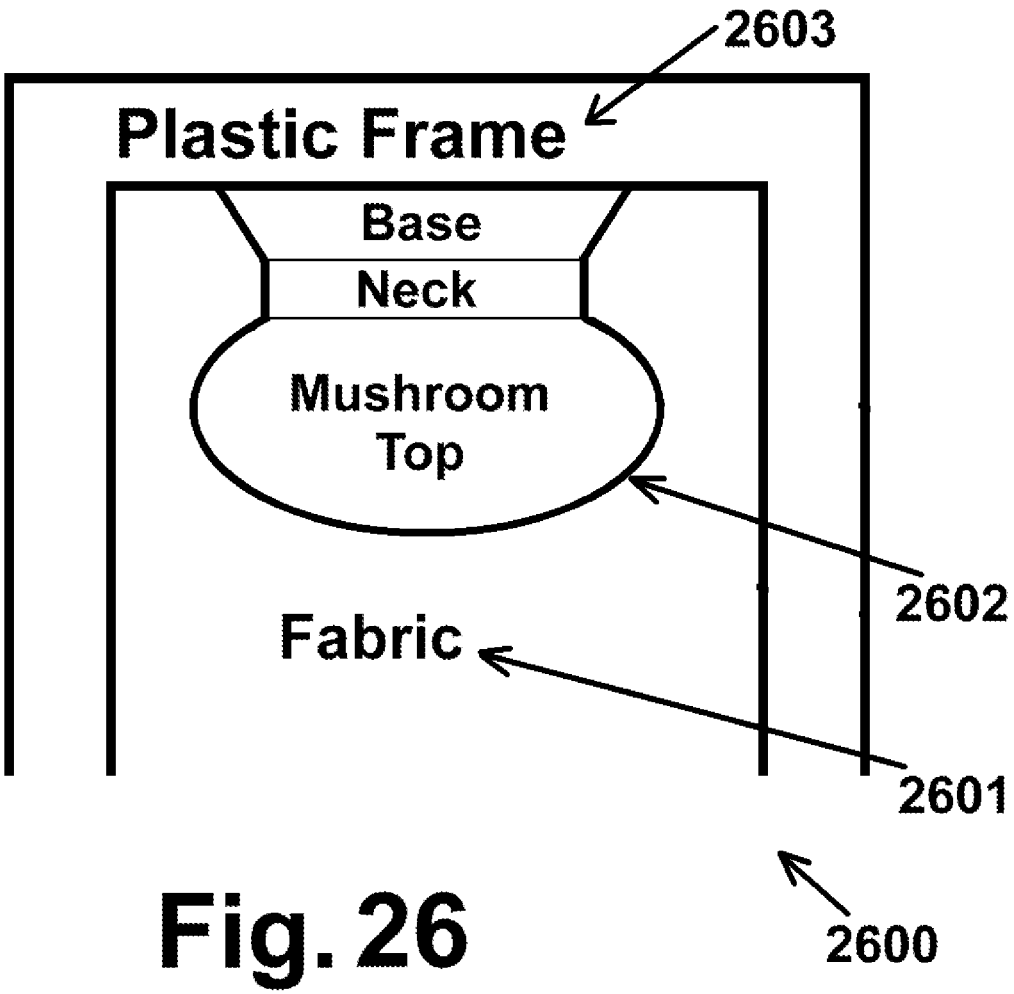

Reference is made to FIG. 26, which is a schematic illustration of a male member 2600 of a fastener of a bra (or other garment), in accordance with some embodiments of the present invention; demonstrating a single generally mushroom-shaped plastic hook 2602 covering on top of fabric 2601, the plastic hook 2602 having multiple regions (e.g., three regions: mushroom base region, mushroom neck region, mushroom top region), the plastic hook 2602 connected to a plastic frame 2603 or other buffer zone or buffer rod(s).

Figure 27A:
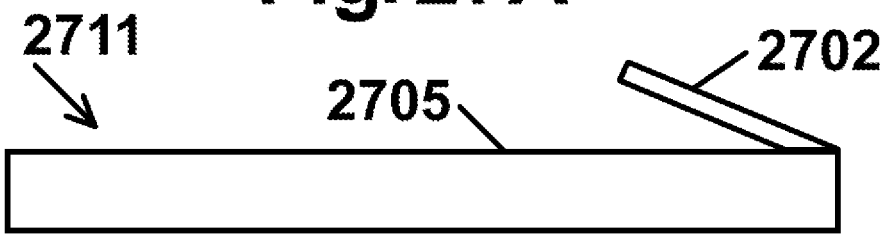
FIGS. 27A-27C are schematic illustrations of side-views of various male members of a fastener of a bra (or other garment), in accordance with some embodiments of the present invention.

Reference is made to FIG. 27A, which is a schematic illustration of a side-view of a male member 2711 of a fastener of a bra (or other garment), in accordance with some embodiments of the present invention; demonstrating that a single hook 2702 is slanted outwardly relative to a general plane of the fabric 2705 of the back-side of the bra.

Figure 27B:
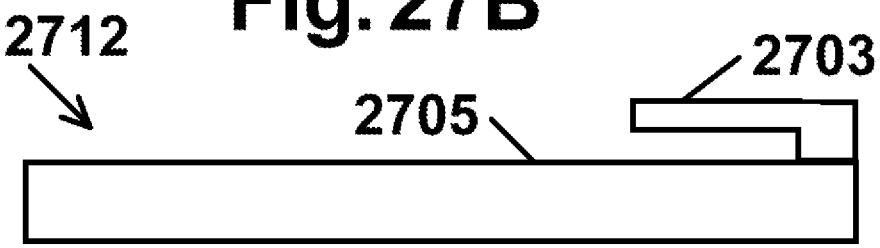

Reference is made to FIG. 27B, which is a schematic illustration of a side-view of a male member 2712 of a fastener of a bra (or other garment), in accordance with some embodiments of the present invention; demonstrating that a single hook 2703 is generally parallel to a general plane of the fabric 2705 of the back-side of the bra.

Figure 27C:
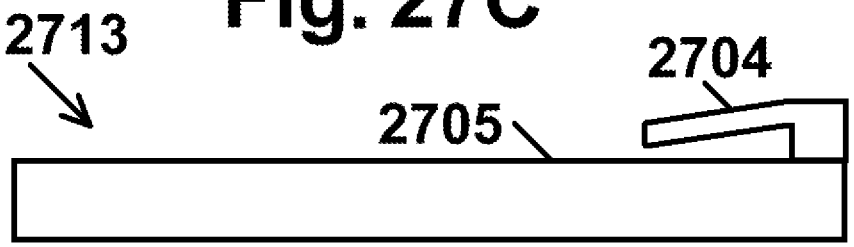

Reference is made to FIG. 27C, which is a schematic illustration of a side-view of a male member 2713 of a fastener of a bra (or other garment), in accordance with some embodiments of the present invention; demonstrating that a single hook 2704 is slanted inwardly relative to a general plane of the fabric 2705 of the back-side of the bra.

Each one of the components described herein, including for example, the bridges, the hook, the frame, the interconnected regions or members, or the like, may be formed or made of one or more suitable materials; for example, plastic, injected plastic, injection molding of raw plastic materials, fabric, fiber, metal, light metal, or the like.

In some embodiments, each bridge (e.g., in the female member, or in member 111) may be formed of two separate units that may be assembled or fused or bonded or glues together, or otherwise attached to each other; and such two parts may be located on two opposite sides of a fabric layer that may be "sandwiched" or trapped between those parts. For example, ultrasonic fusion or ultrasonic soldering may be used in order to attach together the two parts of each such bridge unit such that the fabric layer is trapped or "sandwiched" between them. Additionally or alternatively, such two parts of each bridge unit, may be produced by injection molding of raw plastic material(s) through the fabric layer, in order to create a bridge unit made of plastic, that traps a fabric layer therein. Other suitable methods may be used.

In some embodiments, each one of the bridges may be movable relative to, and separately from or discretely from, any other bridge in the fastener, or relative to at least one more immediately-neighboring bridge, or relative to at least two immediately-neighboring bridges; or each bridge may have at least some degree(s) of freedom of movement relative to such other bridge(s) of the fastener. In some embodiments, each region or member of the fastener, that contains a single bridge therein, may be attached to neighboring bridge-region(s) by using gluing, bonding, sewing, knitting, threading, fusion, ultrasonic process, ultrasonic bonding, ultrasonic gluing, ultrasonic attachment, ultrasonic re-enforcement of attachments, or other suitable processes or operations. Similar processes or operations may be used, for example, in order to connect or attach the bridge(s) and/or the hook(s) to one or more layers of fabric, or to strap(s) of the bra or garment; as well as to attachment or connection of two or more layers of fabric themselves. Other suitable methods may be used.

Figure 28B:
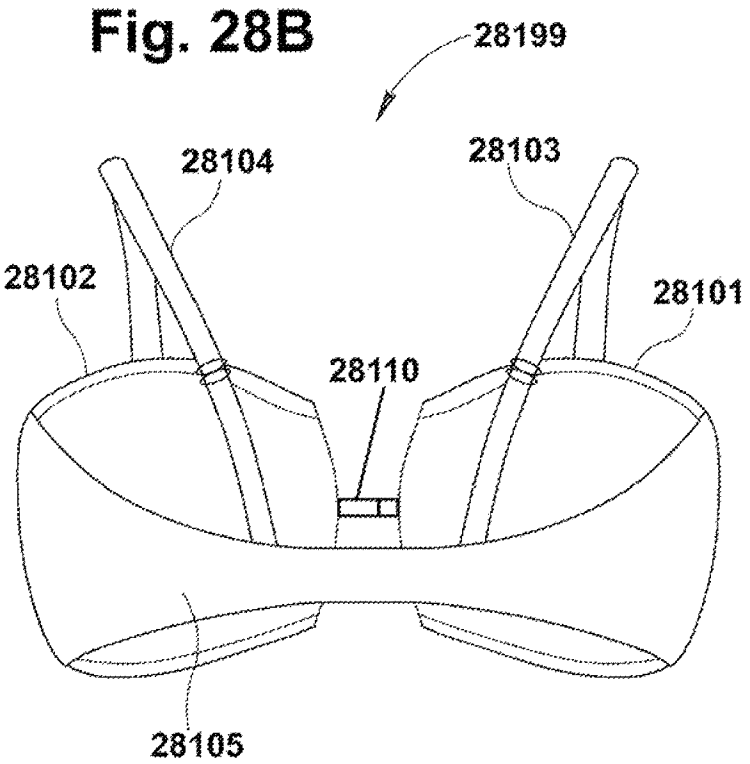
FIGS. 28A-28B are schematic illustrations of a bra having a front-side fastener, in accordance with some demonstrative embodiments of the present invention.
Figure 28A:
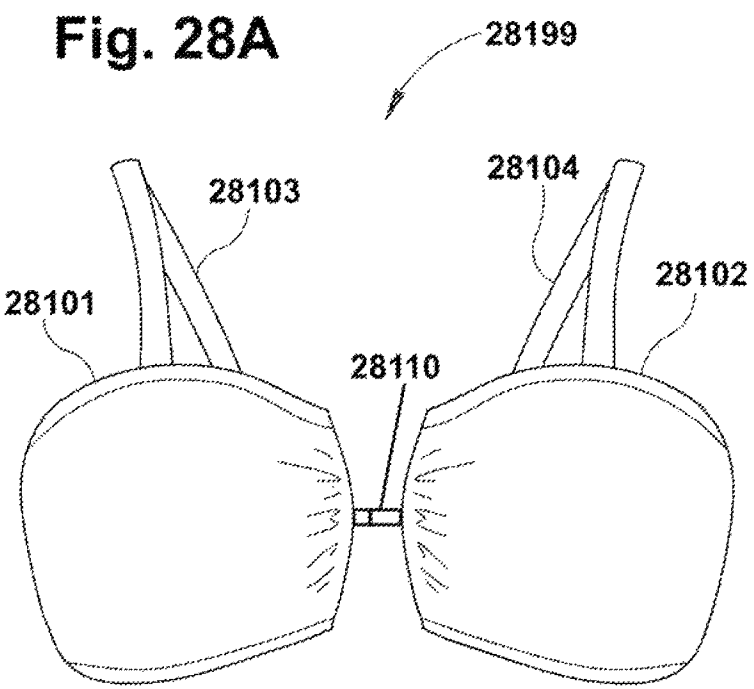

Reference is made to FIGS. 28A-28B, which are schematic illustrations (front-view and rear-view) of a bra 28199 in accordance with some demonstrative embodiments of the present invention. Bra 28199 may comprise, for example, two front-side cups 28101-28102, a right-shoulder strap 28103, a left-shoulder strap 28104, and a back-strap comprising; and may comprise a front-side fastener 28110 located between (and attaching/detaching) the two cups.

Figure 29B:
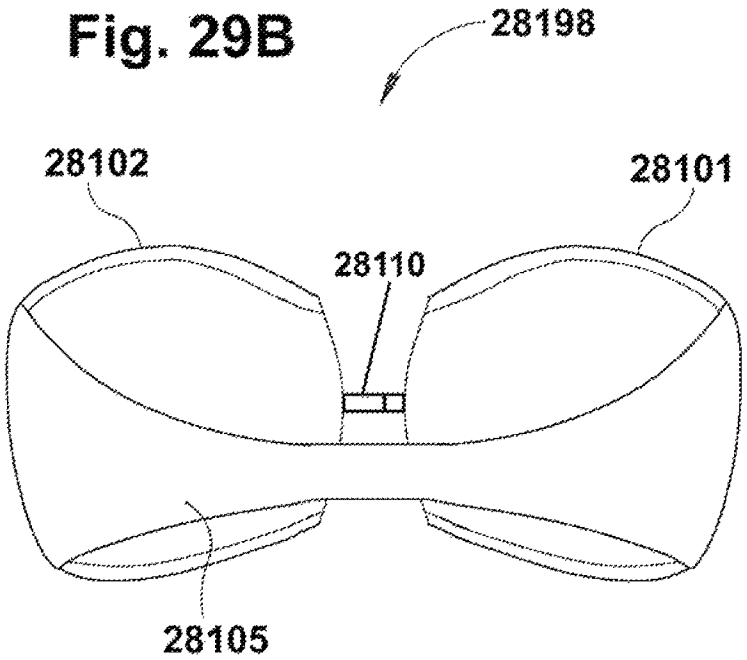
FIGS. 29A-29B are schematic illustrations of a strapless bra having a front-side fastener, in accordance with some demonstrative embodiments of the present invention.
Figure 29A:
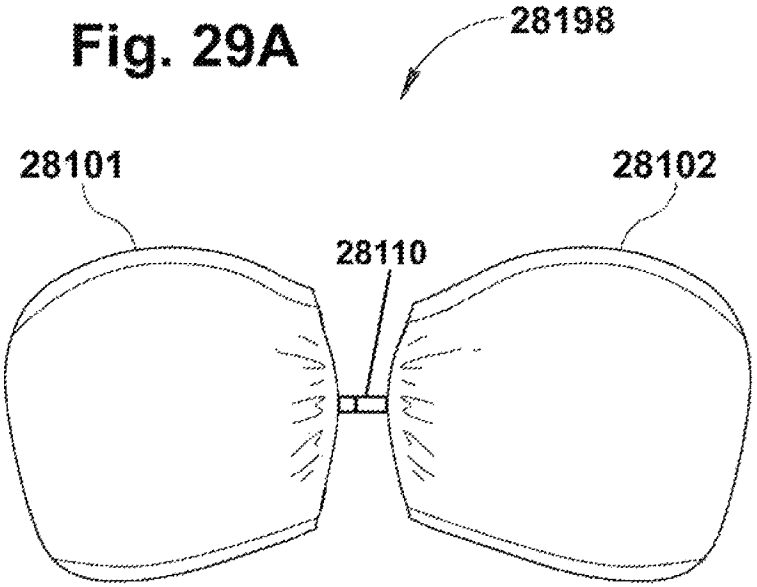

Reference is made to FIGS. 29A-29B, which are schematic illustrations (front-view and rear-view) of a strapless bra 28198 in accordance with some demonstrative embodiments of the present invention. Bra 28198 may comprise, for example, two front-side cups 28101-28102, and back-strap 28105; and may comprise front-side fastener 28110. Strapless bra 198 may lack, or may not comprise, any shoulder straps; or may exclude any shoulder straps.

In accordance with the present invention, a front-side fastener such as fastener 28110 may be of the structure and/or may have features which may be identical to, or similar to, any back-side fastener that is described herein and/or shown herein. In accordance with the present invention, the front-side fastener may facilitate the attachment/detachment of the two front-side cups, and may allow efficient attachment and detachment thereof (and thus, efficient closing and opening of the bra from the front side), without requiring cumbersome hand movements or finger movements, and without requiring the user to see or observe the front-side fastener in order to properly and efficiently operate it. Accordingly, the present invention may comprise a bra or brassiere, or other lingerie item or undergarment or garment, having a front-side fastener in accordance with any of the fastener implementations that are shown and/or discussed herein, and which may suitable be adapted as a front-side fastener.

In some embodiments, the back-side fastener of the present invention may be used in conjunction with back-sides of other suitable garments (e.g., pants, shirts, or the like). In some embodiments, the front-side fastener of the present invention may be used in conjunction with front-sides of other suitable garments (e.g., pants, shirts, or the like). In some embodiments, the fastener of the present invention may be used in conjunction with right-side and/or left-side of other suitable garments (e.g., pants, shirts, or the like), such that the fastener may be located to the right side of the wearer, or to the left side of the user, and not necessarily at the back or in the front.

In some embodiments, optionally, the fastener of the present invention, or the male and female members thereof, may be constructed or structured such that engagement or closure of the fastener generates a "click" sound or other audible sound or audible indication, in order to convey to the user that the fastener is properly closed. For example, the particular width or thickness of the male member (e.g., the hook) and/or the female member(s) (e.g., the bridges or rungs) may be such that proper engagement of them creates a "click" sound or audio effect or audible effect or sound; for example, due to a snapping-together of male member and female member, or due to friction between a hook and a bridge, or the like. This may be particularly useful or advantageous in order to convey to the user, who may operate the fastener "blindly" without seeing it, that the fastener is indeed properly engaged or closed (e.g., behind the back of the wearer). The fastener may thus comprise, or may be structured to feature, a sound-generating protrusion or curve or snapping-part, that generates a "click" sound or other distinct sound upon its proper engagement with a bridge or run of the female member of the fastener.

The present invention may comprise a method of producing or manufacturing a bra, or an article of clothing, or a fastener for a bra, or a fastener for an article of clothing. The method may comprise, for example: (a) preparing or providing or producing multiple bridges; (b) preparing or providing or producing one hook, or multiple hooks; (c) attaching the multiple bridges to a first region of a strap (e.g., a first region of a back-strap of a bra), in accordance with one or more of the properties or characteristics that are described above; (d) attaching the hook (or the multiple hooks) to a second region of the strap (e.g., a second region of the back-strap of the bra); (e) optionally, producing and/or attaching a frame encompassing the bridges. Other suitable operations may be used, in other orders of steps.

Some embodiments of the present invention may comprise a fastener for a brassiere, which comprises a strap having first and second sides. Rungs spaced from one another along the strap are attached to the first side, and a hook is attached to the second side. The hook is engageable with each of the rungs, the sensitiveness of the fastener being determined by the selected rung to be engaged by the hook. The two sides of a brassiere strap are coupled by pulling the first and second sides towards each other such that the one hook slides over the upper surface of the rungs, selecting a desired rung for the hook, and engaging the hook with the selected corresponding rung along any region of the length of the selected rung. The present invention further comprises a method for assembling such a fastener, as well as a method of opening and/or closing such fastener or such bra.

Some embodiments of the present invention provide a fastener for a brassiere, which allows the wearer of the bra to conveniently and easily adjust the girth of the bra to her size. The bra comprises a strap comprising two sides that hang on the back of the wearer when the bra is being donned. The may also comprise shoulder strap(s) that may optionally be adjusted, if desired, in the same way in which the back-strap fastener may be adjusted. In other words, the features of the back-side or back-strap fastener, may also be applied to the shoulder-strap(s) of the bra, or to other strap(s) of other suitable garments.

The fastener according to the present invention comprises a strap having first and second sides; a plurality of retaining elements spaced from one another along said strap and attached to said first side; and at least one hook attached to said second side, said at least one hook being engageable with each of said retaining elements, the sensitiveness of the fastener being determined by the selected retaining element to be engaged by said at least hook.

For the purposes of this invention, a single hook is sufficient; however a plurality of eyes or bridges or rungs may be provided on the second side of the strap, forming a row with which the single hook is aligned or substantially aligned along a transverse line. Optionally, a plurality of hooks and two parallel rows of retaining elements may be used in large size bras; however, a single enlarged and wide hook is typically used for a single bra, in accordance with some embodiments of the present invention.

In some embodiments of the present invention, each of the plurality of retaining elements is transversely disposed and in a mutually parallel and equally longitudinally spaced relation. In some embodiments of the present invention, by "longitudinal direction" is meant the direction of the bra strap, which is circumferential with respect to the wearer's chest when the bra is worn. The "transverse" direction is the direction perpendicular to the longitudinal direction, viz. the direction of the width of the strap. When the fastener of the invention is used as a shoulder strap, the rungs are spaced in a vertical (instead of longitudinal) direction.

In some embodiments of the present invention, the retaining elements are elongated, longitudinally spaced from one another on said first side of the strap, and each is placed transversely of said first side of the strap, viz. with its length parallel to a cross-section of the strap, said length being optionally equal to least 0.75 of the width of the strap. Since the plurality of the transverse, retaining elements together with the frame generate a structure that is similar to a ladder, said elements may be called hereinafter "rungs" or "bridges". Optionally, two rows of retaining elements, or, two parallel ladders, may be provided, in which case the width of each ladder will be less than 0.75 and optionally about 0.30 or 0.35 or 0.40 of the width of the strap.

In some embodiments of the present invention, the plurality of rungs are attached to the first side by means of a frame, the bottom of each of the rungs being spaced from the first side by a sufficient distance for facilitating the engagement of the hook. The frame is optionally attachable to the first side. In some embodiments of the present invention, the term "frame", as used herein, includes any structure or combination of structures that can hold transversal elements or rungs in stable position on a fabric layer.

In some embodiments of the present invention, when the strap is assembled, or when a hook is engaged with a rung, the assembled strap has an overall length that is determined by the rung with which the hook has been engaged, which length is relevant to the comfort of the bra. Said length can be changed by changing the rung with which the hook is engaged, and the spacing between two successive rungs influences the difference that the wearer can cause in the length of the bra strap and therefore the extent to which the wearer can control the comfort of the bra. The length of the strap extending between two successive rungs may be called the "sensitiveness" of the fastener and is optionally between 0.30 and 1.50 centimeters, or between 0.40 and 0.70 centimeter. The sensitiveness of the fastener may be additionally adjusted by displacing an engaged hook along the rung with which it is engaged.

In some embodiments of the present invention, the rungs are in the number of at least four, or between three and eight. The rungs may be made of plastic or metal. They may be connected to the frame in any suitable way: thus, frame and rungs may constitute a single monolithic body, e.g., a single plastic molded body; or the rungs may be attached to the frame by welding or sewing or by means of rivets or by any other suitable means. Optionally, the rungs may form a rope ladder configuration. The frame and the rungs, together, may be called the female half (or female member) of the fastener; the hook or hooks being the male half (or male member).

Some embodiments of the present invention may utilize any structure or combination of structures that can hold transversal elements or rungs in stable position on a fabric layer, particularly on a tape or a side of strap, or hold them in stable position in the absence of a fabric layer, to constitute a "frame", or optionally a flexible frame. The flexible frame may be made of plastic or other flexible material. It may be quadrilateral or sub-quadrilateral, or may have one or more curved sides, optionally a transverse or both transverse sides. It may be polygonal with three sides, two longitudinal ones and a transverse one. It may consist only of two longitudinal sides. In an embodiment of the present invention, the frame consists of two longitudinal sides made of strong filaments or yarns, particularly synthetic yarns. In another embodiment of the present invention, the frame consists of two longitudinal rows of rivets that connect both ends of each rung to the first side of the bra strap. Optionally, the frame may comprise two or more parts. Any suitable structure or combination of structures that can hold transversal elements or rungs in stable position on a fabric, particularly on a tape or a side of strap, may serve as a suitable "frame" for the female member of the fastener.

In some embodiments of the present invention, the frame comprises at least two rows of support elements, a rung being secured by a pair of opposed support elements. Each row of support elements is interposed between two end elements, e.g. having a cross-section in the shape of a right trapezoid. The upper surface, i.e. the surface more spaced from the wearer, of said support elements and end elements are substantially coplanar, and the bottom surface, i.e. the surface closer to the wearer, of said support elements and end elements are substantially coplanar.

In some embodiments of the present invention, each support element is preferably formed with an aperture, a rung being secured to the aperture formed in each of the opposed support elements by means of frictional engagement. To facilitate securement with a support element, the rung is tubular and has two flattened end portions.

In some embodiments of the present invention, the frame further comprises fabric stitched in such a way so as to apply a tensile force onto the support elements and/or end elements. The fabric may be a single-piece outer fabric layer or may comprise upper and bottom fabric layers. When the stitched fabric is of two pieces, the bottom fabric layer is planar and the upper fabric layer is of a variable shape, e.g. the upper fabric layer is folded in such a way that each row of support elements is seated within a different folded portion thereof.

In some embodiments of the present invention, the frame and rungs constitute a single body, such as one produced from molded plastic. In some embodiments of the present invention, each rung is produced from a piece of molded plastic which is injected directly onto the first side. Each piece of plastic comprises two positioning members which adhere to the first side and a rung interposed between said two positioning members. In some embodiments of the present invention, each piece of plastic comprises two posts protruding from the first side, a rung extending between said two posts, and a positioning member adjoining each of said posts, the bottom of said rung being spaced from the bottom edge of said posts by a sufficient distance for facilitating the engagement of the hook. In some embodiments of the present invention, each piece of plastic comprises a base which is considerably wider than the corresponding rung or positioning members, the bottom of each rung being spaced from said base by a sufficient distance for facilitating the engagement of the hook.

In some embodiments of the present invention, each piece of plastic is produced from single-sided molded plastic. In some embodiments of the present invention, each piece of plastic is produced from double-sided molded plastic, a plastic portion injected onto the bottom face of the first side being fusible with the corresponding positioning member formed on the upper face thereof. In some embodiments of the present invention, the first side of the strap may be of double width fabric, said double width fabric being foldable so as to cover the plastic portions formed on the bottom face of the first side.

In some embodiments of the present invention, the rungs are attached to flaps folded along the transverse ends of the first side. In some embodiments of the present invention, the rungs may be attached to the flaps by means chosen from the group consisting of welding, sewing, stitching and adhesive connection.

In some embodiments of the present invention, the hooks are made of plastic or metal. Such materials are inherently rigid, but the hooks may be thin enough to have some flexibility. They are attached to the second side of the bra strap by any convenient means, substantially along a transverse line, as has been said, if there are more than one. In some embodiments of the present invention, their transverse dimension or width is smaller than, but close to, the transverse dimension of length of the rungs, permitting a hook to engage a rung and insert its terminal portion between the rung and the first side of the strap, while maintaining a stable engagement with the said rung.

In some embodiments of the present invention, the first and second sides of the strap may optionally be made of an elastic material to provide a better fitting of the bra. If an elastic material is used, it may optionally be such that it stretches only in the longitudinal direction so as to maintain dimensional stability in the transverse direction.

Some embodiments of the present invention provide a method for coupling two sides of a brassiere, comprising: (a) Providing a strap having first and second sides; a plurality of elongated rungs spaced from one another along said strap and attached to said first side; and at least one hook attached to said second side; (b) Pulling said first and second sides towards each other such that said at least one hook slides over the upper surface of said rungs; (c) Selecting a desired rung for each of said at least one hook; (d) Engaging said at least one hook with said selected corresponding rung along any region of the length of said selected corresponding rung, the sensitiveness of the fastener being determined by the selected rung to be engaged by said at least one hook. In some embodiments of the present invention, the at least one hook is engaged with said selected rung by ceasing to pull said first and second sides together when the wearer feels that the brassiere is tighter than a desirable fit; and allowing said at least one hook to engage a selected rung by a backward motion.

In some embodiments of the present invention, the bottom of the rungs may be separated from the fabric of the first side, the spacing between the bottom of the rungs and the fabric of the first side accommodating the curvature, or the inclination, of the at least one hook, after engagement with the selected corresponding rung.

In some embodiments of the present invention, the sensitiveness of the fastener is adjusted by disengaging a hook from a rung and engaging said hook with an adjacent rung, or by displacing an engaged hook along the rung with which it is engaged.

In some embodiments of the present invention, a method of assembling a fastener may comprise: providing a strap having first and second sides; attaching a plurality of rungs to said first side such that each of said rungs is spaced from one another; and attaching at least one hook to said second side, said at least one hook being engageable with each of said rungs, the sensitiveness of the fastener being determined by the selected rung to be engaged by said at least one hook.

In some embodiments of the present invention, the plurality of rungs are attached to the first side such that each of the plurality of rungs is transversely disposed and in a mutually parallel and equally spaced relation. In some embodiments of the present invention, the plurality of rungs are attached to the first side such that the bottom of each of the rungs is spaced from the first side by a sufficient distance for facilitating the engagement of the at least one hook. In some embodiments of the present invention, the plurality of rungs are attached to a frame and said frame is attached to the first side.

In some embodiments of the present invention, the frame is assembled by: (a) Punching suitable areas of a fabric layer for accommodating a plurality of rungs; (b) Placing first and second rows of support elements on said fabric layer such that each pair of adjacent support elements from one of said rows is equidistantly spaced; (c) Wrapping said fabric layer around said first and second rows of support elements; (d) Inserting each of a plurality of rungs through two corresponding holes punched in said fabric layer; (e) Connecting each of a plurality of rungs to a support element from said first row and to a corresponding support element from said second row; (f) Pushing each support element from said first row and the corresponding support element from said second row towards each other until the rung interposed therebetween is frictionally engaged to said pushed support elements; (g) Stitching said fabric layer in such a way so as to apply a tensile force onto said first and second rows, a rung being secured by a pair of opposed support elements. In some embodiments of the present invention, the method further comprises the steps of placing an end element at each end of said first and second rows; and stitching said fabric layer in such a way so as to apply a tensile force additionally onto each of said end elements.

In some embodiments of the present invention, a rung is connected to a support element by inserting a flattened end portion of a rung into an aperture formed in the support element. In some embodiments of the present invention, the fabric layer is a one-piece fabric layer. In some embodiments of the present invention, the frame comprises a planar bottom fabric layer and an upper fabric layer of a variable shape. In some embodiments of the present invention, the upper fabric layer is folded in such a way that each row of support elements is seated within a different folded portion thereof. In some embodiments of the present invention, each rung is attached to the first side by forming a single plastic piece having a rung and two positioning members by injection molding which is applied directly to the first side. In some embodiments of the present invention, the positioning members adhere to the first side and the rung is interposed between said two positioning members.

In some embodiments of the present invention, each piece of plastic is formed with two posts protruding from the first side, a rung extending between said two posts, and a positioning member adjoining each of said posts, the bottom of said rung being spaced from the bottom edge of said posts by a sufficient distance for facilitating the engagement of the hook.

In some embodiments of the present invention, each piece of plastic is formed with a base which is considerably wider than the corresponding rung or positioning members, the bottom of each rung being spaced from said base by a sufficient distance for facilitating the engagement of the hook. In some embodiments of the present invention, each piece of plastic is produced from single-sided molded plastic. In some embodiments of the present invention, each piece of plastic is produced from double-sided molded plastic, whereby a plastic portion is injected onto the bottom face of the first side and fuses with the corresponding positioning member formed on the upper face thereof. The first side may be provided with double width fabric, whereby said double width fabric is folded and stitched so as to cover the plastic portions injected onto the bottom face of the first side.

In some embodiments of the present invention, the rungs are placed on a central portion of the first side; the transverse ends of the first side are folded to forms two flaps; and the rungs are attached to said flaps. The rungs may be attached to the flaps by from the group consisting of welding, sewing, stitching and adhesive connection.

Some embodiments of the present invention comprise a bra or other garment having a novel fastener, the bra or garment comprising a strap having first and second separate sections (hereinafter "sides"), wherein a plurality of transverse rungs are stably attached to the first side and a hook is attached to the second side. While prior art bra fasteners are inconvenient to manipulate in terms of the difficulty in targeting the hook into the eye blindly behind the back since each hook needs to be inserted into a corresponding eye of a corresponding column of eyes, the fastener of the present invention is advantageously configured. The fastener of the present invention is provided with a plurality of elongated transverse rungs in a spaced relation with an adjacent rung and with the underlying fabric of the first side. The hook attached to the second side is easily engageable behind the back of the wearer with a selected rung attached to the first side since there is no need to pinpoint the hook to a corresponding eye, but rather the hook may be engaged along the entire transverse length of the selected rung. By being able to engage one of the plurality of transversely disposed rungs anywhere on the length thereof, the first and second sides are coupled together with a desired longitudinal and transverse sensitiveness.

In some embodiments of the present invention, a frame is attached to said first side of the strap, in any convenient way, e.g. by sewing, by means of over molding, insert molding, adhesive, welding or by riveting. In this embodiment, the frame has the approximate form of a rectangle, the forward or distal side of which is wider and curved. By "distal" is meant herein "close to the end of the first or second side of the strap". Rungs are attached to the frame. Rungs and frame may be of plastic and be molded together; over molded or insert molded. Over mold is a process where two molds are used. One part is injected into a mold, is then transferred into another mold, and a different plastic is injected over the first part. In insert mold a metal or plastic part is inserted into the mold and plastic is injected over it. All the rungs may be connected to the frame in any convenient way, e.g. by welding or by being inserted in seats of the frame and being connected therein to the frame by means of adhesive or by welding due to heat. Rungs and frame, or only the frame, may be of plastic, injected or cast in a mold in which the terminal or distal portion of the second side of the strap is an insert, so that there may be no need of additional attaching means. The frame may also be made of two equal layers that are connected to one another in any convenient way and may enclose between them the strap. The frame is optionally made of a flexible material, particularly of soft plastic, so that it may bend in contact to the wearer's body and cause no discomfort to her.

In some embodiments of the present invention, the frame is connected by stitching to the strap and has the same cross-section at all points.

In some embodiments of the present invention, the frame is constituted by two longitudinal lines of stitching, by which the rungs are connected to the strap.

In some embodiments of the present invention, the frame is constituted by two longitudinal rows of rivets, two of which connect each rung to the strap. Said rivets may be metal rivets, inserted separately or concurrently in any convenient way, or may be created by the injection of plastic matter.

In some embodiments of the present invention, the frame may be constructed as a rope ladder. Two flexible longitudinal elements are made of any convenient material. Rungs are supported on longitudinal elements through eyes. While the frame may be supported by a fabric, this is not necessary, as the frame, while flexible, may be self-supporting.

In some embodiments of the present invention, the frame is provided with two longitudinal sides supporting transverse rungs and two curved transverse sides. The frame is connected in any suitable way to the strap. A hook is mounted on the first side of the strap and on the bottom thereof, on the side thereof that will be closer to the body of the wearer, said first side of the strap extending beyond the hook, to permit the wearer to grasp it and pull it, e.g. by a length of strap twice the distance between two adjacent rungs or more. The hook may be of a width, i.e., a transverse dimension, not very different from length or transverse dimension of the rungs, and is placed transversely on said first side of the strap.

In some embodiments of the present invention, when the wearer is donning the bra and pulls the two sides of the strap towards each other, the hook will slide over the top of the rungs. The wearer will pull the two sides of the strap towards one another, allowing the hook to slide over the rungs, until she feels that the bra is slightly tighter than would be desirable. At that time, she will cease to pull the two sides of the strap and leave them free to slide slightly back, while pressing slightly on the hook; and said hook will engage the first rung that it reaches in the said backward motion and be guided by said rung to slide into the space between said rung and the preceding one and engage said first rung, thereby closing the fastener. The spacing between the plurality of rungs and the fabric of the first side accommodates the curvature, or the inclination, of the hook, depending on the configuration thereof, after the latter is engaged with a selected rung.

In some embodiments of the present invention, the hook is attached, in any suitable way, e.g. by stitching or gluing or bonding or ultrasonic welding, to the second side of the strap. In some embodiments of the present invention, the hook engages one of the rungs. The closure of the fastener may comprise that the hook would be guided somewhat to become inserted in a space between two adjacent rungs and be able to engage the more distal one of said two rungs.

In some embodiments of the present invention, the frame is formed by two segments of filament or yarn, which are sewn to the first side of the strap. An eye is bored at each end of rungs. After inserting each filament or yarn into an eye, rungs are slid to a desired position. Thereafter, the rung, once in place, is connected to the filaments or yarns by pouring an adhesive or a molten plastic into its eyes. Finally, the resulting assembly of filaments or yarns and rungs, i.e. the female part of the fastener, is connected to the strap by any convenient means, e.g., by sewing it at the appropriate places or by plastic injection. To improve the connection of the ladder constituted by the said filaments or yarns and the said rungs, along the length of said ladder, to the strap, said ladder may be further secured to said strap at other points intermediate between the rungs, e.g. by stitching or bonding or gluing or ultrasonic welding or injection of plastic.

In some embodiments of the present invention, each rung is attached to the frame by means of a pair of support elements. In some embodiments of the present invention, the distal portion comprises first side of the strap, a plurality of mutually parallel transverse rungs, e.g. metallic pins, and a frame for securing each adjacent rung in an equally spaced relation. Optionally, the frame may have a rectilinear configuration, with its two opposed longitudinal walls being slightly raised above the fabric of first side; or, the frame may be non-raised and non-protruding relative to the fabric of the strap itself. Any other configuration of the frame is suitable, as long as the rungs are secured thereto in a parallel and generally equally-spaced relation.

In some embodiments of the present invention, the frame as the outer fabric layer is removed. Each longitudinal wall comprises a plurality of support elements, each of which secures a corresponding end of a rung, and two end elements having a cross-section in the shape of a right trapezoid, i.e. provided with two right angles, and being contiguous or integral with the corresponding rectangular element. The upper surface, i.e. on the side thereof that will be more distant from the body of the wearer, of support elements and end elements are substantially coplanar, and likewise the bottom surface of support elements and end elements are substantially coplanar. Support elements and end elements may be made from molded plastic, although other materials may also be suitable.

In some embodiments of the present invention, rungs are tubular and have flattened end portions, which are frictionally engageable with corresponding support elements. Each support element is formed with an aperture, which is suitably sized so as to receive a flattened end portion of a corresponding rung by frictional engagement. The support elements may be of any suitable shape, such as having an arcuate periphery. Suitable areas of one-piece fabric layer are then punched, so as to accommodate the plurality of rungs. After support elements and end elements are arranged in two rows, corresponding to the two longitudinal walls of frame, fabric layer is then wrapped around all of the rectangular elements, support elements, and end elements. Each flattened end portion of a rung is then inserted through a punched hole of fabric layer and is received within the corresponding support element, such that a rung is connected to two support elements. Thereinafter, the two support elements connected to the same rung are pushed transversely towards each other until the rung is frictionally engaged to the two support elements. Fabric layer is stitched such that the frame produced from these elements is rigid and stable, due to tensile force applied by the fabric layer onto the support elements and end elements. The produced frame is then stitched to the first side of the strap.

In some embodiments of the present invention, the frame may be produced from two fabric layers. For example, bottom fabric layer is planar, while upper fabric layer is of a variable shape. For example, upper fabric layer is made of a polyester mesh which retains its shape after being folded. In some embodiments of the present invention, upper fabric layer is folded in such a way that a plurality of support elements corresponding to a longitudinal wall of the frame are seated within the same folded portion of upper fabric layer. A folded portion is defined by the sides and by the base. The distance between the is substantially equal to the width of the upper concave abutting portion of support element, which abuts the base of the folded portion, so that the plurality of support elements are firmly retained by the folded portion.

In some embodiments of the present invention, two pairs of folded portions may likewise be formed, to accommodate two frames and to provide the wearer with a greater degree of sensitiveness. With respect to a frame with two folded portions, holes are punched in upper fabric layer along two regions that will be defined as sides of folded portion, following formation of the folded portions. After folding upper fabric layer to form sides of folded portion, support elements are placed on terminal portion of the upper fabric layer adjacent to a side of folded portion. Rungs are inserted into corresponding support elements, whereupon the exposed flattened end portion of each rung is passed through the corresponding aperture punched in the side of folded portion and then through the corresponding aperture punched in the side of folded portion, so that it may be received in the previously positioned support element. The two complementary support elements of a pair are then pushed transversely towards each other until the rung interposed therebetween is frictionally engaged to the two support elements. Following the formation of the two rows, respectively, of support elements, the terminal portions are folded to form sides of folded portion, such that each support element is retained by two walls of a folded portion. Planar bottom fabric layer having a length substantially equal to the distance between terminal portions, is placed on the underside of upper fabric layer, covering rows support elements. Bottom fabric layer is attached to upper fabric layer by one-sided stitching, gluing, ultrasonic welding or bonding, whereby the assembled frame is rigid and stable, due to tensile force applied by the fabric layers onto the rectangular elements, support elements, and end elements. The frame is then stitched to the first side of the strap.

In some embodiments of the present invention, the rungs are produced from single-sided molded plastic, which is applied by injection molding directly onto a first side. Each piece of molded plastic is formed with two posts protruding from the first side, and the rung is extending between the two posts; and a circular positioning member may adhere to the first side and adjoins a corresponding post. The rung is considerably thinner than the two corresponding posts, so that the bottom edge of the rung is separated from the adjacent surface of the first side of the strap or from the bottom of the positioning members by a sufficient distance which facilitates the engagement of the hook, as well as to fasten the hook to the rung while engaged. Fastening capability may be provided, for example, by forming suitable geometric contours in the hook and/or in the rung. The positioning members are adapted to properly align each plastic piece such that the plurality of rungs are transversely disposed and in an essentially mutually parallel and equally spaced relation. The two positioning members between which a corresponding rung is interposed have a considerably greater width and a considerably shorter transversal dimension than that of the corresponding rung. The structural strength of a fastener employing such positioning members is therefore increased due to the wide-area adhesion, thereby preventing detachment of the plastic piece from first side during repeated engagement and disengagement operations of the hook with respect to a selected rung. As positioning elements are attached directly to the first side of the strap without use of support elements or mating elements, a frame is therefore unnecessary.

In some embodiments of the present invention, a single-sided molded plastic piece may be configured in any desired shape or form. The plastic piece may be provided with a base which is considerably wider than the rung or positioning members, so as to improve the adhesion of the plastic piece to first piece. The bottom of each rung is spaced from the base by a sufficient distance for facilitating the engagement of the hook. During engagement of the hook, the hook slides over the selected rung towards the corresponding base and is then released, to engage the selected rung by a backward motion.

In some embodiments of the present invention, each plastic piece is produced from single or double-sided molded plastic wherein plastic is injected on the bottom face of fabric in order to fuse with the rung injected on the opposite side thereof. Since the plastic piece is provided with increased structural integrity after being produced from double-sided molded plastic, its rung may be longer and its covering members (used for aesthetic and/or improved adhesion purposes) may be thinner than those of the plastic piece, which are produced from single-sided plastic. In order to cover the portion of the plastic piece which is positioned on the bottom face of the fabric, the first side of the strap may have a double width. After the plastic pieces are attached to the first side, the first side may be folded as shown, producing upper and lower pieces of fabric, which are subsequently stitched together. The first side may be punched with a plurality of holes, to increase the fusibility of a plastic portion positioned on the bottom face of first side and the corresponding positioning member positioned on the opposite thereof.

In some embodiments of the present invention, a plurality of mutually parallel and equally spaced metallic pins, e.g. of rectangular cross section as shown or of circular cross section, are placed on central portion of the first side, to serve as rungs. The two transverse ends of the first side are folded to form flaps. The Flaps are folded until they contact a pin, such that the pins are secured to flaps at corresponding attachment areas by ultrasonic welding when the fabric of the first side is synthetic, by stitching or by bonding.

In some embodiments of the present invention, the fastener serves to secure the bra about the waist of the wearer, and therefore may be called the circumferential or waist fastener; however, the structure may equally apply to shoulder straps, which serve to secure the bra to the shoulders of the wearer, and therefore may be called vertical or shoulder fasteners. The present invention comprises bras, as well as other garments, in which the waist fastener or the shoulder fasteners or both the waist fastener and the shoulder fasteners are structured as described herein.

In some embodiments of the present invention, a fastener for a brassiere comprises: (a) a strap having first and second sides; (b) a plurality of rungs spaced from one another along said strap and attached to said first side wherein each of said plurality of rungs is transversely disposed and in an essentially mutually parallel and equally longitudinally spaced relation; (c) at least one hook attached to said second side, said at least one hook being engageable with each of said rungs, the sensitiveness of the fastener being determined by the selected rung to be engaged by said at least hook, characterized in that each rung is produced from a piece of molded plastic which is injected directly onto the first side, wherein each of said pieces of plastic comprises a transversely disposed rung and two positioning members between which said rung is interposed having a considerably greater width and a considerably shorter transversal dimension than that of the corresponding rung, the bottom of said corresponding rung being spaced from the bottom of said two positioning members by a sufficient distance for facilitating the engagement of the at least one hook.

In some embodiments of the present invention, each positioning member is adhered to the first side. In some embodiments of the present invention, the piece of plastic further comprises a post adjoining each positioning member and a rung extending between said two posts, the bottom of the rung being spaced from the bottom edge of said posts by a sufficient distance for facilitating the engagement of the hook.

In some embodiments of the present invention, each piece of plastic further comprises a base which is adhered to the first side and is considerably wider than the corresponding rung or positioning members, the positioning members protruding from said base and the bottom of each rung being spaced from said base by a sufficient distance for facilitating the engagement of the hook. In some embodiments of the present invention, each piece of plastic is produced from single-sided molded plastic.

In some embodiments of the present invention, each piece of plastic is produced from double-sided molded plastic, a plastic portion injected onto the bottom face of the first side being fusible with the corresponding positioning member formed on the upper face thereof. In some embodiments of the present invention, the first side is double width fabric, said double width fabric being foldable so as to cover the plastic portions formed on the bottom face of the first side.

In some embodiments of the present invention, the fastener is a waist fastener for securing the brassiere to the waist of the wearer and wherein the rungs are spaced from one another in the longitudinal direction. In some embodiments of the present invention, the fastener is a shoulder fastener for securing the brassiere to a shoulder of the wearer and wherein the rungs are spaced from one another in the vertical direction.

In some embodiments of the present invention, the fastener comprises a single hook member or a single male member.

In some embodiments of the present invention, the fastener comprises a plurality of hooks forming one or more rows on the second side of the brassiere strap, in each of which rows the hooks are aligned or substantially aligned along a transverse line.

In some embodiments of the present invention, a bra fastener comprises: (a) a strap having first and second sides; (b) a plurality of rungs spaced from one another along said strap and attached to said first side wherein each of said plurality of rungs is transversely disposed and in an essentially mutually parallel and equally longitudinally spaced relation; (c) at least one hook attached to said second side, said at least one hook being engageable with each of said rungs, the sensitiveness of the fastener being determined by the selected rung to be engaged by said at least hook; (d) a frame connected to said plurality of rungs and attached to said first side, characterized in that said frame comprises: (e) at least two rows of support elements, a rung being frictionally engaged to a pair of opposed support elements; and (f) two end elements between which each row of support elements is interposed, wherein at least one fabric layer is stitched in such a way so as to apply a tensile force onto the support elements and/or end elements, suitable areas of one of said fabric layers being punched so as to accommodate said plurality of rungs.

In some embodiments of the present invention, upper and bottom fabric layers apply a tensile force onto the support elements and/or end elements. In some embodiments of the present invention, the bottom fabric layer is planar and the upper fabric layer is of a variable shape. In some embodiments of the present invention, the upper fabric layer is folded in such a way that each row of support elements is seated within a different folded portion thereof.

In some embodiments of the present invention, each end element has a cross-section in the shape of a right trapezoid. In some embodiments of the present invention, the upper surface of said support elements and end elements are substantially coplanar, and the bottom surface of said support elements and end elements are substantially coplanar. In some embodiments of the present invention, each support element is formed with an aperture, a rung being frictionally engaged to the aperture formed in each of the opposed support elements.

In some embodiments of the present invention, the rung is tubular and has two flattened end portions. In some embodiments of the present invention, the spacing between successive rungs ranges between 0.3 and 1.5 cm. In some embodiments of the present invention, the spacing between successive rungs ranges between 0.4 and 0.7 cm. In some embodiments of the present invention, the fastener comprises at least three rungs; or at least four rungs; or at least five rungs; or between 3 and 9 rungs.

In some embodiments of the present invention, the rungs are made of plastic or metal. In some embodiments of the present invention, the frame is attached to the first side by means chosen from the group consisting of insert, over molding, welding, sewing, riveting and adhesive connection. In some embodiments of the present invention, the frame is made of flexible material. In some embodiments of the present invention, the at least one hook is made of plastic or metal.

In some embodiments of the present invention, a bra comprises a fastener which comprises: (a) a strap having first and second sides; (b) a plurality of rungs spaced from one another along said strap and attached to said first side wherein each of said plurality of rungs is transversely disposed and in an essentially mutually parallel and equally longitudinally spaced relation; (c) at least one hook attached to said second side, said at least one hook being engageable with each of said rungs, the sensitiveness of the fastener being determined by the selected rung to be engaged by said at least hook, characterized in that the rungs are attached to flaps folded along the transverse ends of the first side. In some embodiments of the present invention, the rungs are attached to the flaps by means chosen from the group consisting of welding, sewing, stitching and adhesive connection. In some embodiments of the present invention, each rung is a metallic pin.

In some embodiments of the present invention, a method of assembling a fastener comprises: (a) providing a strap having first and second sides; (b) attaching a plurality of rungs to said first side such that each of said rungs is transversely disposed and in a mutually parallel and equally spaced relation; (c) attaching at least one hook to said second side, said at least one hook being engageable with each of said rungs which are spaced from the first side by a sufficient distance for facilitating the engagement of said at least one hook, the sensitiveness of the fastener being determined by the selected rung to be engaged by said at least one hook, characterized in that each rung is attached to the first side by forming a plastic piece having a rung and two positioning members between which said rung is interposed by injection molding which is applied directly to the first side, each of said two positioning members having a considerably greater width and a considerably shorter transversal dimension than that of the corresponding rung, the bottom of said corresponding rung being spaced from the bottom of said two positioning members by a sufficient distance for facilitating the engagement of the at least one hook.

In some embodiments of the present invention, the positioning members adhere to the first side. In some embodiments of the present invention, each piece of plastic is formed with two posts each of which adjoins a corresponding positioning member, a rung extending between said two posts, the bottom of said rung being spaced from the bottom edge of said posts by a sufficient distance for facilitating the engagement of the hook. In some embodiments of the present invention, each piece of plastic is formed with a base which is adhered to the first side and is considerably wider than the corresponding rung or positioning members, the positioning members protruding from said base and the bottom of each rung being spaced from said base by a sufficient distance for facilitating the engagement of the hook.

In some embodiments of the present invention, each piece of plastic is produced from single-sided molded plastic. In some embodiments of the present invention, each piece of plastic is produced from double-sided molded plastic, whereby a plastic portion is injected onto the bottom face of the first side and fuses with the corresponding positioning member formed on the upper face thereof. In some embodiments of the present invention, the first side is provided with double width fabric, whereby said double width fabric is folded and stitched so as to cover the plastic portions injected onto the bottom face of the first side. In some embodiments of the present invention, the positioning members of each plastic piece are aligned.

In some embodiments of the present invention, a method of assembling a fastener comprises: (a) providing a strap having first and second sides; (b) attaching a plurality of rungs to said first side such that each of said rungs is transversely disposed and in a mutually parallel and equally spaced relation; (c) attaching at least one hook to said second side, said at least one hook being engageable with each of said rungs which are spaced from the first side by a sufficient distance for facilitating the engagement of said at least one hook, the sensitiveness of the fastener being determined by the selected rung to be engaged by said at least one hook, characterized in that the plurality of rungs are attached to a frame and said frame is attached to the first side, said frame being assembled by: (d) punching suitable areas of at least one fabric layer for accommodating a plurality of rungs; (e) placing first and second rows of support elements on said at least one fabric layer such that each pair of adjacent support elements from one of said rows is equidistantly spaced; (f) wrapping said at least one fabric layer around said first and second rows of support elements; g) inserting each of a plurality of rungs through two corresponding holes punched in said fabric layer; h) connecting each of a plurality of rungs to a support element from said first row and to a corresponding support element from said second row; i) pushing each support element from said first row and the corresponding support element from said second row towards each other until the rung interposed therebetween is frictionally engaged to said pushed support elements; and j) stitching said at least one fabric layer in such a way so as to apply a tensile force onto said first and second rows, a rung being secured by a pair of opposed support elements.

In some embodiments of the present invention, the method comprises: placing an end element at each end of said first and second rows; and stitching said at least one fabric layer in such a way so as to apply a tensile force additionally onto each of said end elements. In some embodiments of the present invention, a rung is connected to a support element by inserting a flattened end portion of a rung into an aperture formed in the support element. In some embodiments of the present invention, the at least one fabric layer is a one-piece fabric layer. In some embodiments of the present invention, the frame is assembled by means of a planar bottom fabric layer and an upper fabric layer of a variable shape.

In some embodiments of the present invention, the upper fabric layer is folded in such a way that each row of support elements is seated within a different folded portion thereof. In some embodiments of the present invention, the upper fabric layer is made of a polyester mesh which. retains its shape after being folded. In some embodiments of the present invention, each folded portion is folded to form two sides and a base.

In some embodiments of the present invention, the frame is assembled by: (a) forming substantially identical first and second folded portions; (b) punching holes in a second side of said first folded portion and in a first side of said second folded portion; (c) placing the first row of support elements on the base of said first folded portion such that each aperture of a support element is adjacent to a corresponding hole punched in the second side of said first folded portion; (d) passing an end portion of a rung through a corresponding hole punched in the first side of said second folded portion and through a corresponding hole punched in the second side of said first folded portion; (e) frictionally engaging said end portion with the aperture of the corresponding support element; (f) placing the second row of support elements on the base of said second folded portion such that each aperture of a support element is adjacent to a corresponding hole punched in the first side of said second folded portion; (g) frictionally engaging the other end portion of said rung with the corresponding support element placed on the base of said second folded portion; and (h) attaching the bottom fabric layer to the top fabric layer in such a way so as to apply a tensile force onto the support elements and end elements.

In some embodiments of the present invention, the bottom fabric layer is attached to the top fabric layer by means chosen from the group consisting of one-sided stitching, ultrasonic welding, and adhesive connection. In some embodiments of the present invention, the frame is attached to the first side by means chosen from the group consisting of insert, over molding, welding, sewing, riveting and adhesive connection.

In some embodiments of the present invention, a method of assembling a fastener comprises: (a) providing a strap having first and second sides; (b) attaching a plurality of rungs to said first side such that each of said rungs is transversely disposed and in a mutually parallel and equally spaced relation; (c) attaching at least one hook to said second side, said at least one hook being engageable with each of said rungs which are spaced from the first side by a sufficient distance for facilitating the engagement of said at least one hook, the sensitiveness of the fastener being determined by the selected rung to be engaged by said at least one hook, characterized in that each rung is a pin, the method further comprising: (d) placing the rungs on a central portion of the first side; (e) folding the transverse ends of the first side to form two flaps; and (f) attaching said rungs to said flaps. In some embodiments of the present invention, the rungs are attached to the flaps by from the group consisting of welding, sewing, stitching and adhesive connection. In some embodiments of the present invention, each rung is a metallic pin.

Some or all of the operations of such method(s) or process(es) may be performed automatically or partially-automatically or semi-automatically, by a suitable machine or production line or manufacturing line; which may comprise, for example, robotic arms, automated knitting machine or sewing machine, machine-controllable clothes-making machine or device, and/or other modules or units. Optionally, a computerized platform or a computer may be used, to control and/or manage the production of one or more components or of the entire product, the fastener and/or the bra. In some implementations, such computer or computing device may comprise, for example, a processor, a logic circuit, an integrated circuit, an input unit (keyboard, mouse, stylus), an output unit (e.g., screen or monitor), memory unit, storage unit, wireless communication modules, wired communication modules, power source, operating system, drivers, applications, and/or other suitable hardware components and/or software modules.

The present invention may comprise, or may be used in conjunction with, any other suitable garment or clothing article, having similar or identical properties to the features descried herein; for example, a bra, a sports bra, a brassier, a lingerie item, a shirt, a blouse, a jacket, a pullover, a sweatshirt, a vest, a dress, pants, leggings, underwear, underpants, thongs, boxers, boxer shorts, short pants, long pants, swimsuit, single-part swimsuit, two-part swimsuit, bikini swimsuit, sports clothes, training clothes, elastic material clothes, form-fitting clothes, supporting clothes, shaper, shaper garment, shaper article of clothing, girdle, body-shaping garment, gloves, belts, a maternity belt, a maternity accessory, a maternity shirt or blouse or garment, a support garment, shoes, sneakers, sports shoes, sports garments, sports clothes, work garments, uniforms, and/or any other suitable article of clothing which may utilize such fastener or open-close mechanism to attach/detach mechanism. All such other types of clothing articles, or garments, as well as other suitable articles of clothing, may be produced and utilized in accordance with the present invention; and are included in various embodiments of the present invention.

In accordance with the present invention, a bra comprises: two cups located at a front-side of the bra; a fastener located at a back-side of the bra; wherein the back-side of the bra has a first region and a second region; wherein the fastener enables (A) attachment of the first region to the second region, and (B) detachment of the first region from the second region; wherein the fastener comprises: (I) a male member located in the first region of the back-side of the bra, and (II) a female member located in said second region of the back-side of the bra; wherein the male member comprises a single hook; wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra; wherein each bridge covers at least 51 percent of a north-to-south width of the second region of the back-side of the bra; wherein an engaging tip of said single hook of the male member covers at least 51 percent of the north-to-south width of the first region of the back-side of the bra; wherein an edge of the first region and an edge of the second region, which are generally parallel to each other, are held together via said single hook which engages with one of said bridges; and wherein said fastener does not include two or more hooks that engage with two or more respective eyes.

In some embodiments, said male member comprises a rigid frame in which said multiple spaced-apart bridges are located; wherein said rigid frame does not protrude relative to a fabric of said second-region of the back-side of the bra.

In some embodiments, said male member comprises a rigid frame in which said multiple spaced-apart bridges are located; wherein said rigid frame is at a same level as, and does not protrude relative to, a fabric of said second-region of the back-side of the bra.

In some embodiments, said male member comprises a flexible frame in which said multiple spaced-apart bridges are located; wherein said flexible frame does not protrude relative to a fabric of said second-region of the back-side of the bra.

In some embodiments, said male member comprises a flexible frame in which said multiple spaced-apart bridges are located; wherein said flexible frame is at a same level as, and does not protrude relative to, a fabric of said second-region of the back-side of the bra.

In some embodiments, said male member comprises a rigid-flex frame in which said multiple spaced-apart bridges are located; wherein said rigid-flex frame does not protrude relative to a fabric of said second-region of the back-side of the bra.

In some embodiments, said male member comprises a rigid-flex frame in which said multiple spaced-apart bridges are located; wherein said rigid-flex frame is at a same level as, and does not protrude relative to, a fabric of said second-region of the back-side of the bra.

In some embodiments, the single hook of the male member is a generally mushroom-shaped hook member, comprising: a mushroom base portion having a first average width; a mushroom neck portion having a second average width; a mushroom top portion having a third average width; wherein the mushroom neck portion is located between the mushroom base portion and the mushroom top portion; wherein the second average width of the mushroom neck portion, is smaller than the first average width of the mushroom base portion; wherein the second average width of the mushroom neck portion, is smaller than the third average width of the mushroom top portion. In some embodiments, the mushroom top portion comprises two trapezoid portions having a common trapezoid-base edge. In some embodiments, the mushroom top portion ends with a non-flat tip which is curved outwardly. In some embodiments, the mushroom top portion ends with a non-flat tip which is generally trapezoid-shaped.

In some embodiments, the single hook of the male member is a generally mushroom-shaped hook member, comprising: a mushroom base portion having a first average width; a mushroom neck portion having a second average width; a mushroom top portion having a third average width; wherein the mushroom neck portion is located between the mushroom base portion and the mushroom top portion; wherein the second average width of the mushroom neck portion, is smaller than the first average width of the mushroom base portion; wherein the second average width of the mushroom neck portion, is smaller than the third average width of the mushroom top portion; wherein the third average width of the mushroom top portion, is smaller than the first average width of the mushroom base portion. In some embodiments, the mushroom top portion comprises two trapezoid portions having a common trapezoid-base edge. In some embodiments, the mushroom top portion ends with a non-flat tip which is curved outwardly. In some embodiments, the mushroom top portion ends with a non-flat tip which is generally trapezoid-shaped.

In some embodiments, exactly one particular bridge, out of said multiple spaced-apart bridges, has a protruding bridge height which is greater than a common bridge height that is common to all other bridges.

In some embodiments, exactly one particular bridge, out of said multiple spaced-apart bridges, has a protruding bridge height which is smaller than a common bridge height that is common to all other bridges.

In some embodiments, exactly one particular bridge, out of said multiple spaced-apart bridges, has a bridge length which is greater than a common bridge length that is common to all other bridges.

In some embodiments, exactly one particular bridge, out of said multiple spaced-apart bridges, has a bridge length which is smaller than a common bridge length that is common to all other bridges.

In some embodiments, exactly one particular bridge, out of said multiple spaced-apart bridges, has a bridge shape which is different than a common bridge shape that is common to all other bridges.

In some embodiments, exactly one particular bridge, out of said multiple spaced-apart bridges, has a bridge shape which is curved and non-pointy, wherein all other bridges have non-curved and pointy shape.

In some embodiments, exactly one particular bridge, out of said multiple spaced-apart bridges, has a bridge shape which is pointy and non-curved, wherein all other bridges have curved and non-pointy shape.

In some embodiments, exactly one particular bridge, out of said multiple spaced-apart bridges, has is form of a first material; wherein all other bridges are formed of a second, different, material.

In some embodiments, exactly one particular bridge, out of said multiple spaced-apart bridges, has a first texture; wherein all other bridges have a second, different, texture.

In some embodiments, exactly one particular bridge, out of said multiple spaced-apart bridges, has a bridge thickness which is greater than a common bridge thickness that is common to all other bridges.

In some embodiments, exactly one particular bridge, out of said multiple spaced-apart bridges, has a bridge thickness which is smaller than a common bridge thickness that is common to all other bridges.

In some embodiments, all of said bridges are equally spaced apart.

In some embodiments, said bridges are non-equally spaced apart.

In some embodiments, (A) a distance between a first bridge and a second bridge of said bridges, is different from (B) a distance between the second bridge and a third bridge of said bridges.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted relative to the buffer rod, and (B) is slanted relative to the plane on which fabric of said first-region is located.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted outwardly and protrudingly relative to the buffer rod, and (B) is slanted outwardly and protrudingly relative to the plane on which fabric of said first-region is located.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted inwardly relative to the buffer rod, and (B) is slanted inwardly relative to the plane on which fabric of said first-region is located.

In some embodiments, the female member comprises: a first fabric layer intended to touch a back of a wearer of the bra; a second fabric layer intended not to touch the back of the wearer, and intended to face outwardly relative to the back of the wearer; an intermediate layer that is sandwiched between the first fabric layer and the second fabric layer; wherein each one of said bridges is held in place by said intermediate layer.

In some embodiments, the female member comprises: a first fabric layer intended to touch a back of a wearer of the bra; a second fabric layer intended not to touch the back of the wearer, and intended to face outwardly relative to the back of the wearer; an intermediate layer that is sandwiched between the first fabric layer and the second fabric layer; wherein each one of said bridges is held in place by said intermediate layer; wherein each one of said bridges has two bases, (A) which are internal to said intermediate layer, and (B) which are not visible to a wearer of said bra, and (C) which are held in place by said intermediate layer, and (D) which are non-exposed to direct touching by the wearer of the bra. In some embodiments, the first fabric layer, and the second fabric layer, and the intermediate layer, are held together by stitches and/or by glue and/or by one or more ultrasonic welding structures.

In some embodiments, the female member comprises: a first fabric layer intended to touch a back of a wearer of the bra; a second fabric layer intended not to touch the back of the wearer, and intended to face outwardly relative to the back of the wearer; an intermediate non-fabric layer that is sandwiched between the first fabric layer and the second fabric layer; wherein each one of said bridges is held in place by said intermediate non-fabric layer.

In some embodiments, the female member comprises: a first fabric layer intended to touch a back of a wearer of the bra; a second fabric layer intended not to touch the back of the wearer, and intended to face outwardly relative to the back of the wearer; an intermediate non-fabric layer that is sandwiched between the first fabric layer and the second fabric layer; wherein each one of said bridges is held in place by said intermediate non-fabric layer; wherein each one of said bridges has two bases, (A) which are internal to said intermediate non-fabric layer, and (B) which are not visible to a wearer of said bra, and (C) which are held in place by said intermediate non-fabric layer, and (D) which are non-exposed to direct touching by the wearer of the bra. In some embodiments, the first fabric layer, and the second fabric layer, and the intermediate non-fabric layer, are held together by stitches and/or by glue and/or by one or more ultrasonic welding structures.

In some embodiments, the female member comprises: a first fabric layer intended to touch a back of a wearer of the bra; a second fabric layer intended not to touch the back of the wearer, and intended to face outwardly relative to the back of the wearer; an intermediate sponge layer that is sandwiched between the first fabric layer and the second fabric layer; wherein each one of said bridges is held in place by said intermediate sponge layer.

In some embodiments, the female member comprises: a first fabric layer intended to touch a back of a wearer of the bra; a second fabric layer intended not to touch the back of the wearer, and intended to face outwardly relative to the back of the wearer; an intermediate sponge layer that is sandwiched between the first fabric layer and the second fabric layer; wherein each one of said bridges is held in place by said intermediate sponge layer; wherein each one of said bridges has two bases, (A) which are internal to said intermediate sponge layer, and (B) which are not visible to a wearer of said bra, and (C) which are held in place by said intermediate sponge layer, and (D) which are non-exposed to direct touching by the wearer of the bra. In some embodiments, the first fabric layer, and the second fabric layer, and the intermediate sponge layer, are held together by stitches and/or by glue and/or by one or more ultrasonic welding structures.

In some embodiments, the male member does not extend and does not protrude beyond a fabric edge of said first-region of the back-side of the bra.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region; wherein a bridge-engaging portion of said mushroom-shaped hook, (A) is non-parallel to a fabric plane of said first-region, and (B) is slanted outwardly relative to said fabric plane of said first-region.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region; wherein a bridge-engaging portion of said mushroom-shaped hook, (A) is non-parallel to a fabric plane of said first-region, and (B) is slanted inwardly relative to said fabric plane of said first-region.

In some embodiments, the male member does not extend and does not protrude beyond a fabric edge of said first-region of the back-side of the bra; wherein the male member comprises two trapezoid-shaped portions that have a common trapezoid base.

In some embodiments, the male member does not extend and does not protrude beyond a fabric edge of said first-region of the back-side of the bra; wherein the male member comprises a generally mushroom-shaped hook having three trapezoid-shaped portions, comprising a first trapezoid touching a second trapezoid touch a third trapezoid; wherein the first trapezoid shares a common base with the second trapezoid; wherein the second trapezoid shares another common base with the third trapezoid.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is greater than a distance between two spaced-apart bridges of the female member.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is smaller than a distance between two spaced-apart bridges of the female member.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is equal to a distance between two spaced-apart bridges of the female member.

In some embodiments, the male member does not extend and does not protrude beyond a fabric edge of said first-region of the back-side of the bra; wherein the male member comprises a generally mushroom-shaped hook, which is separated by a buffer rod from an edge of said first-region that faces said second region; and (A) a distance between (i) the edge of the first-region that faces the second region, and (ii) a mushroom-top edge of said mushroom-shaped hook, is greater than (B) a distance between two spaced-apart bridges of the female member.

In some embodiments, the fastener comprises an audible snapping mechanism, wherein secure engagement of the male member and the female member generates an audible click sound to convey to the wearer that the fastener is securely engaged. Optionally, the audible snapping may be implemented by constructing the male member (e.g., the single wide hook) as having a narrower portion (e.g., a portion of the hook which is closer to the underlying fabric), such that the narrower portion causes generation of an audible click or sound upon secure engagement with a female member or bridge or rung. In some embodiments, optionally, a snapping mechanism may be used such that the opening or curve of the hook is slightly smaller that the thickness of the corresponding female bridge or rung, such that slight force may be applied by the user in order to engage them, thereby producing a click sound or other audible indication of secure engagement of the fastener. In other embodiments, one or more portions of the male member and/or the female member(s) may be formed of metal, or of other materials which produces a click sound or a desired sound effect upon meeting with another item (e.g., a distinctive sound of a first metal portion hitting or meeting another metal portion). In other embodiments, the slanting of a portion of the male member, may be configured to generate an audible sound only upon secure engagement with the female member or bridge. Other suitable mechanisms may be used to generate a clicking sound or other audible indication for secure engagement or proper engagement of the fastener.

In some embodiments, a brassiere comprises: a right-cup and a left-cup located at a front-side of the brassiere; a front-side fastener located at a front-side of the bra, between the right-cup and the left-cup; wherein the front-side fastener enables (A) attachment of the right-cup to the left-cup, and (B) detachment of the right-cup from the left-cup; wherein the fastener comprises: (I) a male member that is attached to a first cup selected from the right-cup and the left-cup, and (II) a female member that is attached to a second, different, cup selected from the right-cup and the left cup; wherein the male member comprises a single hook; wherein the female member comprises a set of multiple spaced-apart bridges, each bridge protruding outwardly and generally-perpendicularly relative to a longest dimension of the female member; wherein each bridge is generally perpendicular to a longest dimension of the front-side fastener; wherein each bridge covers at least 51 percent of a north-to-south width of the front-side fastener of the bra; wherein an engaging tip of said single hook of the male member covers at least 51 percent of the north-to-south width of the female member; wherein the right-cup and the left-cup are held together via said single hook which engages with one of said bridges; and wherein said fastener does not include two or more hooks that engage with two or more respective eyes.

In some embodiments, a bra comprises: two cups located at a front-side of the bra; a fastener located at a back-side of the bra; wherein the back-side of the bra has a first region and a second region; wherein the fastener enables (A) attachment of the first region to the second region, and (B) detachment of the first region from the second region; wherein the fastener comprises: (I) a male member located in the first region of the back-side of the bra, and (II) a female member located in said second region of the back-side of the bra; wherein the male member comprises a single hook; wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra; wherein each bridge covers at least 51 percent of a north-to-south width of the second region of the back-side of the bra; wherein an engaging tip of said single hook of the male member covers at least 51 percent of the north-to-south width of the first region of the back-side of the bra; wherein an edge of the first region and an edge of the second region, which are generally parallel to each other, are held together via said single hook which engages with one of said bridges; and wherein said fastener does not include two or more hooks that engage with two or more respective eyes.

In some embodiments, said male member comprises a rigid frame in which said multiple spaced-apart bridges are located; wherein said rigid frame does not protrude relative to a fabric of said second-region of the back-side of the bra.

In some embodiments, said male member comprises a rigid frame in which said multiple spaced-apart bridges are located; wherein said rigid frame is at a same level as, and does not protrude relative to, a fabric of said second-region of the back-side of the bra.

In some embodiments, said male member comprises a flexible frame in which said multiple spaced-apart bridges are located; wherein said flexible frame does not protrude relative to a fabric of said second-region of the back-side of the bra.

In some embodiments, said male member comprises a flexible frame in which said multiple spaced-apart bridges are located; wherein said flexible frame is at a same level as, and does not protrude relative to, a fabric of said second-region of the back-side of the bra.

In some embodiments, said male member comprises a rigid-flex frame in which said multiple spaced-apart bridges are located; wherein said rigid-flex frame does not protrude relative to a fabric of said second-region of the back-side of the bra.

In some embodiments, said male member comprises a rigid-flex frame in which said multiple spaced-apart bridges are located; wherein said rigid-flex frame is at a same level as, and does not protrude relative to, a fabric of said second-region of the back-side of the bra.

In some embodiments, the single hook of the male member is a generally mushroom-shaped hook member, comprising: a mushroom base portion having a first average width; a mushroom neck portion having a second average width; a mushroom top portion having a third average width; wherein the mushroom neck portion is located between the mushroom base portion and the mushroom top portion; wherein the second average width of the mushroom neck portion, is smaller than the first average width of the mushroom base portion; wherein the second average width of the mushroom neck portion, is smaller than the third average width of the mushroom top portion. In some embodiments, the mushroom top portion comprises two trapezoid portions having a common trapezoid-base edge. In some embodiments, the mushroom top portion ends with a non-flat tip which is curved outwardly. In some embodiments, the mushroom top portion ends with a non-flat tip which is generally trapezoid-shaped.

In some embodiments, the single hook of the male member is a generally mushroom-shaped hook member, comprising: a mushroom base portion having a first average width; a mushroom neck portion having a second average width; a mushroom top portion having a third average width; wherein the mushroom neck portion is located between the mushroom base portion and the mushroom top portion; wherein the second average width of the mushroom neck portion, is smaller than the first average width of the mushroom base portion; wherein the second average width of the mushroom neck portion, is smaller than the third average width of the mushroom top portion; wherein the third average width of the mushroom top portion, is smaller than the first average width of the mushroom base portion. In some embodiments, the mushroom top portion comprises two trapezoid portions having a common trapezoid-base edge. In some embodiments, the mushroom top portion ends with a non-flat tip which is curved outwardly. In some embodiments, the mushroom top portion ends with a non-flat tip which is generally trapezoid-shaped.

In some embodiments, exactly one particular bridge, out of said multiple spaced-apart bridges, has a protruding bridge height which is greater than a common bridge height that is common to all other bridges. In some embodiments, exactly one particular bridge, out of said multiple spaced-apart bridges, has a protruding bridge height which is smaller than a common bridge height that is common to all other bridges. In some embodiments, exactly one particular bridge, out of said multiple spaced-apart bridges, has a bridge length which is greater than a common bridge length that is common to all other bridges. In some embodiments, exactly one particular bridge, out of said multiple spaced-apart bridges, has a bridge length which is smaller than a common bridge length that is common to all other bridges. In some embodiments, exactly one particular bridge, out of said multiple spaced-apart bridges, has a bridge shape which is different than a common bridge shape that is common to all other bridges.

In some embodiments, exactly one particular bridge, out of said multiple spaced-apart bridges, has a bridge shape which is curved and non-pointy, wherein all other bridges have non-curved and pointy shape. In some embodiments, exactly one particular bridge, out of said multiple spaced-apart bridges, has a bridge shape which is pointy and non-curved, wherein all other bridges have curved and non-pointy shape. In some embodiments, exactly one particular bridge, out of said multiple spaced-apart bridges, has is form of a first material; wherein all other bridges are formed of a second, different, material. In some embodiments, exactly one particular bridge, out of said multiple spaced-apart bridges, has a first texture; wherein all other bridges have a second, different, texture. In some embodiments, exactly one particular bridge, out of said multiple spaced-apart bridges, has a bridge thickness which is greater than a common bridge thickness that is common to all other bridges. In some embodiments, exactly one particular bridge, out of said multiple spaced-apart bridges, has a bridge thickness which is smaller than a common bridge thickness that is common to all other bridges.

In some embodiments, all of said bridges are equally spaced apart.

In some embodiments, said bridges are non-equally spaced apart.

In some embodiments, (A) a distance between a first bridge and a second bridge of said bridges, is different from (B) a distance between the second bridge and a third bridge of said bridges.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted relative to the buffer rod, and (B) is slanted relative to the plane on which fabric of said first-region is located.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted outwardly and protrudingly relative to the buffer rod, and (B) is slanted outwardly and protrudingly relative to the plane on which fabric of said first-region is located.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted inwardly relative to the buffer rod, and (B) is slanted inwardly relative to the plane on which fabric of said first-region is located.

In some embodiments, the female member comprises: a first fabric layer intended to touch a back of a wearer of the bra; a second fabric layer intended not to touch the back of the wearer, and intended to face outwardly relative to the back of the wearer; an intermediate layer that is sandwiched between the first fabric layer and the second fabric layer; wherein each one of said bridges is held in place by said intermediate layer.

In some embodiments, the female member comprises: a first fabric layer intended to touch a back of a wearer of the bra; a second fabric layer intended not to touch the back of the wearer, and intended to face outwardly relative to the back of the wearer; an intermediate layer that is sandwiched between the first fabric layer and the second fabric layer; wherein each one of said bridges is held in place by said intermediate layer; wherein each one of said bridges has two bases, (A) which are internal to said intermediate layer, and (B) which are not visible to a wearer of said bra, and (C) which are held in place by said intermediate layer, and (D) which are non-exposed to direct touching by the wearer of the bra.

In some embodiments, the first fabric layer, and the second fabric layer, and the intermediate layer, are held together by stitches and/or by and/or by one or more ultrasonic welding structures or elements.

In some embodiments, the female member comprises: a first fabric layer intended to touch a back of a wearer of the bra; a second fabric layer intended not to touch the back of the wearer, and intended to face outwardly relative to the back of the wearer; an intermediate non-fabric layer that is sandwiched between the first fabric layer and the second fabric layer; wherein each one of said bridges is held in place by said intermediate non-fabric layer.

In some embodiments, the female member comprises: a first fabric layer intended to touch a back of a wearer of the bra; a second fabric layer intended not to touch the back of the wearer, and intended to face outwardly relative to the back of the wearer; an intermediate non-fabric layer that is sandwiched between the first fabric layer and the second fabric layer; wherein each one of said bridges is held in place by said intermediate non-fabric layer; wherein each one of said bridges has two bases, (A) which are internal to said intermediate non-fabric layer, and (B) which are not visible to a wearer of said bra, and (C) which are held in place by said intermediate non-fabric layer, and (D) which are non-exposed to direct touching by the wearer of the bra. In some embodiments, the first fabric layer, and the second fabric layer, and the intermediate non-fabric layer, are held together by stitches and/or by glue and/or by one or more ultrasonic welding structures.

In some embodiments, the female member comprises: a first fabric layer intended to touch a back of a wearer of the bra; a second fabric layer intended not to touch the back of the wearer, and intended to face outwardly relative to the back of the wearer; an intermediate sponge layer that is sandwiched between the first fabric layer and the second fabric layer; wherein each one of said bridges is held in place by said intermediate sponge layer.

In some embodiments, the female member comprises: a first fabric layer intended to touch a back of a wearer of the bra; a second fabric layer intended not to touch the back of the wearer, and intended to face outwardly relative to the back of the wearer; an intermediate sponge layer that is sandwiched between the first fabric layer and the second fabric layer; wherein each one of said bridges is held in place by said intermediate sponge layer; wherein each one of said bridges has two bases, (A) which are internal to said intermediate sponge layer, and (B) which are not visible to a wearer of said bra, and (C) which are held in place by said intermediate sponge layer, and (D) which are non-exposed to direct touching by the wearer of the bra. In some embodiments, the first fabric layer, and the second fabric layer, and the intermediate sponge layer, are held together by stitches and/or by glue and/or by one or more ultrasonic welding structures.

In some embodiments, the male member does not extend and does not protrude beyond a fabric edge of said first-region of the back-side of the bra.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region; wherein a bridge-engaging portion of said mushroom-shaped hook, (A) is non-parallel to a fabric plane of said first-region, and (B) is slanted outwardly relative to said fabric plane of said first-region.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region; wherein a bridge-engaging portion of said mushroom-shaped hook, (A) is non-parallel to a fabric plane of said first-region, and (B) is slanted inwardly relative to said fabric plane of said first-region.

In some embodiments, the male member does not extend and does not protrude beyond a fabric edge of said first-region of the back-side of the bra; wherein the male member comprises two trapezoid-shaped portions that have a common trapezoid base.

In some embodiments, the male member does not extend and does not protrude beyond a fabric edge of said first-region of the back-side of the bra; wherein the male member comprises a generally mushroom-shaped hook having three trapezoid-shaped portions, comprising a first trapezoid touching a second trapezoid touch a third trapezoid; wherein the first trapezoid shares a common base with the second trapezoid; wherein the second trapezoid shares another common base with the third trapezoid.

In some embodiments, the male member does not extend and does not protrude beyond a fabric edge of said first-region of the back-side of the bra; wherein the male member comprises a generally mushroom-shaped hook; wherein a distance between a mushroom-base of said hook and a mushroom-top of said hook is greater than a distance between two spaced-apart bridges of the female member.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is smaller than a distance between two spaced-apart bridges of the female member.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is equal to a distance between two spaced-apart bridges of the female member.

In some embodiments, the male member does not extend and does not protrude beyond a fabric edge of said first-region of the back-side of the bra; wherein the male member comprises a generally mushroom-shaped hook, which is separated by a buffer rod from an edge of said first-region that faces said second region; In some embodiments, (A) a distance between (i) the edge of the first-region that faces the second region, and (ii) a mushroom-top edge of said mushroom-shaped hook, is greater than (B) a distance between two spaced-apart bridges of the female member.

In some embodiments, the fastener comprises an audible snapping mechanism, wherein secure engagement of the male member and the female member generates an audible click sound to convey to the wearer that the fastener is securely engaged.

In some embodiments, a brassiere comprises: a right-cup and a left-cup located at a front-side of the brassiere; a front-side fastener located at a front-side of the bra, between the right-cup and the left-cup; wherein the front-side fastener enables (A) attachment of the right-cup to the left-cup, and (B) detachment of the right-cup from the left-cup; wherein the fastener comprises: (I) a male member that is attached to a first cup selected from the right-cup and the left-cup, and (II) a female member that is attached to a second, different, cup selected from the right-cup and the left cup; wherein the male member comprises a single hook; wherein the female member comprises a set of multiple spaced-apart bridges, each bridge protruding outwardly and generally-perpendicularly relative to a longest dimension of the female member; wherein each bridge is generally perpendicular to a longest dimension of the front-side fastener; wherein each bridge covers at least 51 percent of a north-to-south width of the front-side fastener of the bra; wherein an engaging tip of said single hook of the male member covers at least 51 percent of the north-to-south width of the female member; wherein the right-cup and the left-cup are held together via said single hook which engages with one of said bridges; and wherein said fastener does not include two or more hooks that engage with two or more respective eyes.

In some embodiments, the female member may be formed of, or may comprise, bridge elements or rungs that are formed by injection molding of plastic material(s) onto or towards or into fabric. This may be in contrast to conventional fasteners, in which fastening elements were formed of metal, and were connected to fabric via sewing or knitting.

In some embodiments, the female member may comprise one or more internal layers of fabric (e.g., in addition to an external layer of fabric that touches the body of the human wearer, and/or in addition to an external layer of fabric that is facing away from the human body); such internal layer of fabric, which may be "sandwiched" or trapped within the female member of the fastener, may provide reinforcement and/or may strengthen the female member, without necessarily causing the female member to have a rigid or hard look-and-feel. This is in contrast with conventional fastener, in which a reinforcement element was made of metal, and/or was not internal within the fastener, such that conventional fasteners felt rigid and lacked the softness of fabric touch, or caused the body of the human wearer to be in touch with a metal part of the fastener.

In some embodiments, the female member may comprise therein a foam element or a sponge element, or a condensed sponge or condensed foam element, which may contribute to the reinforcement capability of the female member, and/or may make it more resilient or more rigid or less flexible, while also maintaining a generally-soft property or soft-to-the-touch property of the female fastener. Such internal foam or sponge element or layer, was lacking from conventional fasteners.

In some embodiments, the female member may comprise ultrasonic welded edges and/or ultrasonic welded corners and/or ultrasonic welded round-corners and/or ultrasonic welded contour-elements, at the outer contour or edges or corners of the female member, and/or at the internal-facing edges or corners or contours of the female member. In some embodiments, the outward-facing contour of the female member lacks or excludes any ultrasonic welded edges or corners or round-corners or contour-elements, and optionally, only the inwardly-facing portions of the female member may feature such ultrasonic welded elements; thereby ensuring that the outer or the outwardly-facing elements of the female member, or those female member portions that are in direct touch with the body of the wearer, are non-itchy and lack sharp corners and lack sharp edges and lack sharp contour-elements.

In some embodiments, the female member may comprise an external layer of fabric, such as Pique (and not nylon or tricot), which may contribute to the soft look-and-feel of the female member.

The Applicants have realized that in some embodiments of the present invention, the female member having exactly four bridges or rungs is an optimal or near-optimal number female member for some users, which enables the user to comfortably and efficiently close and open the fastener, optionally behind her back and/or without looking at the fastener; and that this particular number of bridges or rungs provides the right balance between (i) user ability to efficiently operate the fastener, and/or (ii) reduced complexity of the fastener, and/or (iii) increased ability of the user to remember which bridge or rung she had used or she typically uses for a particular fastener or bra or garment. Accordingly, a particular set of embodiments of the present invention comprises a female member having exactly four bridges or rungs.

The Applicants have realized that in some embodiments of the present invention, the female member having exactly three bridges or rungs is an optimal or near-optimal number female member for some users, which enables the user to comfortably and efficiently close and open the fastener, optionally behind her back and/or without looking at the fastener; and that this particular number of bridges or rungs provides the right balance between (i) user ability to efficiently operate the fastener, and/or (ii) reduced complexity of the fastener, and/or (iii) increased ability of the user to remember which bridge or rung she had used or she typically uses for a particular fastener or bra or garment. Accordingly, a particular set of embodiments of the present invention comprises a female member having exactly three bridges or rungs.

The Applicants have realized that in some embodiments of the present invention, the female member having exactly five bridges or rungs is an optimal or near-optimal number female member for some users, which enables the user to comfortably and efficiently close and open the fastener, optionally behind her back and/or without looking at the fastener; and that this particular number of bridges or rungs provides the right balance between (i) user ability to efficiently operate the fastener, and/or (ii) reduced complexity of the fastener, and/or (iii) increased ability of the user to remember which bridge or rung she had used or she typically uses for a particular fastener or bra or garment. Accordingly, a particular set of embodiments of the present invention comprises a female member having exactly five bridges or rungs.

The Applicants have realized that in some embodiments of the present invention, the female member having exactly two bridges or rungs is an optimal or near-optimal number female member for some users, which enables the user to comfortably and efficiently close and open the fastener, optionally behind her back and/or without looking at the fastener; and that this particular number of bridges or rungs provides the right balance between (i) user ability to efficiently operate the fastener, and/or (ii) reduced complexity of the fastener, and/or (iii) increased ability of the user to remember which bridge or rung she had used or she typically uses for a particular fastener or bra or garment. Accordingly, a particular set of embodiments of the present invention comprises a female member having exactly two bridges or rungs.

In some embodiments, the male member may comprise at least a portion that is non-parallel to the human body, but rather, is slightly slanted towards the human body, for example as demonstrated in FIG. 27C. In some embodiments, the entirety of the hook portion of the male member, may be slanted towards the human body. These two types of embodiments may increase the efficiency of operating the fastener, and/or may facilitate the closing of the fastener by a user, and/or may enable the male member to more easily catch into or hold into the female member.

In some embodiments, the male member may be formed as (or may be a part of) an internal cavity within the fastener, thereby reducing the overall thickness of the fastener, and thereby providing a fastener whose male member does not protrude outwardly beyond the general contour of the fastener or beyond the neighboring area(s) of the male member.

In some embodiments, the male member may comprise ultrasonic-welded fabric that covers (entirely, or at least partially) the male member, thereby hiding the male member (partially or entirely) from an observer that looks at the bra that is worn on a user. In some embodiments, the outward-facing layer or side of the male member, may be formed of fabric, or may comprise only fabric (e.g., and not metal, and not plastic), thereby maintaining a fabric look-and-feel of the external-side of the fastener (e.g., the side that is farthest from the human body when the bra is worn).

In some embodiments, the male member may comprise a protrusion or a raised dot or a raised rib, which (i) may cause increased friction for the purpose of opening and/or closing the fastener, and/or (ii) may assist in securing the male member in a secured manner within the female member, and may prevent accidental or undesired opening of the fastener, and/or (iii) may generate or produce an audible sound (e.g., "click" sound), when the fastener is closed (e.g., due to snapping or clicking of the male member into place), thereby providing an audible feedback to the wearer that the fastener was indeed securely closed.

Figure 30:
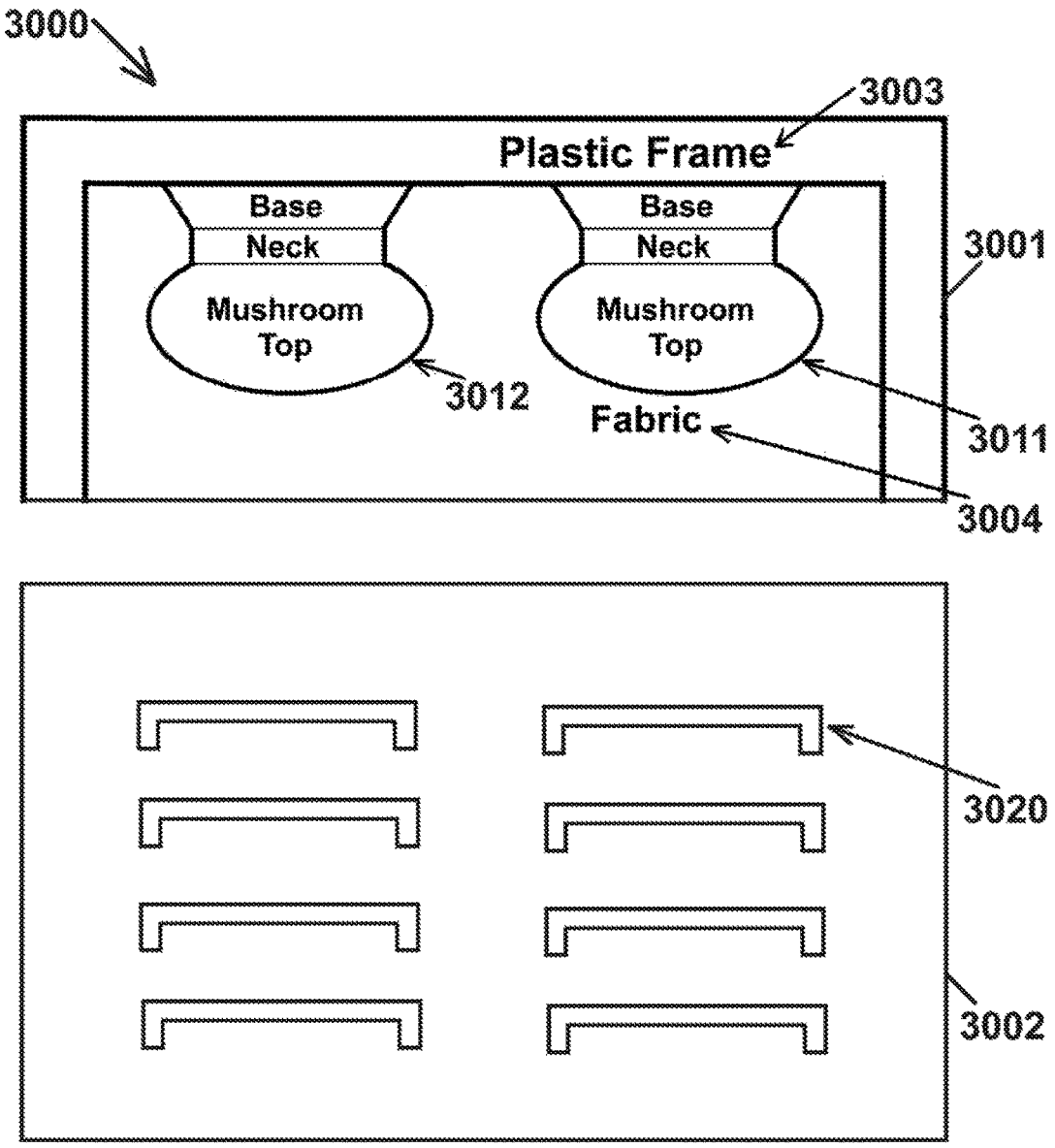
FIG. 30 is a schematic illustration of a fastener having a male member able to engage with a female member, in accordance with some embodiments of the present invention.

Reference is made to FIG. 30, which is a schematic illustration of a fastener 3000 (e.g., of a bra or other garment; located at the rear-side of the bra, or located at the front side of the bra) having a male member 3001 able to engage with a female member 3002, in accordance with some embodiments of the present invention. Fastener 3000 may comprise two generally-similar. generally mushroom-shaped, plastic hooks 3011 and 3012, covering on top of fabric 3004; such that each plastic hook (3011, 3012) has multiple regions (e.g., three regions: mushroom base region, mushroom neck region, mushroom top region); the two plastic hooks (3011, 3012) being connected to and integrated with a single plastic frame 3003 or other buffer zone or buffer rod(s). The female member 30002 may comprise multiple rungs 3020; for example, eight rungs 3020 are shown, arranged in two generally-parallel columns of four rungs in each column. Each one of the plastic hooks 3011-3012 of the male member 3001, is able to engage with one of the rungs 3020 located in one of the two respective columns of rungs 3020, thereby enabling the fastener to close and to open. The double-column structure of rungs 3020 may comprise other, even, number of rungs 3020; for example, two columns of 3+3 rungs, two columns of 5+5 rungs, or the like; thereby enabling the fastener 3000 to be utilized particularly with large-size or larger-size bra or garment, and providing additional support to such fastener 3000. For example, the utilization of two columns of rungs or two columns of bridges, or the utilization of three (or more) such columns of rungs or bridges, may enable enhanced support while maintaining the flexibility of the rungs or bridges, and/or may enable the fastener to be utilized with multiple such columns instead of using a single column or oversized rungs or oversized bridges. Other advantages may be achieved by utilizing two (or more) parallel columns of such rungs or bridges in the fastener.

In some embodiments, a bra comprises: two cups located at a front-side of the bra; a fastener located at a back-side of the bra; wherein the back-side of the bra has a first region and a second region; wherein the fastener enables (A) attachment of the first region to the second region, and (B) detachment of the first region from the second region; wherein the fastener comprises: (I) a male member located in the first region of the back-side of the bra, and (II) a female member located in said second region of the back-side of the bra; wherein the male member comprises a single hook; wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra; wherein each bridge covers at least 51 percent of a north-to-south width of the second region of the back-side of the bra; wherein an engaging tip of said single hook of the male member covers at least 51 percent of the north-to-south width of the first region of the back-side of the bra; wherein an edge of the first region and an edge of the second region, which are generally parallel to each other, are held together via said single hook which engages with one of said bridges; and wherein said fastener does not include two or more hooks that engage with two or more respective eyes.

In some embodiments, said female member comprises a rigid frame in which said multiple spaced-apart bridges are located; wherein said rigid frame is at a same level as, and does not protrude relative to, a fabric of said second-region of the back-side of the bra.

In some embodiments, said female member comprises a flexible frame in which said multiple spaced-apart bridges are located; wherein said flexible frame is at a same level as, and does not protrude relative to, a fabric of said second-region of the back-side of the bra.

In some embodiments, the single hook of the male member is a generally mushroom-shaped hook member, comprising: a mushroom base portion having a first average width; a mushroom neck portion having a second average width; a mushroom top portion having a third average width; wherein the mushroom neck portion is located between the mushroom base portion and the mushroom top portion; wherein the second average width of the mushroom neck portion, is smaller than the first average width of the mushroom base portion; wherein the second average width of the mushroom neck portion, is smaller than the third average width of the mushroom top portion.

In some embodiments, the mushroom top portion ends with a non-flat tip which is curved inwardly towards the wearer.

In some embodiments, the single hook of the male member is a generally mushroom-shaped hook member, comprising: a mushroom base portion having a first average width; a mushroom neck portion having a second average width; a mushroom top portion having a third average width; wherein the mushroom neck portion is located between the mushroom base portion and the mushroom top portion; wherein the second average width of the mushroom neck portion, is smaller than the first average width of the mushroom base portion; wherein the second average width of the mushroom neck portion, is smaller than the third average width of the mushroom top portion; wherein the third average width of the mushroom top portion, is smaller than the first average width of the mushroom base portion.

In some embodiments, the mushroom top portion ends with a non-flat tip which is curved outwardly.

In some embodiments, exactly one particular bridge, out of said multiple spaced-apart bridges, has a bridge length which is greater than a common bridge length that is common to all other bridges.

In some embodiments, exactly one particular bridge, out of said multiple spaced-apart bridges, has a bridge shape which is different than a common bridge shape that is common to all other bridges.

In some embodiments, exactly one particular bridge, out of said multiple spaced-apart bridges, has a first texture; wherein all other bridges have a second, different, texture.

In some embodiments, said bridges are non-equally spaced apart.

In some embodiments, (A) a distance between a first bridge and a second bridge of said bridges, is different from (B) a distance between the second bridge and a third bridge of said bridges.

In some embodiments, the male member comprises: a buffer rod which covers an entirety of a tip of said first-region of the back-side of the bra; wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod; wherein the buffer rod is located on a first plane, which is generally parallel to a plane on which fabric of said first-region is located; wherein the generally mushroom-shaped hook is located on a second plane which (A) is slanted inwardly relative to the buffer rod, and (B) is slanted inwardly relative to the plane on which fabric of said first-region is located.

In some embodiments, the female member comprises: a first fabric layer intended to touch a back of a wearer of the bra; a second fabric layer intended not to touch the back of the wearer, and intended to face outwardly relative to the back of the wearer; an intermediate non-fabric layer that is sandwiched between the first fabric layer and the second fabric layer; wherein each one of said bridges is held in place by said intermediate non-fabric layer; wherein each one of said bridges has two bases, (A) which are internal to said intermediate non-fabric layer, and (B) which are not visible to a wearer of said bra, and (C) which are held in place by said intermediate non-fabric layer, and (D) which are non-exposed to direct touching by the wearer of the bra.

In some embodiments, the first fabric layer, and the second fabric layer, and the intermediate non-fabric layer, are held together by glue.

In some embodiments, the first fabric layer, and the second fabric layer, and the intermediate non-fabric layer, are held together by one or more ultrasonic welding structures.

In some embodiments, the female member comprises: a first fabric layer intended to touch a back of a wearer of the bra; a second fabric layer intended not to touch the back of the wearer, and intended to face outwardly relative to the back of the wearer; an intermediate sponge layer that is sandwiched between the first fabric layer and the second fabric layer; wherein each one of said bridges is held in place by said intermediate sponge layer; wherein each one of said bridges has two bases, (A) which are internal to said intermediate sponge layer, and (B) which are not visible to a wearer of said bra, and (C) which are held in place by said intermediate sponge layer, and (D) which are non-exposed to direct touching by the wearer of the bra.

In some embodiments, the male member does not extend and does not protrude beyond a fabric edge of said first-region of the back-side of the bra; wherein the male member comprises a mushroom-shaped hook, having a mushroom-base at an edge of the fabric edge of said first-region, and having a mushroom-top located inwardly relative to said edge of the fabric edge of said first-region; wherein a bridge-engaging portion of said mushroom-shaped hook, (A) is non-parallel to a fabric plane of said first-region, and (B) is slanted inwardly relative to said fabric plane of said first-region.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is greater than a distance between two spaced-apart bridges of the female member.

In some embodiments, the male member does not extend and does not protrude beyond a fabric edge of said first-region of the back-side of the bra; wherein the male member comprises a generally mushroom-shaped hook, wherein a distance between a mushroom-base of said hook and a mushroom-top of said hook is smaller than a distance between two spaced-apart bridges of the female member.

In some embodiments, the fastener comprises an audible snapping mechanism, wherein secure engagement of the male member and the female member generates an audible click sound to convey to the wearer that the fastener is securely engaged.

In some embodiments, a brassiere comprises: a right-cup and a left-cup located at a front-side of the brassiere; a front-side fastener located at a front-side of the bra, between the right-cup and the left-cup; wherein the front-side fastener enables (A) attachment of the right-cup to the left-cup, and (B) detachment of the right-cup from the left-cup; wherein the fastener comprises: (I) a male member that is attached to a first cup selected from the right-cup and the left-cup, and (II) a female member that is attached to a second, different, cup selected from the right-cup and the left cup; wherein the male member comprises a single hook; wherein the female member comprises a set of multiple spaced-apart bridges, each bridge protruding outwardly and generally-perpendicularly relative to a longest dimension of the female member; wherein each bridge is generally perpendicular to a longest dimension of the front-side fastener; wherein each bridge covers at least 51 percent of a north-to-south width of the front-side fastener of the bra; wherein an engaging tip of said single hook of the male member covers at least 51 percent of the north-to-south width of the female member; wherein the right-cup and the left-cup are held together via said single hook which engages with one of said bridges; and wherein said fastener does not include two or more hooks that engage with two or more respective eyes.

In some embodiments of the present invention, regions and/or portions and/or elements and/or components may have various scales and/or ratios and/or dimensions and/or sizes, such that the elements shown in the figures are not necessarily drawn to scale, and are not intended to limit the present invention. The present invention comprises and includes any combination of parameters and/or features that is disclosed in the text and/or is shown in any of the drawings, including the particular values and/or sizes and/or ratios that are disclosed in the text, and including the particular ratios and/or scales that are actually shown in the figures, and including any other suitable value that is disclosed in this text and/or in any of the drawings. However, in some embodiments of the present invention, the articles or components shown in the drawings have the exact scale or ratio that is shown in the drawing(s) and which may be relied upon; such that the present invention does indeed comprise, among various other implementations and embodiments, also and/or at least the exact scale(s) and/or exact ratio(s) among components or dimensions as shown in the drawings.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A bra comprising:

two cups located at a front-side of the bra;

a fastener located at a back-side of the bra, wherein the back-side of the bra has a first region and a second region, wherein the fastener enables (A) attachment of the first region to the second region, and (B) detachment of the first region from the second region;

wherein the fastener comprises: (I) a male member located in the first region of the back-side of the bra, and (II) a female member located in said second region of the back-side of the bra;

wherein the male member comprises a single hook;

wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra;

wherein each bridge covers at least 51 percent of a north-to-south width of the second region of the back-side of the bra;

wherein an engaging tip of said single hook of the male member covers at least 51 percent of the north-to-south width of the first region of the back-side of the bra;

wherein an edge of the first region and an edge of the second region, which are generally parallel to each other, are held together via said single hook which engages with one of said bridges; and wherein said fastener does not include two or more hooks that engage with two or more respective eyes;

wherein the single hook of the male member is a generally mushroom-shaped hook member, comprising:

a mushroom base portion having a first average width;

a mushroom neck portion having a second average width;

a mushroom top portion having a third average width;

wherein the mushroom neck portion is located between the mushroom base portion and the mushroom top portion;

wherein the second average width of the mushroom neck portion, is smaller than the first average width of the mushroom base portion;

wherein the second average width of the mushroom neck portion, is smaller than the third average width of the mushroom top portion;

wherein the third average width of the mushroom top portion, is smaller than the first average width of the mushroom base portion.

2. The bra of claim 1, wherein said female member comprises a rigid frame in which said multiple spaced-apart bridges are located; wherein said rigid frame is at a same level as, and does not protrude relative to, a fabric of said second-region of the back-side of the bra.

3. The bra of claim 1, wherein said female member comprises a flexible frame in which said multiple spaced-apart bridges are located; wherein said flexible frame is at a same level as, and does not protrude relative to, a fabric of said second-region of the back-side of the bra.

4. The bra of claim 1, wherein the mushroom top portion ends with a non-flat tip which is curved inwardly towards the wearer.

5. The bra of claim 1, wherein the mushroom top portion ends with a non-flat tip which is curved outwardly.

6. The bra of claim 1, wherein exactly one particular bridge, out of said multiple spaced-apart bridges, has a bridge length which is greater than a common bridge length that is common to all other bridges.

7. A bra comprising:

two cups located at a front-side of the bra;

a fastener located at a back-side of the bra, wherein the back-side of the bra has a first region and a second region, wherein the fastener enables (A) attachment of the first region to the second region, and (B) detachment of the first region from the second region;

wherein the fastener comprises: (I) a male member located in the first region of the back-side of the bra, and (II) a female member located in said second region of the back-side of the bra;

wherein the male member comprises a single hook;

wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra;

wherein each bridge covers at least 51 percent of a north-to-south width of the second region of the back-side of the bra;

wherein an engaging tip of said single hook of the male member covers at least 51 percent of the north-to-south width of the first region of the back-side of the bra;

wherein an edge of the first region and an edge of the second region, which are generally parallel to each other, are held together via said single hook which engages with one of said bridges; and wherein said fastener does not include two or more hooks that engage with two or more respective eyes;

wherein exactly one particular bridge, out of said multiple spaced-apart bridges, has a bridge shape which is different than a common bridge shape that is common to all other bridges.

8. The bra of claim 1, wherein the single hook of the male member is a generally mushroom-shaped hook member, comprising:

a mushroom base portion having a first average width;

a mushroom neck portion having a second average width;

a mushroom top portion having a third average width;

wherein the mushroom neck portion is located between the mushroom base portion and the mushroom top portion;

wherein the second average width of the mushroom neck portion, is smaller than the first average width of the mushroom base portion;

wherein the second average width of the mushroom neck portion, is smaller than the third average width of the mushroom top portion.

9. The bra of claim 7, wherein the male member does not extend and does not protrude beyond a fabric edge of said first-region of the back-side of the bra;

wherein the male member comprises a generally mushroom-shaped hook, wherein a distance between a mushroom-base of said hook and a mushroom-top of said hook is smaller than a distance between two spaced-apart bridges of the female member.

10. A bra comprising:

two cups located at a front-side of the bra;

a fastener located at a back-side of the bra, wherein the back-side of the bra has a first region and a second region, wherein the fastener enables (A) attachment of the first region to the second region, and (B) detachment of the first region from the second region;

wherein the fastener comprises: (I) a male member located in the first region of the back-side of the bra, and (II) a female member located in said second region of the back-side of the bra;

wherein the male member comprises a single hook;

wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra;

wherein each bridge covers at least 51 percent of a north-to-south width of the second region of the back-side of the bra;

wherein an engaging tip of said single hook of the male member covers at least 51 percent of the north-to-south width of the first region of the back-side of the bra;

wherein an edge of the first region and an edge of the second region, which are generally parallel to each other, are held together via said single hook which engages with one of said bridges; and wherein said fastener does not include two or more hooks that engage with two or more respective eyes;

wherein the female member comprises:

a first fabric layer intended to touch a back of a wearer of the bra;

a second fabric layer intended not to touch the back of the wearer, and intended to face outwardly relative to the back of the wearer;

an intermediate non-fabric layer that is sandwiched between the first fabric layer and the second fabric layer;

wherein each one of said bridges is held in place by said intermediate non-fabric layer;

wherein each one of said bridges has two bases, (A) which are internal to said intermediate non-fabric layer, and (B) which are not visible to a wearer of said bra, and (C) which are held in place by said intermediate non-fabric layer, and (D) which are non-exposed to direct touching by the wearer of the bra.

11. The bra of claim 10, wherein exactly one particular bridge, out of said multiple spaced-apart bridges, has a first texture; wherein all other bridges have a second, different, texture.

12. The bra of claim 10, wherein said bridges are non-equally spaced apart.

13. The bra of claim 10, wherein the male member comprises:

a buffer rod which covers an entirety of a tip of said first-region of the back-side of the bra;

wherein the buffer rod is integrally connected to the single hook which is generally mushroom-shaped; wherein a mushroom base edge of said single hook touches a longest edge of the buffer rod; wherein the single hook which is generally mushroom-shaped points backwardly away from said tip of said first-region and away from said buffer rod;

wherein the buffer rod is located on a first plane, which is generally parallel to a plane on which fabric of said first-region is located;

wherein the generally mushroom-shaped hook is located on a second plane which (A) is slanted inwardly relative to the buffer rod, and (B) is slanted inwardly relative to the plane on which fabric of said first-region is located.

14. The bra of claim 10, wherein the first fabric layer, and the second fabric layer, and the intermediate non-fabric layer, are held together by glue.

15. The bra of claim 10, wherein the first fabric layer, and the second fabric layer, and the intermediate non-fabric layer, are held together by one or more ultrasonic welding structures.

16. The bra of claim 10, wherein the male member does not extend and does not protrude beyond a fabric edge of said first-region of the back-side of the bra;

wherein the male member comprises a mushroom-shaped hook, having a mushroom-base at an edge of the fabric edge of said first-region, and having a mushroom-top located inwardly relative to said edge of the fabric edge of said first-region;

wherein a bridge-engaging portion of said mushroom-shaped hook, (A) is non-parallel to a fabric plane of said first-region, and (B) is slanted inwardly relative to said fabric plane of said first-region.

17. The bra of claim 10, wherein the fastener comprises an audible snapping mechanism, wherein secure engagement of the male member and the female member generates an audible click sound to convey to the wearer that the fastener is securely engaged.

18. A bra comprising:

two cups located at a front-side of the bra;

a fastener located at a back-side of the bra, wherein the back-side of the bra has a first region and a second region, wherein the fastener enables (A) attachment of the first region to the second region, and (B) detachment of the first region from the second region;

wherein the fastener comprises: (I) a male member located in the first region of the back-side of the bra, and (II) a female member located in said second region of the back-side of the bra;

wherein the male member comprises a single hook;

wherein the female member comprises a set of multiple spaced-apart bridges, each bridge protruding outwardly and generally-perpendicularly relative to said second region of the back-side of the bra; wherein each bridge is generally perpendicular to the longest dimension of the back-side of the bra;

wherein each bridge covers at least 51 percent of a north-to-south width of the second region of the back-side of the bra;

wherein an engaging tip of said single hook of the male member covers at least 51 percent of the north-to-south width of the first region of the back-side of the bra;

wherein an edge of the first region and an edge of the second region, which are generally parallel to each other, are held together via said single hook which engages with one of said bridges; and wherein said fastener does not include two or more hooks that engage with two or more respective eyes;

wherein the female member comprises:

a first fabric layer intended to touch a back of a wearer of the bra;

a second fabric layer intended not to touch the back of the wearer, and intended to face outwardly relative to the back of the wearer;

an intermediate sponge layer that is sandwiched between the first fabric layer and the second fabric layer;

wherein each one of said bridges is held in place by said intermediate sponge layer;

wherein each one of said bridges has two bases, (A) which are internal to said intermediate sponge layer, and (B) which are not visible to a wearer of said bra, and (C) which are held in place by said intermediate sponge layer, and (D) which are non-exposed to direct touching by the wearer of the bra.

19. The bra of claim 18, wherein the male member does not extend and does not protrude beyond a fabric edge of said first-region of the back-side of the bra;

wherein the male member comprises a generally mushroom-shaped hook, wherein a distance between a mushroom-base of said hook and a mushroom-top of said hook is greater than a distance between two spaced-apart bridges of the female member.

20. The bra of claim 18, wherein (A) a distance between a first bridge and a second bridge of said bridges, is different from (B) a distance between the second bridge and a third bridge of said bridges.

* * * * *